US008678570B2

(12) United States Patent
Matsumoto et al.

(10) Patent No.: US 8,678,570 B2
(45) Date of Patent: Mar. 25, 2014

(54) LIQUID CONTAINER AND LIQUID SUPPLYING SYSTEM

(75) Inventors: Haruyuki Matsumoto, Kanagawa (JP); Kenjiro Watanabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 12/856,478

(22) Filed: Aug. 13, 2010

(65) Prior Publication Data

US 2010/0309265 A1 Dec. 9, 2010

Related U.S. Application Data

(62) Division of application No. 11/016,903, filed on Dec. 21, 2004.

(30) Foreign Application Priority Data

Dec. 26, 2003 (JP) ..... 2003-435942

(51) Int. Cl.
*B41J 2/175* (2006.01)
*B41J 2/17* (2006.01)

(52) U.S. Cl.
USPC ..... 347/86; 347/85; 347/84

(58) Field of Classification Search
USPC ..... 347/84–86
See application file for complete search history.

(56) References Cited

U.S. PATENT DOCUMENTS 5,049,898 A 9/1991 Arthur et al. ..... 346/1.1
5,304,812 A * 4/1994 Tani et al. ..... 250/551
5,365,312 A 11/1994 Hillmann et al. ..... 355/206
5,400,066 A 3/1995 Matsumoto et al. ..... 347/86
5,519,418 A 5/1996 Nishikami et al. ..... 347/19
5,567,063 A 10/1996 Chiu ..... 400/174
5,583,549 A 12/1996 Ujita et al. ..... 347/86
5,589,859 A 12/1996 Schantz ..... 347/19
5,610,635 A * 3/1997 Murray et al. ..... 347/7
5,616,929 A 4/1997 Hara ..... 250/573

(Continued)

FOREIGN PATENT DOCUMENTS

EP 0 412 459 A2 8/1990
EP 0 779 156 6/1997

(Continued)

OTHER PUBLICATIONS

PCT International Search Report dated Apr. 19, 2005, from corresponding International Application No. PCT/JP2004/019786.

(Continued)

*Primary Examiner* — Sarah Al Hashimi
(74) *Attorney, Agent, or Firm* — Fitzpatrick, Cella, Harper & Scinto

(57) ABSTRACT

A liquid container detachably mountable to a recording apparatus to which a plurality of liquid containers are detachably mountable, wherein the recording apparatus includes apparatus electrical contacts corresponding to the liquid containers, respectively, photoreceptor means for receiving light, and an electric circuit connected with a line which is commonly connected with the apparatus electrical contacts, the liquid container includes a container electrical contact electrically connectable with one of the apparatus contacts; an information storing portion capable of storing at least individual information of the liquid container; a light emitting portion; a controller for controlling emission of light of the light emitting portion in response to a correspondence between a signal indicative of individual information supplied through the container electrical contact and the information stored in the information storing means.

71 Claims, 35 Drawing Sheets

(56) References Cited

U.S. PATENT DOCUMENTS

| | | | | |
|---|---|---|---|---|
| 5,625,384 | A * | 4/1997 | Numata et al. | 347/23 |
| 5,689,290 | A | 11/1997 | Saito et al. | 347/7 |
| 5,699,091 | A | 12/1997 | Bullock et al. | 347/19 |
| 5,903,294 | A | 5/1999 | Abe et al. | 347/87 |
| 5,930,140 | A | 7/1999 | Asai et al. | 364/468.28 |
| 5,940,102 | A | 8/1999 | Watanabe et al. | 347/86 |
| 6,024,428 | A | 2/2000 | Uchikata | 347/7 |
| 6,062,667 | A | 5/2000 | Matsui et al. | 347/19 |
| 6,097,405 | A | 8/2000 | Lo et al. | 347/6 |
| 6,151,041 | A | 11/2000 | Bolash et al. | 347/19 |
| 6,196,670 | B1 | 3/2001 | Saruta | 347/86 |
| 6,243,109 | B1 | 6/2001 | Ishinaga et al. | 347/3 |
| 6,246,484 | B1 | 6/2001 | Shimamura et al. | 358/1.12 |
| 6,299,274 | B1 | 10/2001 | Bolash et al. | 347/19 |
| 6,302,535 | B1 | 10/2001 | Sturgeon et al. | 347/86 |
| 6,312,074 | B1 | 11/2001 | Walker | 347/7 |
| 6,312,084 | B1 | 11/2001 | Ujita et al. | 347/19 |
| 6,361,136 | B1 | 3/2002 | Watanabe et al. | 347/7 |
| 6,386,722 | B2 | 5/2002 | Okumura | 362/31 |
| 6,390,590 | B1 | 5/2002 | Hansburg | 347/19 |
| 6,402,310 | B1 | 6/2002 | Maeda et al. | 347/87 |
| 6,422,675 | B1 | 7/2002 | Tomomatsu | 347/7 |
| 6,431,681 | B2 | 8/2002 | Hatasa et al. | 347/19 |
| 6,454,400 | B1 | 9/2002 | Morita et al. | 347/86 |
| 6,464,338 | B1 | 10/2002 | Morita et al. | 347/49 |
| 6,502,916 | B1 | 1/2003 | Naka | 347/14 |
| 6,504,565 | B1 | 1/2003 | Narita et al. | 347/237 |
| 6,513,891 | B2 | 2/2003 | Eida | 347/7 |
| 6,531,695 | B2 | 3/2003 | Fukazawa et al. | 250/239 |
| 6,540,340 | B2 * | 4/2003 | Thorpe et al. | 347/85 |
| 6,547,363 | B1 | 4/2003 | Shinada et al. | 347/19 |
| 6,554,411 | B1 | 4/2003 | Hatasa et al. | 347/86 |
| 6,604,560 | B2 | 8/2003 | Ikemoto et al. | 141/147 |
| 6,609,788 | B2 | 8/2003 | Hatasa et al. | 347/86 |
| 6,609,792 | B2 * | 8/2003 | Kaga et al. | 347/104 |
| 6,666,540 | B2 | 12/2003 | Asauchi | 347/19 |
| 6,685,296 | B2 * | 2/2004 | Mochizuki et al. | 347/19 |
| 6,702,427 | B2 | 3/2004 | Shimizu et al. | 347/50 |
| 6,719,394 | B2 | 4/2004 | Kubota et al. | 347/19 |
| 6,742,857 | B2 | 6/2004 | Koshikawa et al. | 347/19 |
| 6,742,872 | B2 | 6/2004 | Fukazawa et al. | 347/50 |
| 6,767,075 | B1 | 7/2004 | Takada et al. | 347/19 |
| 6,769,754 | B2 | 8/2004 | Imanaka et al. | 347/7 |
| 6,808,256 | B2 | 10/2004 | Umeyama et al. | 347/87 |
| 6,815,381 | B1 | 11/2004 | Yamamoto et al. | 442/187 |
| 6,824,258 | B2 | 11/2004 | Yamamoto et al. | 347/86 |
| 6,827,411 | B2 | 12/2004 | Kubota et al. | 347/7 |
| 6,869,158 | B2 | 3/2005 | Kojima et al. | 347/19 |
| 6,935,716 | B2 | 8/2005 | Hatasa et al. | |
| 6,971,732 | B1 | 12/2005 | Seshimo et al. | 347/19 |
| 7,213,914 | B2 | 5/2007 | Anma et al. | 347/86 |
| 7,237,881 | B2 | 7/2007 | Hayasaki et al. | 347/86 |
| 7,278,721 | B2 | 10/2007 | Shimizu et al. | 347/86 |
| 7,321,436 | B2 | 1/2008 | Asauchi | 358/1.15 |
| 7,841,681 | B2 | 11/2010 | Hatasa et al. | 347/14 |
| 7,841,711 | B2 | 11/2010 | Matsumoto et al. | 347/86 |
| 7,928,935 | B2 * | 4/2011 | Kanda | 345/77 |
| 2001/0012026 | A1 | 8/2001 | Kobayashi et al. | 347/19 |
| 2001/0033316 | A1 * | 10/2001 | Eida | 347/86 |
| 2001/0048459 | A1 | 12/2001 | Sakai et al. | 347/233 |
| 2002/0005872 | A1 | 1/2002 | Goto et al. | 347/22 |
| 2002/0008722 | A1 | 1/2002 | Imanaka et al. | 347/14 |
| 2002/0008724 | A1 * | 1/2002 | Kubota et al. | 347/19 |
| 2002/0033855 | A1 | 3/2002 | Kubota et al. | 347/19 |
| 2002/0101469 | A1 | 8/2002 | Wade et al. | 347/19 |
| 2002/0118241 | A1 | 8/2002 | Fujii | 347/12 |
| 2002/0135629 | A1 * | 9/2002 | Sarmast et al. | 347/19 |
| 2002/0140750 | A1 * | 10/2002 | Yoshiyama et al. | 347/7 |
| 2002/0149633 | A1 | 10/2002 | Murakami et al. | 347/7 |
| 2002/0175979 | A1 | 11/2002 | Morita et al. | 347/86 |
| 2002/0191041 | A1 | 12/2002 | Asauchi | 347/19 |
| 2003/0002080 | A1 | 1/2003 | Asauchi | 258/1.16 |
| 2003/0011654 | A1 * | 1/2003 | Asauchi | 347/19 |
| 2003/0025766 | A1 * | 2/2003 | Tanaka et al. | 347/65 |
| 2003/0156172 | A1 | 8/2003 | Matsuba et al. | 347/86 |
| 2003/0184623 | A1 | 10/2003 | Sasaki et al. | 347/85 |
| 2003/0202062 | A1 | 10/2003 | Steinmetz et al. | 347/86 |
| 2003/0209990 | A1 | 11/2003 | Kawasaki et al. | 315/169.3 |
| 2003/0215280 | A1 | 11/2003 | Hatasa et al. | 401/132 |
| 2003/0227501 | A1 | 12/2003 | Hatasa et al. | 347/19 |
| 2003/0231915 | A1 | 12/2003 | Jakubowski et al. | 400/76 |
| 2003/0234844 | A1 | 12/2003 | Yamamoto et al. | 347/86 |
| 2004/0017445 | A1 | 1/2004 | Kojima et al. | 347/85 |
| 2004/0100540 | A1 | 5/2004 | Hatasa et al. | 347/86 |
| 2005/0007420 | A1 | 1/2005 | Ogawa et al. | 347/50 |
| 2005/0036016 | A1 | 2/2005 | Watanabe et al. | 347/86 |
| 2010/0309265 | A1 | 12/2010 | Matsumoto et al. | 347/86 |

FOREIGN PATENT DOCUMENTS

| | | | |
|---|---|---|---|
| EP | 1114726 | | 7/2001 |
| EP | 1132817 | | 9/2001 |
| EP | 1 153 752 | | 11/2001 |
| EP | 1153752 | | 11/2001 |
| EP | 1164022 | | 12/2001 |
| EP | 1170713 | | 1/2002 |
| EP | 1247651 | | 10/2002 |
| EP | 1270236 | | 1/2003 |
| EP | 1348560 | | 10/2003 |
| GB | 2317589 | | 4/1998 |
| JP | 54-007825 | | 1/1979 |
| JP | 57-6782 | | 1/1982 |
| JP | 57-051480 | | 3/1982 |
| JP | 58-204314 | | 11/1983 |
| JP | 60-032667 | | 2/1985 |
| JP | 61-010215 | Y | 4/1986 |
| JP | 62-193867 | | 8/1987 |
| JP | 1-016207 | | 1/1989 |
| JP | 64-016207 | | 1/1989 |
| JP | 2-279344 | | 11/1990 |
| JP | 4-500482 | | 1/1992 |
| JP | 4-188924 | | 7/1992 |
| JP | 4-199753 | | 7/1992 |
| JP | 4-275156 | | 9/1992 |
| JP | 04275156 | A * | 9/1992 |
| JP | 6-115089 | | 4/1994 |
| JP | 6-126981 | | 5/1994 |
| JP | 6-155769 | | 6/1994 |
| JP | 6-262771 | | 9/1994 |
| JP | 7-076104 | | 3/1995 |
| JP | 7-076145 | | 3/1995 |
| JP | 7-218321 | | 8/1995 |
| JP | 7-323573 | | 12/1995 |
| JP | 9-029989 | | 2/1997 |
| JP | 9-309213 | | 12/1997 |
| JP | 10-044451 | | 2/1998 |
| JP | 10-65188 | | 3/1998 |
| JP | 10-109429 | | 4/1998 |
| JP | 10-112598 | | 4/1998 |
| JP | 10-200690 | | 7/1998 |
| JP | 10-230616 | | 9/1998 |
| JP | 10-323993 | | 12/1998 |
| JP | 11-263025 | | 9/1999 |
| JP | 11-286121 | | 10/1999 |
| JP | 11-342662 | | 12/1999 |
| JP | 2000-103087 | | 4/2000 |
| JP | 2000-127444 | | 5/2000 |
| JP | 2000-301738 | | 10/2000 |
| JP | 2000-326604 | | 11/2000 |
| JP | 2000-334974 | | 12/2000 |
| JP | 2001-253087 | | 9/2001 |
| JP | 2001-287381 | | 10/2001 |
| JP | 2001-293883 | | 10/2001 |
| JP | 2001287381 | A * | 10/2001 |
| JP | 2001-310458 | | 11/2001 |
| JP | 2001-353926 | | 12/2001 |
| JP | 2001-358291 | | 12/2001 |
| JP | 2001-358292 | | 12/2001 |
| JP | 2002-001933 | | 1/2002 |
| JP | 2002-001934 | | 1/2002 |
| JP | 2002-001990 | | 1/2002 |
| JP | 2002-005724 | | 1/2002 |
| JP | 2002-005818 | | 1/2002 |
| JP | 2002-007984 | | 1/2002 |

(56) References Cited

FOREIGN PATENT DOCUMENTS

| | | |
|---|---|---|
| JP | 2002-014870 | 1/2002 |
| JP | 2002-079685 | 3/2002 |
| JP | 2002-086697 | 3/2002 |
| JP | 2002-113882 | 4/2002 |
| JP | 2002-120379 | 4/2002 |
| JP | 2002-234187 | 8/2002 |
| JP | 2002-301829 | 11/2002 |
| JP | 2002-326604 | 11/2002 |
| JP | 2002-361890 | 12/2002 |
| JP | 2002-370378 | 12/2002 |
| JP | 2002-370383 | 12/2002 |
| JP | 2003-237101 | 8/2003 |
| JP | 2003-291364 | 10/2003 |
| JP | 2003-300358 | 10/2003 |
| JP | 2003-341085 | 12/2003 |
| JP | 2005-205886 | 8/2005 |
| WO | 00/43932 | 7/2000 |
| WO | 02/40275 | 5/2002 |

OTHER PUBLICATIONS

English language translation of a Decision on Granting Patent for Invention, from corresponding Russian Application No. 2004138032.
English language translation of a Chinese Office Action dated Nov. 3, 2006, from corresponding Chinese Application No. 200410061594.3.
Search and Examination Report from the Singapore Patent Office (apparently prepared by the Austrian Patent Office on behalf of the Singapore Patent Office) dated Nov. 11, 2006, from corresponding Singapore Application No. 200407934-9.
European Search Report dated Sep. 17, 2008, from corresponding European Application No. 04030455.2.
Excerpted translation of Japanese Office Action dated Dec. 9, 2008 in a Japanese counterpart application to U.S. Patent 7,237,881.
European Examination Report dated Feb. 16, 2009, from corresponding European Application No. 04030455.2.
European Examination Report dated Apr. 23, 2009, from corresponding European Application No. 09150215.3.
Ukranian Decision on Grant, which appears to bear a date of Feb. 27, 2009, from corresponding Ukranian Application No. 200608359/(MI-4158), together with an English language translation thereof.
Letter from Philippine associate in corresponding Philippine Application No. 1-2006-501257.
Canadian Office Action dated Apr. 22, 2010, from corresponding Canadian Application No. 2,490,732.
Explanation of Circumstances Concerning Accelerated Examination dated Dec. 28, 2005, from corresponding Japanese Application No. 2004-330952, and excerpt translation thereof.
Notification of Reasons for Rejected the Demand for Correction 2009-800007, dated May 7, 2009, and excerpt translation thereof.
Decision of Invalidation Trial 2009-800006, dated Aug. 24, 2009, and excerpt translation thereof.
Decision of Invalidation Trial 2009-800101, dated Jan. 26, 2010, and excerpt translation thereof.
Extended European Search Report from corresponding European Application No. 10177371.1, dated Nov. 23, 2010.
Extended European Search Report from corresponding European Application No. 10177369,5, dated Dec. 9, 2010.
Extended European Search Report dated Apr. 20, 2011, from corresponding European Application No. 11154691.7.
European Patent Office Communication dated May 2, 2011, from corresponding European Application No. 04030455.2.
Summons in Official Letter dated Jul. 11, 2011 in German Application No. 11-2004-002498.6, with English translation.
Summons in Official Letter dated Jul. 11, 2011 in German Application No. 11-2004-003063.3, with English translation.
Data Microchip 93LC756/86, "8K/16K 2.5V Microwire Serial EEPROM", 1998 Microchip Technology Inc. (pp. 27 to 38).
U. Tietze Ch. Schenk, Halbleiter-Schaltungstechnik, Zehnte Auflage, Mit 1166 Abbildungen, Springer-Verlag (pp. 39 to 49) and English translation.
European Search Report dated Sep. 23, 2008 in European Application 04030458.6, which is a counterpart to U.S. Patent 7,237,881.
European Search Report dated Apr. 5, 2011 in European Application 10195661.3, which is a counterpart to U.S. Patent 7,237,881.
European Search Report dated Apr. 8, 2011 in European Application 11150832.1, which is a counterpart to U.S. Patent 7,237,881.
European Search Report dated Apr. 15, 2011 in European Application 11154693.3, which is a counterpart to U.S. Patent 7,237,881.
Korean Notice of Allowance dated May 25, 2007 in Korean Application 10-2004-0111800, which is a counterpart to U.S. Patent 7,237,881.
Search and Examination Report dated Nov. 30, 2006 in Singapore Application 200407932-3 (apparently conducted by the Austrian Patent Office on Nov. 17, 2006), which is a counterpart to U.S. Patent.
Search Report and Written Opinion dated Oct. 18, 2010 in Singapore Application 200704787-1 (apparently conducted by the Austrian Patent Office on Jul. 29, 2010), which is a counterpart to U.S. Patent 7,237,881.
Search and Examination Report dated Jul. 19, 2011 in Singapore Application 200704787-1 (apparently conducted by the Austrian Patent Office on Jun. 14, 2011), which is a counterpart to U.S. Patent 7,237,881.
Notification of Ground of Rejection dated Feb. 24, 2012 in Japan Application 2010-010498, which is a counterpart to U.S. Patent 7,237,881, and excerpted English language translation thereof.
Notification of Ground of Rejection dated Dec. 17, 2010 in Japan Application 2009-027896, which is a counterpart to U.S. Patent 7,237,881, and excerpted English language translation thereof.
Official Letter dated May 24, 2013 in counterpart German Application No. 11 2004 003 139.7, and English language translation thereof.
Official Letter dated May 24, 2013 in counterpart German Application No. 11 2004 003 140.0, and English language translation thereof.
European Communication dated Jan. 3, 2014, in counterpart European Patent Application No. 04 030 455.2.

* cited by examiner (a)

(b)

STRT CODE + CLR INF | CTRL CODE

| | | | | | | |
|---|---|---|---|---|---|---|
| K-OFF | 0 | 0 | 0 | 0 | 0 | 0 |
| K-ON | 0 | 0 | 0 | 1 | 0 | 0 |
| ALL-OFF | 1 | 1 | 1 | 0 | 0 | 0 |
| ALL-ON | 1 | 1 | 1 | 1 | 0 | 0 |
| K-CALL | 0 | 0 | 0 | 0 | 0 | 1 |

COMMANDS TO CTLR ON CNTTNR 1K

| | | | | | | |
|---|---|---|---|---|---|---|
| C-OFF | 1 | 0 | 0 | 0 | 0 | 0 |
| C-ON | 1 | 0 | 0 | 1 | 0 | 0 |
| ALL-OFF | 1 | 1 | 1 | 0 | 0 | 0 |
| ALL-ON | 1 | 1 | 1 | 1 | 0 | 0 |
| C-CALL | 1 | 0 | 0 | 0 | 0 | 1 |

COMMANDS TO CTLR ON CNTTNR 1C

| | | | | | | |
|---|---|---|---|---|---|---|
| M-OFF | 0 | 1 | 0 | 0 | 0 | 0 |
| M-ON | 0 | 1 | 0 | 1 | 0 | 0 |
| ALL-OFF | 1 | 1 | 1 | 0 | 0 | 0 |
| ALL-ON | 1 | 1 | 1 | 1 | 0 | 0 |
| M-CALL | 0 | 1 | 0 | 0 | 0 | 1 |

COMMANDS TO CTLR ON CNTTNR 1M

| | | | | | | |
|---|---|---|---|---|---|---|
| Y-OFF | 1 | 1 | 0 | 0 | 0 | 0 |
| Y-ON | 1 | 1 | 0 | 1 | 0 | 0 |
| ALL-OFF | 1 | 1 | 1 | 0 | 0 | 0 |
| ALL-ON | 1 | 1 | 1 | 1 | 0 | 0 |
| Y-CALL | 1 | 1 | 0 | 0 | 0 | 1 |

COMMANDS TO CTLR ON CNTTNR 1Y

LIQUID CONTAINER AND LIQUID SUPPLYING SYSTEM

This application is a division of U.S. application Ser. No. 11/016,903, filed Dec. 21, 2004, the contents of which are incorporated herein by reference. This application is also related to U.S. application Ser. No. 12/076,365, filed Mar. 18, 2008, U.S. application Ser. No. 12/318,706, filed Jan. 7, 2009, U.S. application Ser. No. 12/725,435, filed Mar. 16, 2010 and U.S. application Ser. No. 12/855,673, filed Aug. 12, 2010.

FIELD OF THE INVENTION AND RELATED ART

The present invention relates to a liquid container and a liquid supplying system, more particularly, to a liquid container which is capable of notifying a state of the liquid container using light emitting means such as a LED, the state including an ink remaining amount of an ink container for ink jet recording.

With recent wider use of digital camera, the demand is increasing for printing with the digital camera being directly connected with a printer (recording device), that is, non-PC printing. Another increasing demand is for printing by setting a card type information memory medium detachably mountable to a digital camera directly in a printer to transfer the data, and printing them (another non-PC recording). Generally, the ink remaining amount in the ink container of the printer is checked on a display through a personal computer. In the case of the non-PC printing, this is not possible. However, capability of checking the ink remaining amount in the ink container is desired even in the non-PC printing. This is because if the user can be aware of the fact that ink remaining amount in the ink container is small, the user can exchange the ink container with a fresh one prior to stating printing operation, so that printing failure during the course of printing on a sheet can be avoided.

Use of a display element such as a LED is known to notify the user of such a state of the ink container. For example, Japanese laid-open Patent Application Hei 4-275156 discloses that ink container which is integral with a recording head is provided with two LED elements, which are switched on depending on the ink remaining amount in two steps. Japanese Laid-open Patent Application 2002-301829 also discloses that ink container is provided with a lamp which is switched on depending on the ink remaining amount. The same also discloses that four ink containers used with one recording device are provided with said lamps, respectively.

In addition, in order to meet a demand for high image quality, light magenta ink, light cyan ink and so on become used in addition to the conventional four color (black, yellow, magenta and cyan) inks. Furthermore, use of special color inks such as red ink or blue ink are proposed. In such a case, seven-eight color ink containers are used individually in an ink jet printer. Then, a mechanism for preventing the ink containers from being mounted at erroneous positions is desired. U.S. Pat. No. 6,302,535 discloses that engaging configurations of the carriage, the ink containers are made different from each other, so that erroneous mounting (incorrect position) is prevented, when the ink containers are mounted on the carriage.

Even when the ink container is provided with a lamp, as disclosed in Japanese Laid-open Patent Application 2002-301829, the main assembly side controller has to identify the ink container which is recognized as containing less ink. To do this, it is necessary to identify the ink container to which the signal for turning the right lamp on. If, for example, the ink container is mounted on a wrong position, there is a liability that small ink remaining amount is displayed for another ink container which contains a sufficient amount of the ink. Therefore, the emission control for the displaying device such as a lamp has to have correct information of the carried positions of the ink containers.

As to a structure for detecting the carried position of an ink container, there is a structure in which the mutual configuration relations between the carrying portions and the associated ink containers are made different depending on the carrying positions. However, in such a case, it is required to manufacturing ink containers which are different depending on the color and/or kind of the ink, with the result of disadvantages in terms of manufacturing efficiency and/or cost.

As another structure for accomplishing this, a signal line of a circuit which will be closed by connection between the electrical contact of the ink container and the main assembly side electrical contact at the carrying position of a carriage or the like, is provided substantially independently for each of the carrying positions. For example, the signal line for reading ink color information of an ink container out of the ink container, for controlling the actuation of a LED is provided for each of the carrying positions, by which if the read color information does not meet the carrying position, the erroneous mounting of the ink container is discriminated.

However, this structure result in increased number of signal lines. As mentioned hereinbefore, recent ink jet printers or the like use a greater number of kinds of inks to improve the image quality. The increase of the number of the signal lines increases the cost particularly in such printers. On the other hand, in order to reduce the number of wiring leads, it would be effective to employ a so-called common signal line using a bus connection, but simple use of such a common signal line as bus connection cannot determines the ink containers or the carrying positions of the ink containers.

SUMMARY OF THE INVENTION

Accordingly, it is a principal object of the present invention to provide a liquid container with which emission control is effected for displaying devices such as LEDs using a common signal line for a plurality of ink container carrying positions, and the carrying positions for the respective liquid containers (ink container) can be determined to effect the emission control of the displaying device for the respective liquid containers, despite the use of the common signal line.

Accordingly, it is a principal object of the present invention a liquid container detachably mountable to a recording apparatus to which a plurality of liquid containers are detachably mountable, wherein said recording apparatus includes apparatus electrical contacts corresponding to the liquid containers, respectively, photoreceptor means for receiving light, and an electric circuit connected with a line which is commonly connected with said apparatus electrical contacts, said liquid container comprising a container electrical contact electrically connectable with one of said apparatus contacts; an information storing portion capable of storing at least individual information of said liquid container; a light emitting portion; a controller for controlling emission of light of said light emitting portion in response to a correspondence between a signal indicative of individual information supplied through said container electrical contact and said information stored in said information storing means.

With this structure, the light emission of the light emitting portion is controlled on the basis of a signal inputted through a contact (pad) of an ink container (liquid container) connected with a contact (connector) provided in the main assembly side of the recording device and the information belonging to the ink container, so that even if the ink containers receive the same control signal through the common signal line, only the ink container having the matched individual information can be subjected to the light emission control. In this manner, the light emission control such as lightening of the light emitting portion can be effected for the matched ink container. As an additional feature, the light emission controller can sequentially actuate the light emitting portions of the ink containers carried on the carriage when the carriage is being moved, by providing means for detecting the light emission, and erroneous mounting of an ink container can be discriminated when the light is not detected at a position. By doing so, the user may be prompted to remount the ink container to a right position, and as a result respective carried positions of the ink containers can be detected.

Therefore, the use is made with a common signal line for a plurality of ink container carrying positions to control the light emission of displaying devices such as LEDs, even in such a case, the start effect controls of the displaying devices can be effected with the carrying positions of the liquid containers such as ink containers being specified.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 21 is a detailed circuit diagram of the substrate having a controller or the like.

DESCRIPTION OF THE PREFERRED EMBODIMENTS

The description will be made as to the embodiments of the present invention in conjunction with the accompanying drawings, in the following order:

1. Mechanical Structure:
1.1 Ink Container
1.2 Modified Example:
1.3 Ink Container Mounting Portion
1.4 Recording Device:
2. Control System:
2.1 General Arrangement:
2.2 Connecting Portion:
2.3 Control Process:
3. Other Embodiments:

1. Mechanical Structure

1.1 Ink Container (FIG. 1-FIG. 5)

Figure 1:
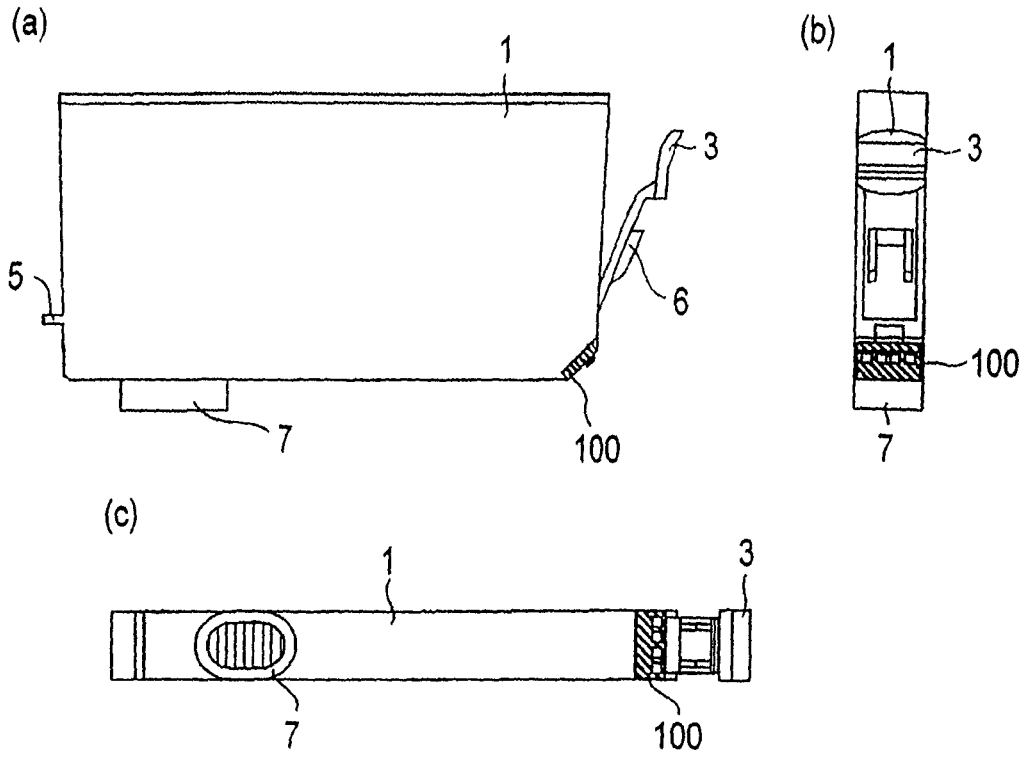
FIG. 1 is a side view (a), a front view (b) and a bottom view (c) of an ink container according to a first embodiment of the present invention.
Figure 2:
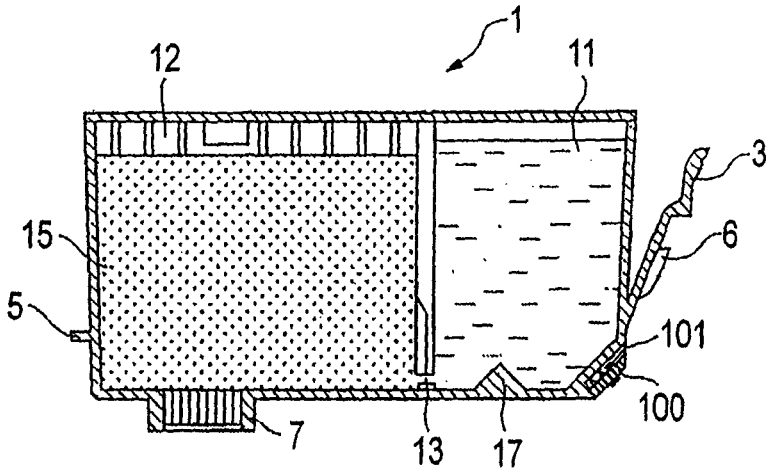
FIG. 2 is a sectional side elevation of the ink container according to the first embodiment of the present invention.

FIG. 1 is a side view (a), a front view (b) and a bottom view (c) of an ink container according to a first embodiment of the present invention. newpa FIG. 2 is a sectional side elevation of the ink container according to the first embodiment of the present invention. In the following descriptions, the front side of the ink container is the side which is faced to the user who is manipulating the ink container (mounting and demounting operation of the ink container), which provides the user with information (by light emission of LED which will be described hereinafter).

In FIG. 1, the ink container 1 of this embodiment has a supporting member 3 supported on the lower portion at the front side thereof. The supporting member 3 is made of resin material integrally molded with an outer casing of the ink container 1, and the ink container 1 is displaceable about a portion of the ink container to be supported when the ink container 1 is mounted to the container holder. The ink container 1 is provided on its rear side and front side with a first engaging portion 5 and second engaging portion 6, respectively, which are engageable with locking portions provided in a container holder. In this embodiment, they are integral with the supporting member 3. By engagement of the engaging portion 5 and the engaging portion 6 with the locking portions, the ink container 1 is securedly mounted in the ink container 1. The operation during the mounting will be described hereinafter referring to FIG. 15.

The bottom surface of the ink container 1 is provided with an ink supply port 7 for ink supply, which port is connectable with an ink introduction opening of the recording head which will be described hereinafter, by mounting of the ink container 1 to the container holder. A base member is provided on the bottom side of the supporting portion of the supporting member 3 at a position where the bottom side and the front side intersect with each other. The base member may be in the form of a chip or a plate. In the following description, it is called "Substrate" 100.

FIG. 2 is a sectional side elevation of the ink container 1. An inside of the ink container 1 is divided into an ink reservoir chamber 11 which is provided adjacent the front side where the supporting member 3 and the substrate 100 are provided, and a negative pressure generating member accommodating chamber 12 which is provided adjacent the rear side and which is in fluid communication with an ink supply port 7. The ink reservoir chamber 11 and the negative pressure generating member accommodating chamber 12 are in fluid communication with each other through, a communication port 13. The ink reservoir chamber 11 contains the ink alone in this embodiment, whereas the negative pressure generating member accommodating chamber 12 accommodates an ink absorbing material 15 (negative pressure generating member which is a porous member in this embodiment) made of sponge, fiber aggregate or the like for retaining the ink by impregnation. The porous member 15 functions to generate such a negative pressure as is sufficient to provide balance with the force of meniscus formed in the ink ejection nozzle of the recording head to prevent ink leakage from the ink ejection portion to the outside and to permits ink ejection by actuation of the recording head.

The internal structure of the ink container 1 is not limited to such a partitioned structure in which the inside is partitioned into the porous member accommodating chamber and, the reservoir containing the ink alone. In another example, the porous, member may occupy substantially all of the inside space of the ink container. The negative pressure generating means is not limited to the one using the porous member. In another example, the ink alone is contained in a bladder-like member made of elastic material such as rubber or the like which produces tension in the direction of expanding the volume thereof. In such a case, the negative pressure is generated by the tension in the bladder-like member to retain the ink. In a further example, at least a part of the ink accommodation space is constructed by a flexible member, and the ink alone is accommodated in the space, wherein a spring force is applied to the flexible member, by which a negative pressure is generated.

The bottom portion of the ink reservoir chamber 11 is provided with a portion to be detected 17 at a position for facing a sensor (which is provided in the apparatus, as will be described hereinafter) for detecting an ink remaining amount when the ink container 1 is mounted in the apparatus. In this embodiment, the ink remaining amount detection sensor is in the form of a photo-sensor comprising a light emitting portion and a light receiving portion. The portion to be detected 17 is made of a transparent or semi-transparent material, and when the ink is not contained, the light from the light emitting portion is appropriately reflected toward the light receiving portion (which will be described hereinafter) by providing an inclined surface portion having a configuration, angle or the like for this purpose.

Figure 3:
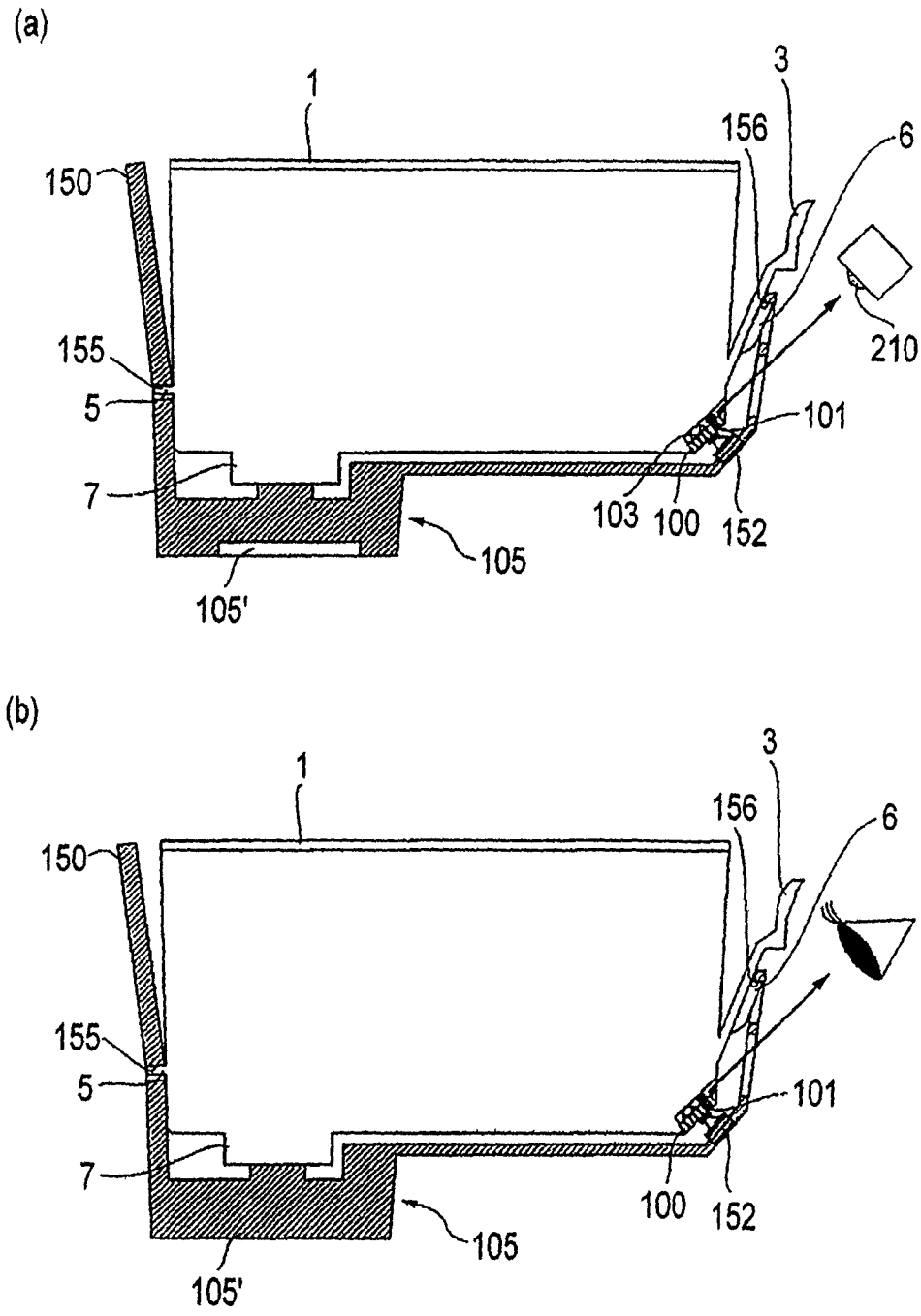
FIG. 3 is schematic side views (a) and (b) of the ink container according to the first embodiment of the present invention, illustrating function of a substrate provided on the ink container.
Figure 4:
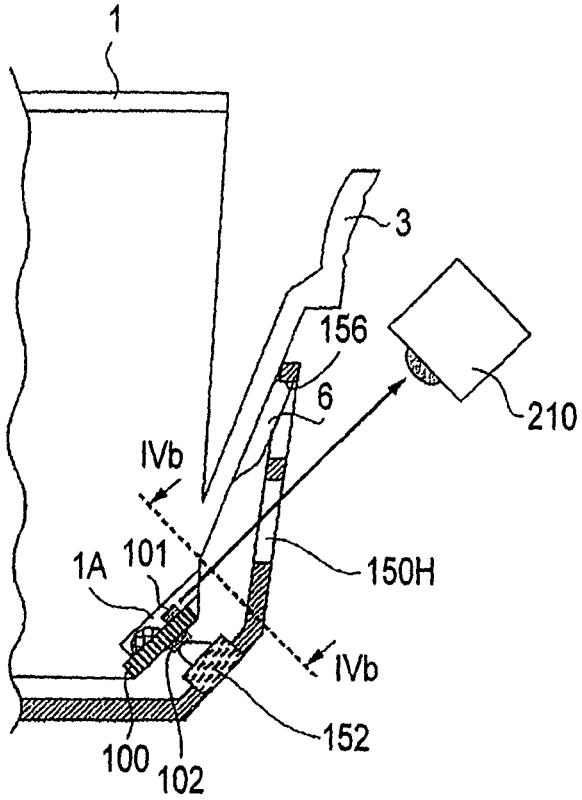
FIG. 4 is an enlarged view (a) of a major part of the ink container shown in FIG. 3, and a view (b) as seen in a direction IVb.
Figure 4:
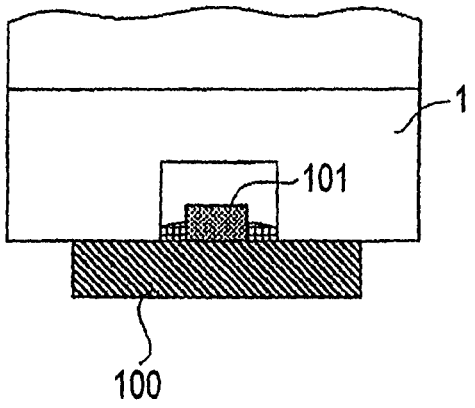
Figure 5:
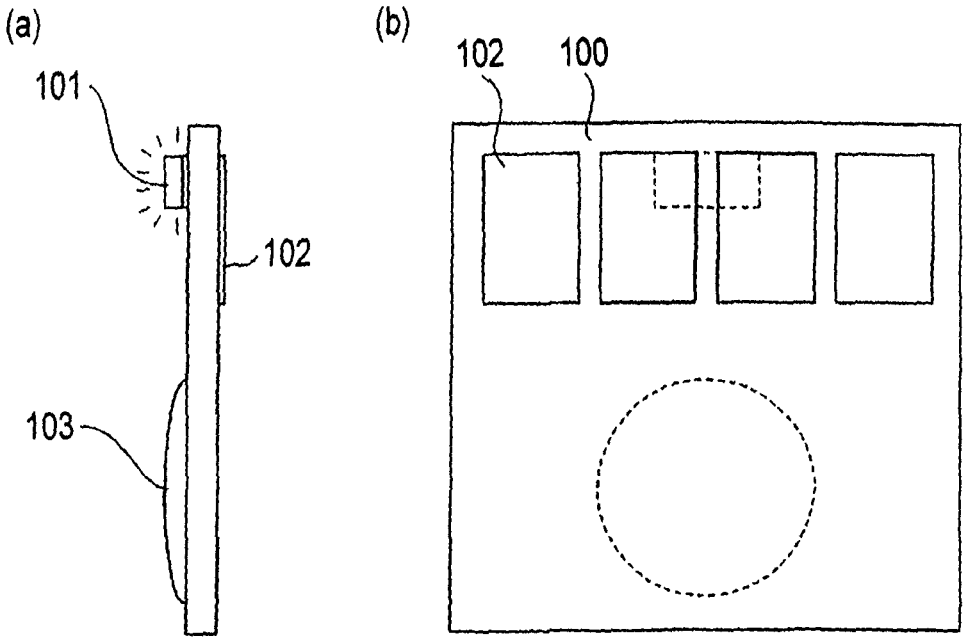
FIG. 5 is a side view (a) and a front view (b) of an example of a controller substrate mounted on the ink container of the first embodiment.

Referring to FIG. 3-FIG. 5, the description will be made as to the structure and the function of the substrate 100. FIG. 3 is schematic side views (a) and (b) of the ink container according to the first embodiment of the present invention, illustrating function of a substrate provided on the ink container. newpa FIG. 4 is an enlarged view (a) of a major part of the ink container shown in FIG. 3 and a view (b) as seen in a direction IVb. FIG. 5 is a side view (a) and a front view (b) of an example of a controller substrate mounted on the ink container of the first embodiment.

The ink container 1 is securedly mounted in or to the holder 150 which is integral with the recording head unit 105 having the recording head 105, by engagements of the first engaging portion 5 and the second engaging portion 6 of the ink container 1 with a first locking portion 155 and a second locking portion 156 of the holder 150, respectively. At this time, a contact (connector) 152 provided in the holder 150, and a contact in the form of an electrode pad 102 ((*b*) of FIG. 5)

provided on a surface of the substrate 100 facing to outside, are electrically contacted to establish electrical connection.

A surface of the substrate 100 facing inwardly of the ink container 1 is provided with a first light emitting portion 101 such as a LED for emitting visible light and a control element 103 for controlling the light emitting portion, and the control element 103 controls the light emission of the first light emitting portion 101 in accordance with the electric signal supplied through the connector 152 and the pad 102. In FIG. 5, (*a*) shows a state in which after the control element 103 is set in the substrate 100, it is coated with a protecting sealant. When a memory element for storing information such as a color or the remaining amount of the ink contained in the ink container is employed, it is set at the same place, so that it is coated with the sealant.

Here, as described hereinbefore, the substrate 100 is disposed at a lower portion of the supporting portion of the supporting member 3 adjacent the portion where the sides of the ink container 1 constituting the bottom side and the front side cross with each other. At this position, an inclined surface is provided between the bottom and front sides of the ink container 1. Therefore, when the first light emitting portion 101 emits light, a part thereof is emitted outwardly from the front side of the ink container 1 along the inclined surface.

By this disposition of the substrate 100, the information relating to the ink container 1 can be directly provided not only to the recording device (and to a host apparatus such as a computer connected thereto) also to the user, by the first light emitting portion 101 alone. As shown by (a) in FIG. 3, the light receiving portion is disposed at a position for receiving the light emitted in an upper right direction in the Figure adjacent an end of a scanning range of the carriage for carrying the holder 150, and at the timing when the carriage comes to the position, the light emission of the first light emitting portion 101 is controlled, by which the recording device side can obtain predetermined information relating to the ink container 1 on the basis of a content of the light received by the light receiving portion. In addition, by controlling the light emission of the first light emitting portion 101 with the carriage being disposed at a center portion of the scanning range, as shown by is (b) in FIG. 3, the user is visually informed of the state of the light emission, so that user can be given the predetermined information relating to the ink container 1.

Here, the predetermined information of the ink container (liquid container) 1 includes at least one of properness of the mounting state of the ink container 1 (i.e. whether the mounting is mounting or not), properness of the position of mounting of the ink container 1 (i.e. whether or not the ink container 1 is mounted on the right position in the holder which is determined corresponding to the ink color), and sufficiency of the ink remaining amount (i.e. whether the remaining amount of the ink is sufficient or not). The information relating to them can be provided by emission or non-emission of the light and/or states of light emission (flickering or the like). The control of the light emission, the manners of providing the information will be described hereinafter in the description of the structure of the control system.

In FIGS. 4, (*a*) and (*b*) show a preferable example of the disposition, the operation of the substrate 100, and the first light emitting portion 101. For the purpose of smooth reaching of the light light emitted from the first light emitting portion 101 into the view field of the first light receiving portion 210 or the user, it is preferable that such a portion of the ink container 1 as is opposed to the surface of the substrate 100 having the first light emitting portion 101 and the control element 103 is provided with a space 1A at least along the optical axis, as indicated by the arrow. For the same purpose, the arrangement and the configuration of the supporting member 3 are so selected that optical axis is not blocked. In addition, the holder 150 is provided with a hole (or a light transmitting portion) 150H to assure non-blocking of the optical axis.

1.2 Modified Example (FIG. 6-FIG. 13)

The foregoing structures are examples and can be modified as long as the predetermined information relating to the ink container 1 can be given to the recording device and to the user by the first light emitting portion 101. The description will be made as to some modified examples.

Figure 6:
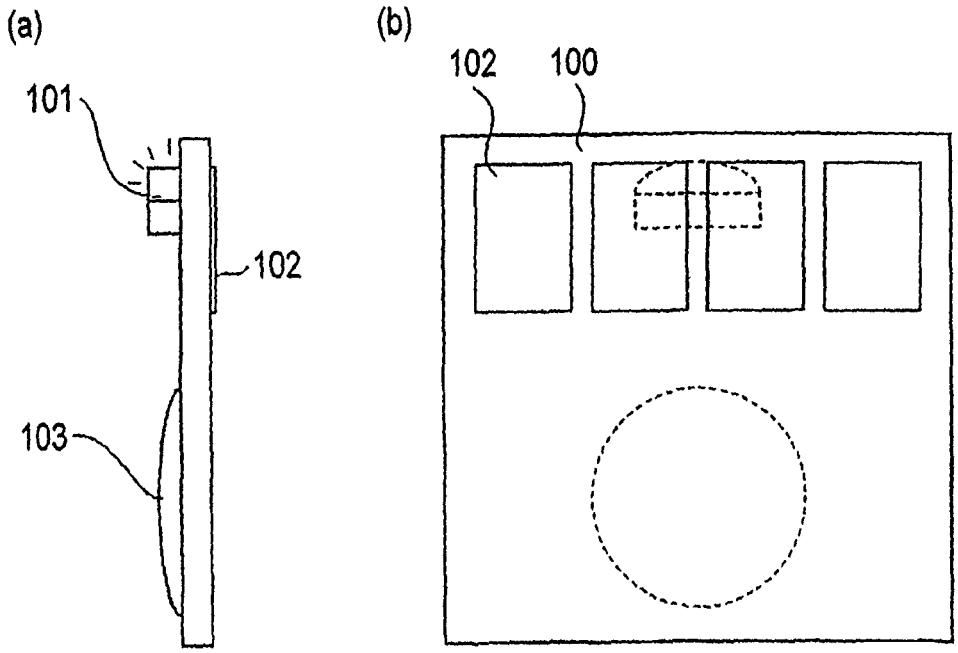
FIG. 6 is a side view (a) and a front view (b) of a modified example of the controller substrate mounted on the ink container according to the first embodiment.

FIG. 6 is a side view (a) and a front view (b) of a modified example of the controller substrate mounted on the ink container according to the first embodiment. In this example, a directivity is provided such that light is directed particularly toward the first light receiving portion 210 and toward the eyes of the user. To accomplish this, the attitude of the first light emitting portion 101 is appropriately determined, and an element (a lens or the like) for providing the directivity may be employed.

Figure 7:
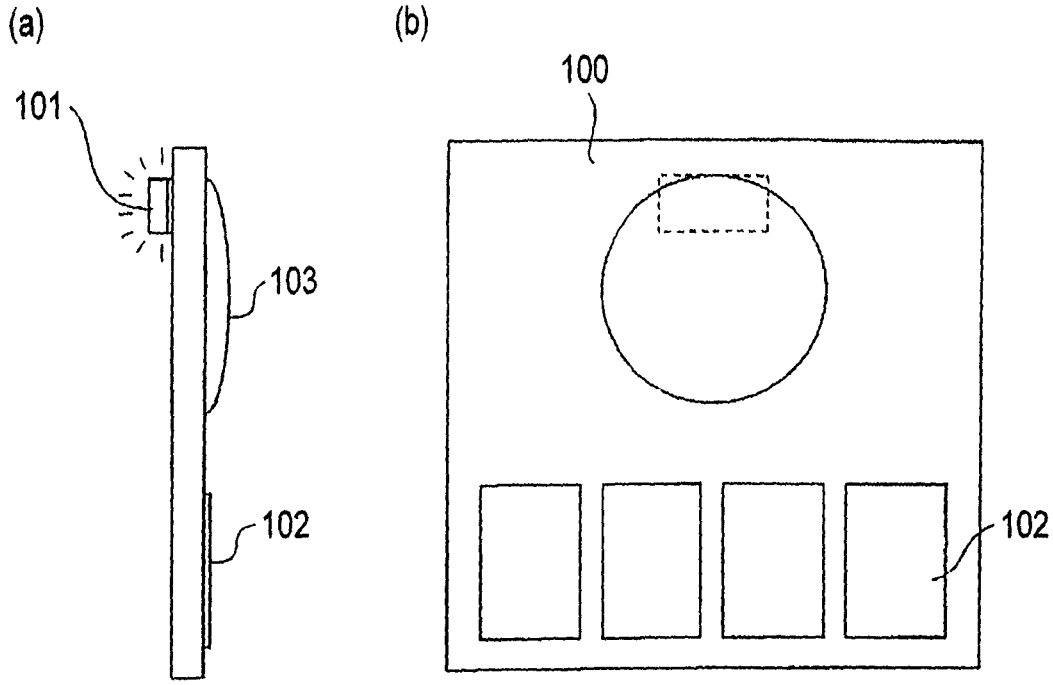
FIG. 7 is a side view (a) and a front view (b) of another modified example of the controller substrate mounted on the ink container according to the first embodiment.

In the example of (a) and (b) of FIG. 7, the surface of the substrate 100 facing toward the inside of the ink container 1 is provided only with the first light emitting portion 101, and the surface of the substrate 100 facing toward the outside is provided with the control element 103 and the electrode pad 102. With this structure, the light emitted from the first light emitting portion 101 is not blocked by the control element 103, so that light is directed not only in an inclined upward direction but also in an inclined downward direction along the surface of the substrate 100.

Figure 8:
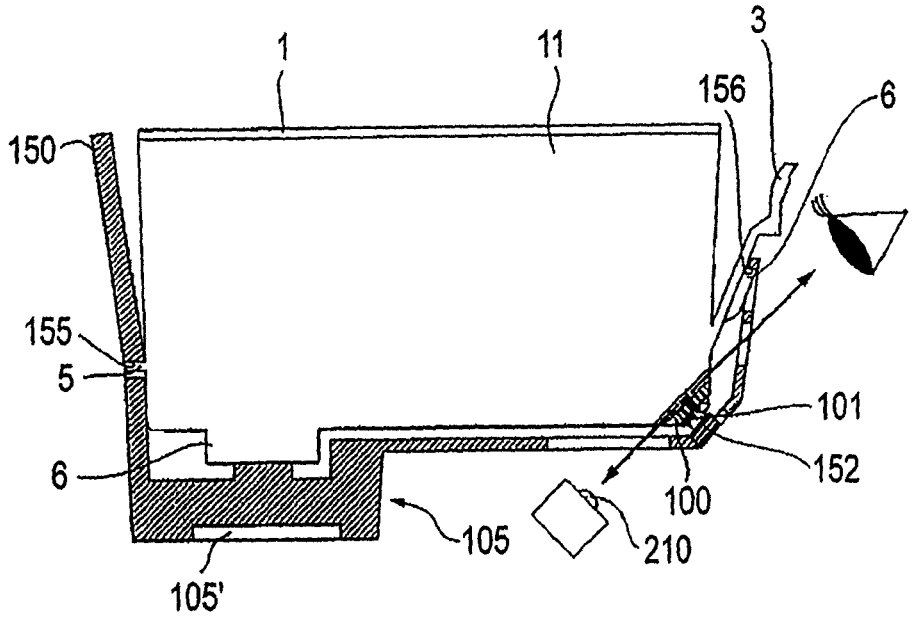
FIG. 8 is a side view of an ink container illustrating an usage of the controller substrate of FIG. 7.

FIG. 8 is a side view of the ink container illustrating an usage of the controller substrate of FIG. 7. As will be understood from this Figure, the first light emitting portion 101 directs the light not only in the upper right direction toward the user's observation but also in the lower left direction. In this citation, the first light receiving portion 210 is disposed across the optical axis extending toward the lower left, so that recording device side can receive the predetermined information relating to the ink container 1.

Figure 9:
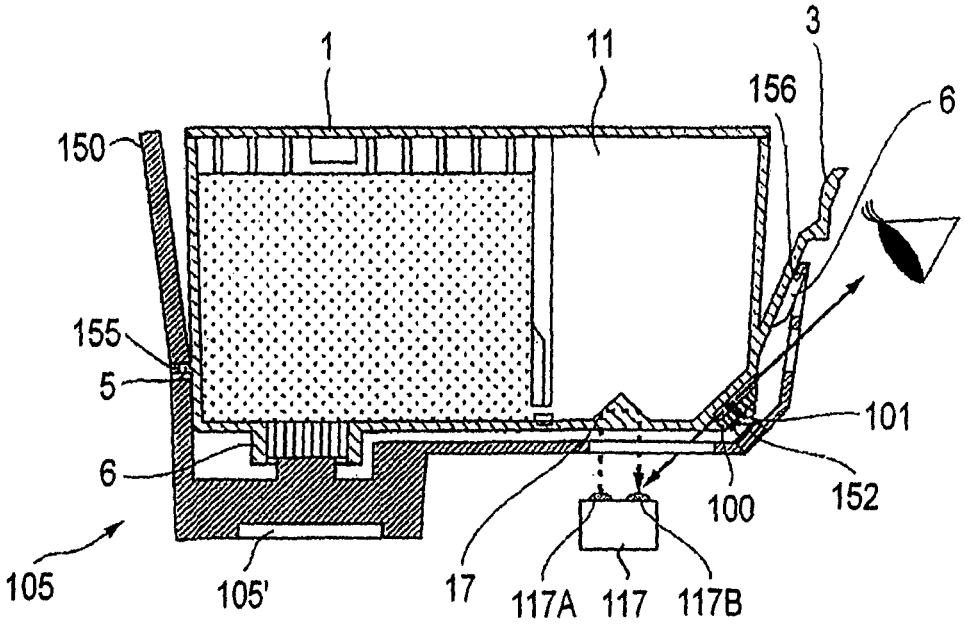
FIG. 9 is a side view illustrating another example of usage of the controller substrate of FIG. 7.

FIG. 9 is a side view illustrating another example of usage of the controller substrate of FIG. 7. This example is suitable to the case that sensor 117, in the form of a photosensor, for detection of the ink remaining amount is provided in the apparatus so as to be opposed to the portion to be detected 17 which is in the form of a prism, when the ink container 1 is mounted on the apparatus. More particularly, the sensor 117 for detection of the ink remaining amount includes a light emitting portion 117A and a light receiving portion 117B, and when the ink remaining amount in the ink chamber 11 of the ink container 1 is small, the light from the light emitting portion 117A is reflected by the prism-like portion to be detected 17, and returns to the light receiving portion 117B, so that apparatus can detect the ink shortage. In this embodiment, the light receiving portion 117B is utilized also as a photoreceptor for receiving the light from the first light emitting portion 101 to permit for the apparatus to detect the presence or absence and/or properness of the mounted ink container 1.

Figure 10:
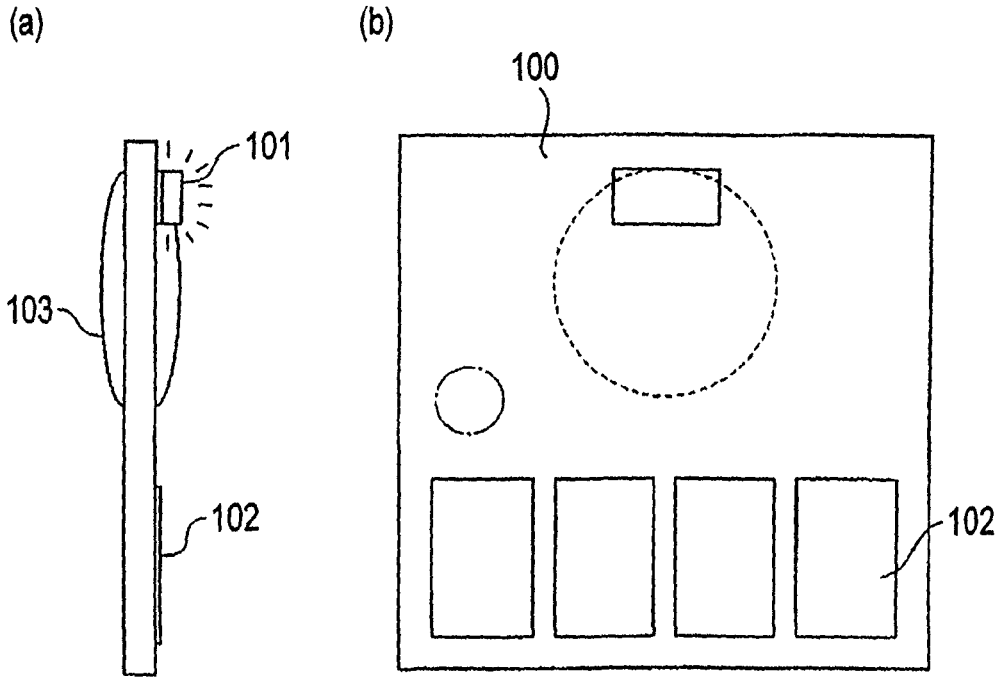
FIG. 10 is a side view (a) and a front view (b) of a further modified example of the controller substrate mounting on the ink container according to the first embodiment.

In the example shown in (a) and (b) of FIG. 10, the surface of the substrate 100 facing inwardly of the ink container 1 is provided with a control element 103, and the first light emitting portion 101 and the electrode pad 102 are disposed on the surface of the substrate 100 facing outwardly. With this structure, the light emitted from the first light emitting portion 101 travels also in the outward direction from the surface of the substrate 100.

Figure 11:
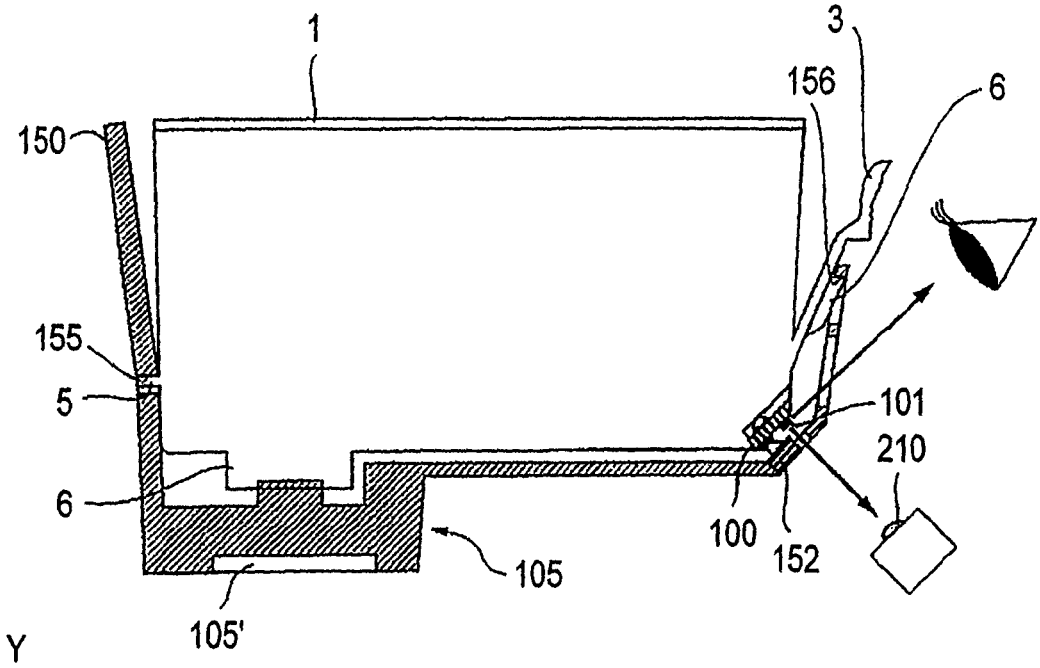
FIG. 11 is a side view illustrating an usage of the controller substrate of FIG. 10 provided on the ink container.

FIG. 11 is a side view illustrating an usage of the ink container having such a controller substrate. As will be understood from the Figure, the first light emitting portion 101 emits the light not only in the upper right direction by which the user can visually receive the light, but also in the lower right direction. The first light receiving portion 210 is disposed across the optical axis extending in the lower right direction, so that predetermined information relating to the ink container 1 can be transmitted to the recording device side.

With the above-described structures, the position and/or the configuration of a member or members which may block the light travelling along the optical axes, are appropriately selected, and an opening and/or light-transmissive are provided, so that optical axes directing toward the eyes of the user and toward the light receiving portion are positively assured. However, other arrangements are usable by which the light is directed to the eyes of the user and/or to the light receiving portion.

Figure 12:
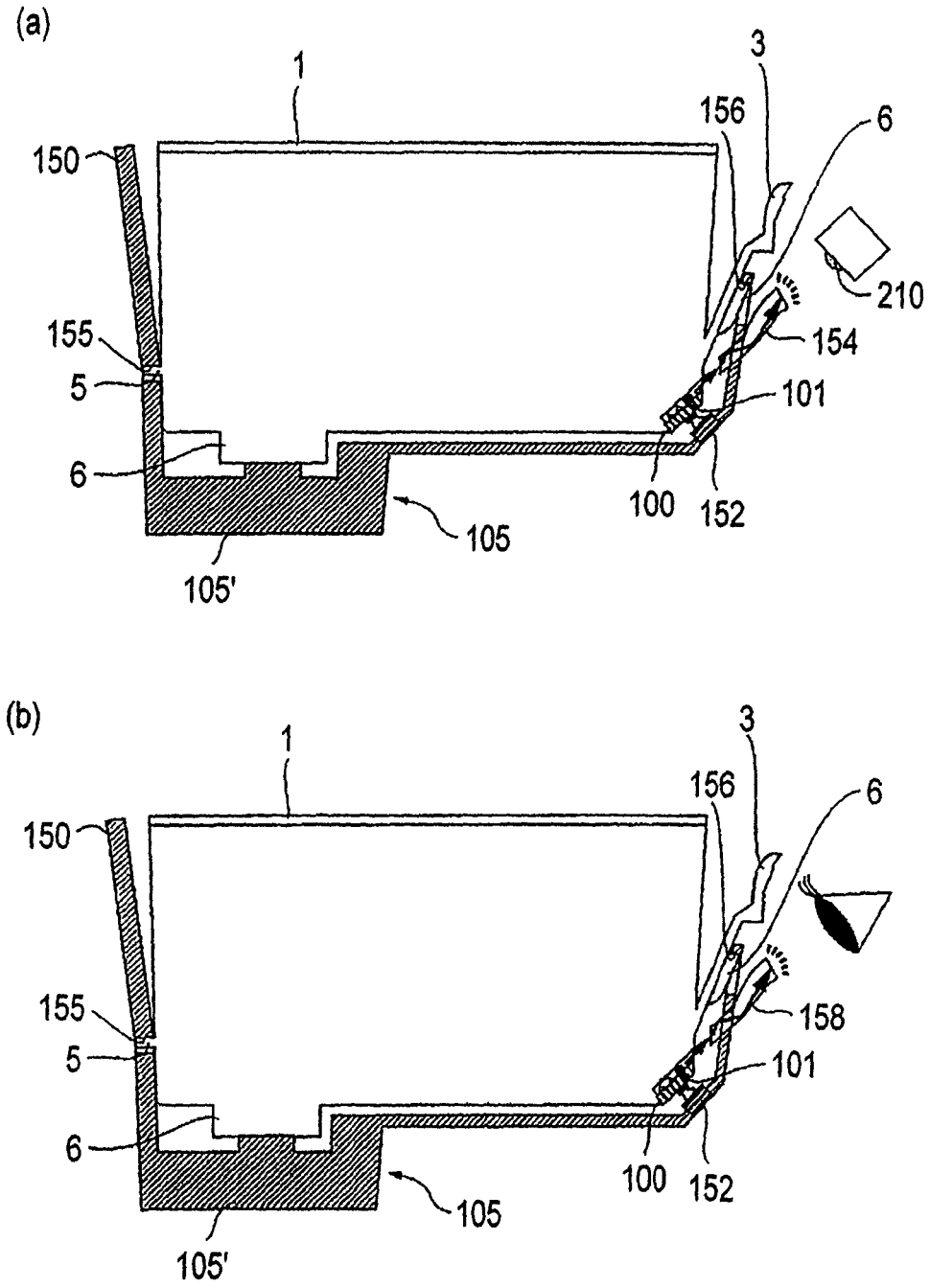
FIG. 12 is a schematic side view illustrating another example of the structure and an operation of a major part of the ink container according to the first embodiment of the present invention.

In FIGS. 12, (*a*) and (*b*) shows an example of such a structure, wherein the light emitted from the first light emitting portion 101 is directed to a desired position by using a light guiding member 154 such as optical fibers. By means of the light guiding member 154, the predetermined information relating to the ink container 1 can be transmitted to the first light receiving portion 210 (FIG. 12, (*a*)), to the eyes of the user (FIG. 12, (*b*)).

In the foregoing, the description has been made with various arrangements relating to the first light emitting portion 101 of the controller substrate, but the pad 102 can be appropriately arranged.

Figure 13:
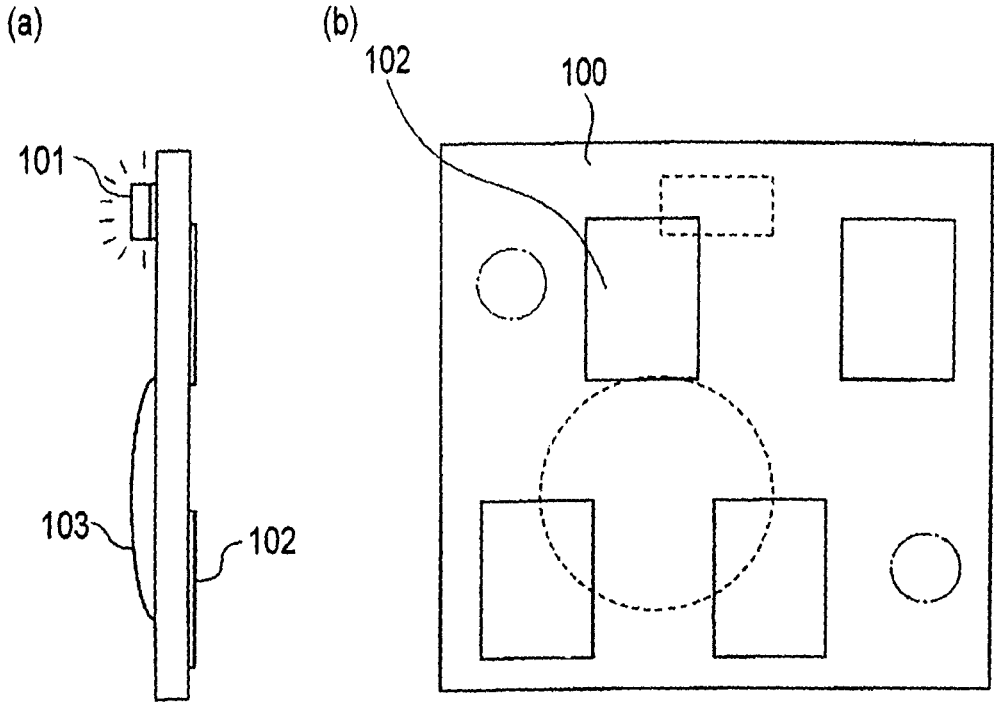
FIG. 13 is a side view (a) and a front view (b) of a further example of the controller substrate mounted on the ink container.

FIG. 13 is a side view (a), a front view (b) of a further example of the controller substrate mounted on the ink container. In the foregoing example, a plurality of electrode pads 102 are provided aligned on a surface of the substrate 100 (FIG. 5, (*b*), for example), but the plurality of electrode pads 102 are provided distributed on the surface of the substrate 100 (staggered arrangement in the Figure). Such an arrangement is advantages in that distortion of the substrate 100 which may be caused by the load applied to the substrate when it is contacted to the connector 152, can be suppressed even in the case that contact pressure is relatively high.

1.3 Mounting Portion of Ink Container

Figure 14:
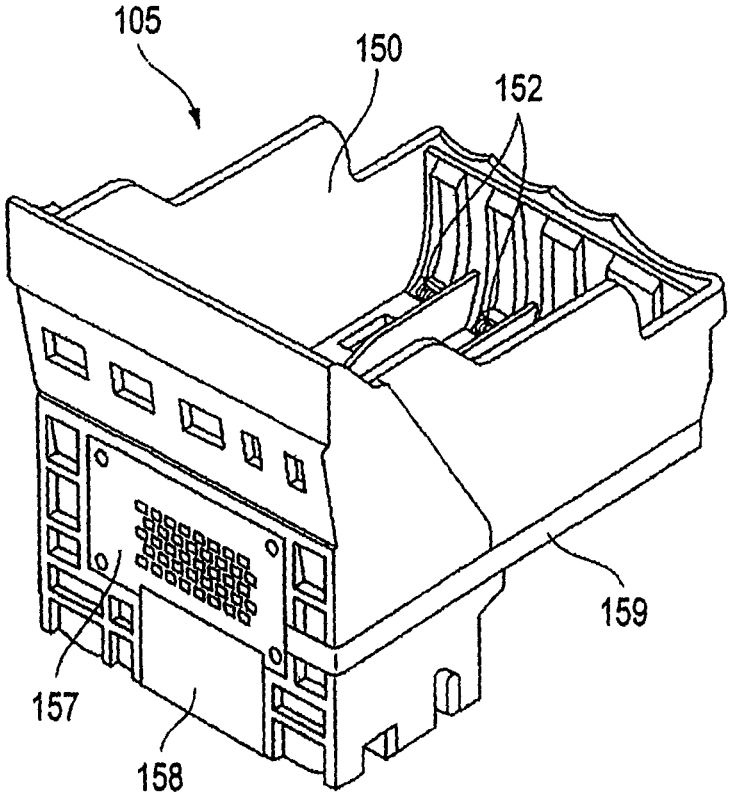
FIG. 14 is a perspective view illustrating an example of a recording head unit having a holder to which the ink container according to the first embodiment is mountable.
Figure 15:
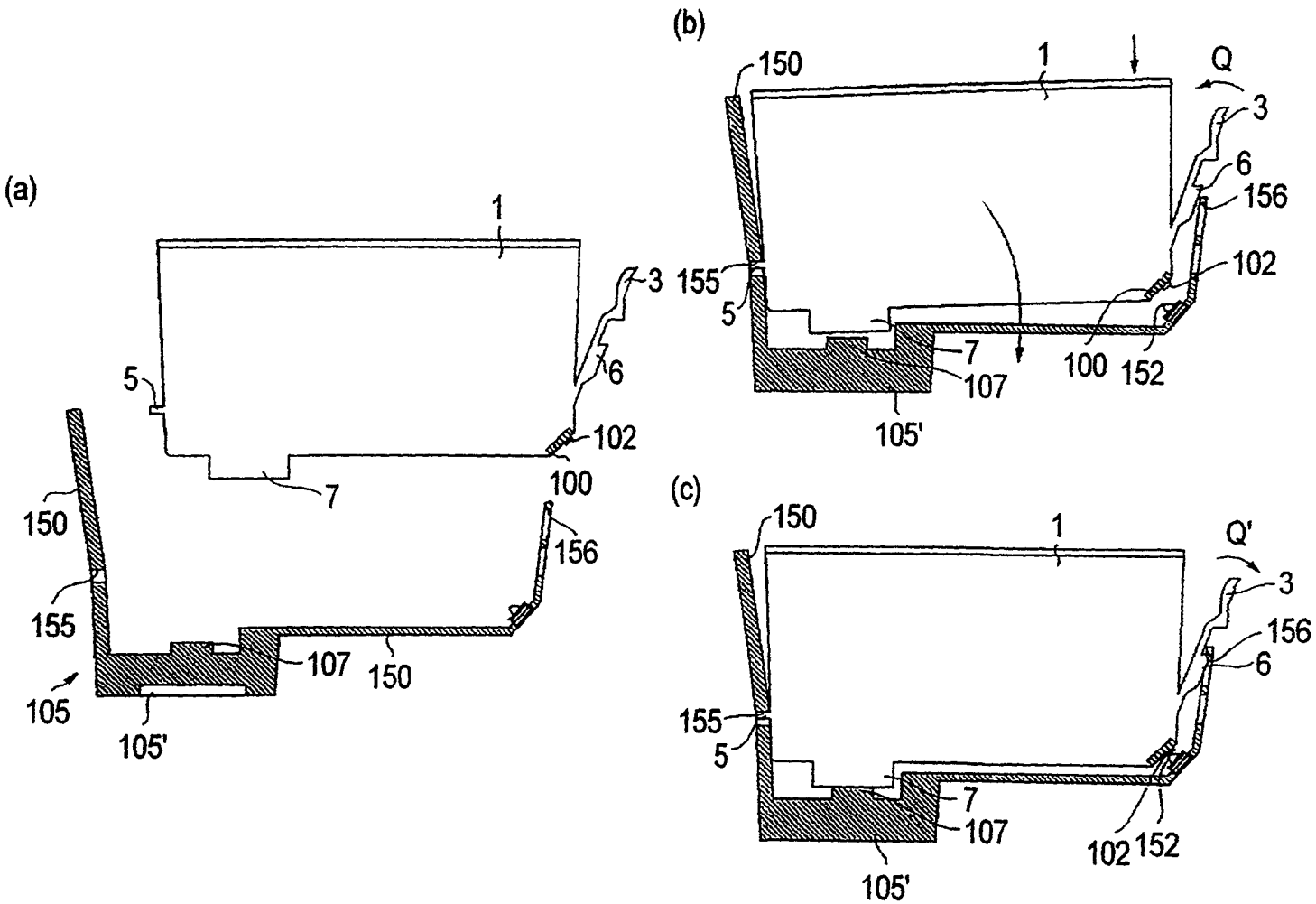
FIG. 15 is a schematic side view illustrating an operation of mounting and demounting of the ink container according to the first embodiment to the holder shown in FIG. 14.

FIG. 14 is a perspective view illustrating an example of a recording head unit having a holder to which the ink container according to the first embodiment is mountable. newpa FIG. 15 is a schematic side view illustrating an operation of mounting and demounting (a)-(c) of the ink container according to the first embodiment to the holder shown in FIG. 14.

The recording head unit 105 is generally constituted by a holder 150 for detachably holding a plurality (four, in the example shown in the Figure) of ink containers, and a recording head 105 disposed adjacent the bottom side (unshown in FIG. 14). By mounting the ink container to the holder 150, an ink introduction opening 107 of the recording head disposed adjacent the bottom portion of the holder is connected with the ink supply port 7 of the ink container to establish an ink fluid communication path therebetween.

An example of usable recording head 105 comprises a liquid passage constituting a nozzle, an electrothermal transducer element provided in the liquid passage. The electrothermal transducer element is supplied with electrical pulses in accordance with recording signals, by which thermal energy is applied to the ink in the liquid passage. This causes a phase change of the ink resulting in bubble generation (boiling), and therefore, abrupt pressure rise, by which the ink is ejected from the nozzle. An electrical contact portion (unshown) for signal transmission provided on the carriage 203 which will be described hereinafter, and an electrical contact portion 157 of the recording head unit 105, are electrically contacted to each other, so that transmission of the recording signal is enabled to the electrothermal transducer element driving circuit of the recording head 105 through the wiring portion 158. From the electrical contact portion 157, a wiring portion 159 is extended to the connector 152.

When the ink container 1 is mounted to the recording head unit 105, the holder 150 is brought to above the holder 150 ((*a*) in FIG. 15), and a first engaging portion 5 in the form of a projection provided on an ink container rear side is inserted into a first locking portion 155 in the form of a through hole provided in a holder rear side, so that the ink container 1 is placed on the inner bottom surface of the holder ((b) of FIG. 15). With this state kept, the front side upper end of the ink container 1 is pressed down as indicated by arrow P, by which the ink container 1 rotates in the direction indicated by the arrow R about the engaging portion between the first engaging portion 5 and the first locking portion 155, so that front side of the ink container displaces downwardly. In the process of this action, the supporting member 3 is displaced in the direction of an arrow Q, while a side surface of a second engaging portion 6 provided in the supporting member 3 on the ink container front side is being pressed to the second locking portion 156 provided on the holder front side.

When the upper surface of the second engaging portion 6 reaches a lower portion of the second locking portion 156, the supporting member 3 displaces in the direction Q' by the elastic force of the supporting member 3, so that second engaging portion 6 is locked with the second locking portion 156. With this state ((c) in FIG. 15), the second locking portion 156 elastically urges the ink container 1 in a horizontal direction through the supporting member 3, so that rear side of the ink container 1 is abutted to the rear side of the holder 150. The upward displacement of the ink container 1 is suppressed by the first locking portion 155 engaged with the first engaging portion 5 and by the second locking portion 156 engaged with the second engaging portion 6. At this time, the mounting of the ink container 1 in addition completed, wherein the ink supply port 7 is connected with the ink introduction opening 107, and the pad 102 is electrically connected with the connector 152.

The above-described uses the principle of "lever" during the mounting process shown in (b) of FIG. 15, wherein the engaging portion between the first engaging portion 5 and the first locking portion 155 is a fulcrum, and the front side of the ink container 1 is a power point where the force is applied. The connecting portion between the ink supply port 7 and the ink introduction opening 107 is a working point which is located between the power point and the fulcrum, preferably, closer to the fulcrum. Therefore, the ink supply port 7 is pressed against the ink introduction opening 107 with a large force by the rotation of the ink container 1. At the connecting portion, an elastic member such as a filter, an absorbing material, a packing or the like which has a relatively high flexibility is provided to assure an ink communication property to prevent ink leakage there.

Such structure, arrangement and mounting operation are therefore preferable in that such a member is elastically deformed by the relatively large force. When the mounting operation is completed, the first locking portion 155 engaged with the first engaging portion 5 and the second locking portion 156 engaged with the second engaging portion 6 are effective to prevent the ink container 1 from rising away from the holder, and therefore, the restoration of the elastic member is suppressed, so that the member is kept in an appropriately deformed elastically.

On the other hand, the pad 102 and the connector 152 (electrical contacts) are made of a relatively rigidity electroconductive material such as metal to assuring satisfy electrical connection property therebetween. On the other hand, an excessive contact force therebetween is not preferable from the standpoint of damage prevention and sufficient durability. In this example, they are disposed at a position as remote as possible from the fulcrum, more particularly, in the neighborhood of the front side of the ink container, in this example, by which the contact force is minimized.

To accomplish this, it is considered to place the pad of the substrate at a position very close to the front side on the bottom side of the ink container. Alternatively, it is considered to place the pad of the substrate on the front side of the ink container. In any case, however, some limitation is imparted to the disposition of the first light emitting portion 101 on the substrate, which should be selected such that light should properly reach the first light receiving portion 210 and the eyes of the user. In the case of placing the pad of the substrate at a position very close to the front side on the bottom side of the ink container, the pad 102 and the connector 152 approach to each other in a face-to-face fashion in the state immediately before completion of the mounting of the ink container 1, and they abut each other in such a state. A large mounting force is required in order to provide a satisfactory electrical connection irrespective of the surface conditions of the pad and the connector, with a possible result of excessive force applied to the pad and to the connector. In case the ink leaks out at the connecting portion between the ink supply port 7 and/or the ink introduction opening 107, the leaked ink might reach the pad and/or the connecting portion along the bottom side of the ink container. When the substrate is disposed at the ink container front side, the disengagement of the ink container from the main assembly of the apparatus may be difficult.

In this example of the embodiment, the substrate 100 is disposed on the inclined surface connecting the bottom side of the ink container 1 with the front side of the ink container 1, namely, at the corner portion therebetween. When the balance of forces only at the contact portion in the state that pad 102 is contacted to the connector 152 immediately before the completion of mounting, is considered, it is such that reaction force (a upward force in the vertical direction) applied by the connector 152 to the pad 102, balancing with the mounting force applied downwardly in the vertical direction, involves a component force of the actual contact pressure between the pad 102 and the connector 152. Therefore, when the user presses the ink container down toward the mounting completion position, an addition of ink container mounting force for electrical connection between the substrate and the connector is small, so that operativity may be quite low.

When the ink container 1 is pressed down toward the mounting completion position where the first engaging portion 5 is engaged with each other, the second engaging portion 6 and the second locking portion 156 are engaged with each other, and there arises a component force (a force sliding the pad 102 on the connector 152) parallel with a surface of the substrate 100 by the urging force. Therefore, a good electrical connection property is provided and assured upon the completion of the mounting of the ink container. In addition, the electrical connecting portion is at a position high from the bottom side of the ink container, and therefore, the liability of the leaked ink reaching there is small. Furthermore, the optical axes toward the first light receiving portion 210 and toward the eyes of the user can be assured.

In this manner, the structure and arrangement of the electrical connecting portion-described above is advantageous from the standpoint of assuring the optical path in the case that first light emitting portion 101 is used both for the first light receiving portion, for the eyes of the user, in addition, from the standpoint of the magnitude of the required ink container mounting force, assurance of the electrical contact state and the protection from contamination with the leaked ink.

The structure of the mounting portion for the ink container in the first embodiment or the modified example is not limited to that shown in FIG. 14.

Figure 16:
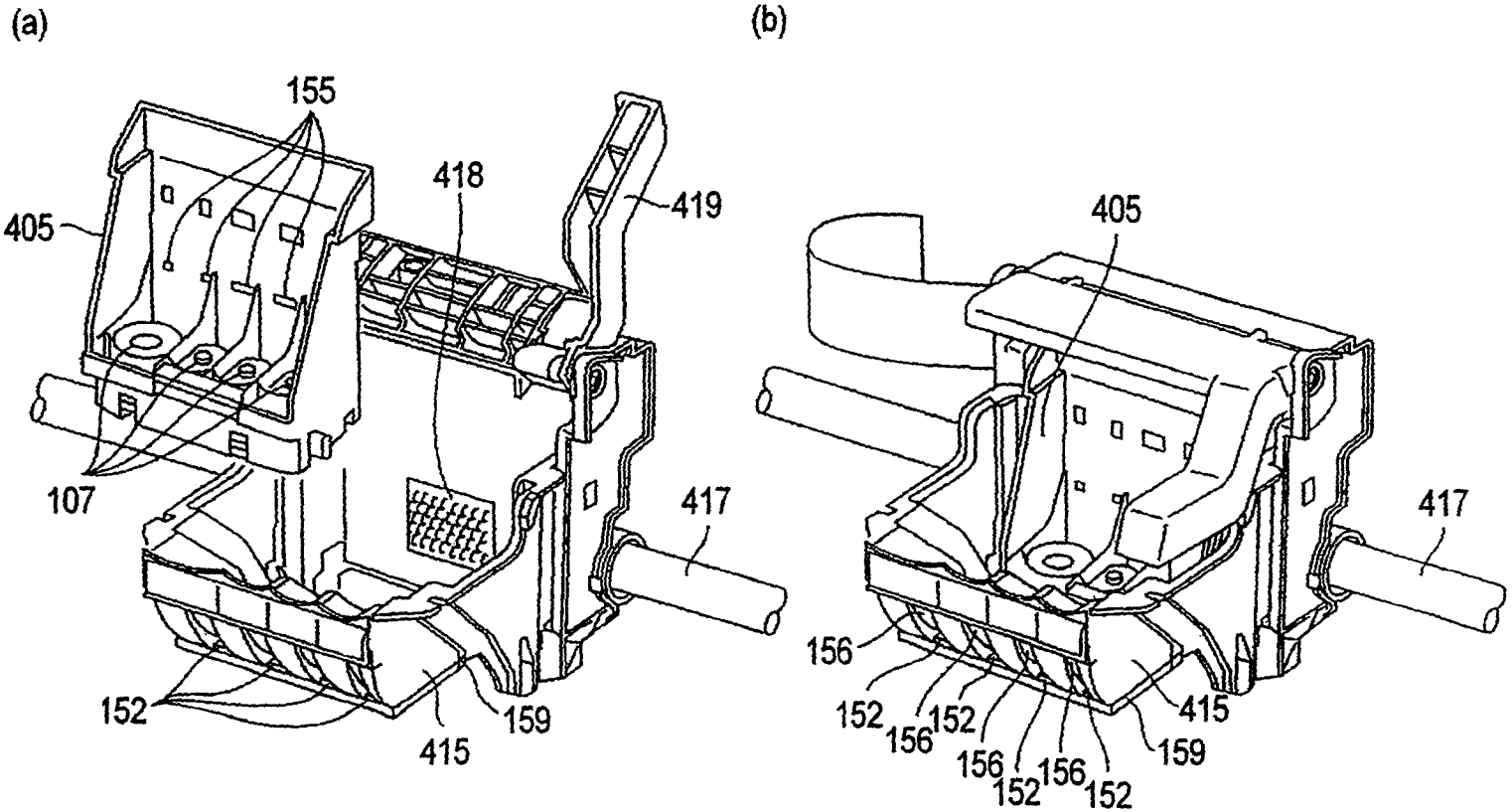
FIG. 16 are perspective views (a) and (b) of another example of a mounting portion of the ink container according to the first embodiment of the present invention.

Referring to FIG. 16, the description will be made as to this point. FIG. 16 is a perspective view (a) of another example of the recording head unit for executing the recording operation while being supplied with the ink from the ink container, and a carriage for carrying the recording head unit; and a perspective view wherein the ink container is carried on the carriage.

As shown in FIG. 16, the recording head unit 405 of this example is different from those (holder 150) described hereinbefore in that it does not have the holder portion corresponding to the ink container front side, the second locking portion or the connector. The recording head unit 405 is similar to the foregoing one in the other respects, the bottom side thereof is provided with an ink introduction opening 107 to be connected with the ink supply port 7. The rear side thereof is provided with the first locking portion 155, and the back side is provided with an electrical contact portion (unshown) for signal transmission.

On the other hand, as shown by (b) in FIG. 16, the carriage 415 is movable along a shaft 417, and is provided with a lever 419 for fixing the recording head unit 405, and an electrical contact portion 418 connected with the electrical contact portion of the recording head. The carriage 415 is also provided with a holder portion corresponding to the structure of the ink container front side. The second locking portion 156, the connector 152 and the wiring portion 159 to the connector, are provided on the carriage side.

With this structure, when the recording head unit 405 is mounted on the carriage 415, as shown by (b) in FIG. 16, the mounting portion for the ink container is established. In this manner, through the mounting operation which is similar to the example of FIG. 15, the connection between the ink supply port 7 and the ink introduction opening 107, and the connection between the pad 102 and the connector 152, are established, and the mounting operation is completed.

Figure 17:
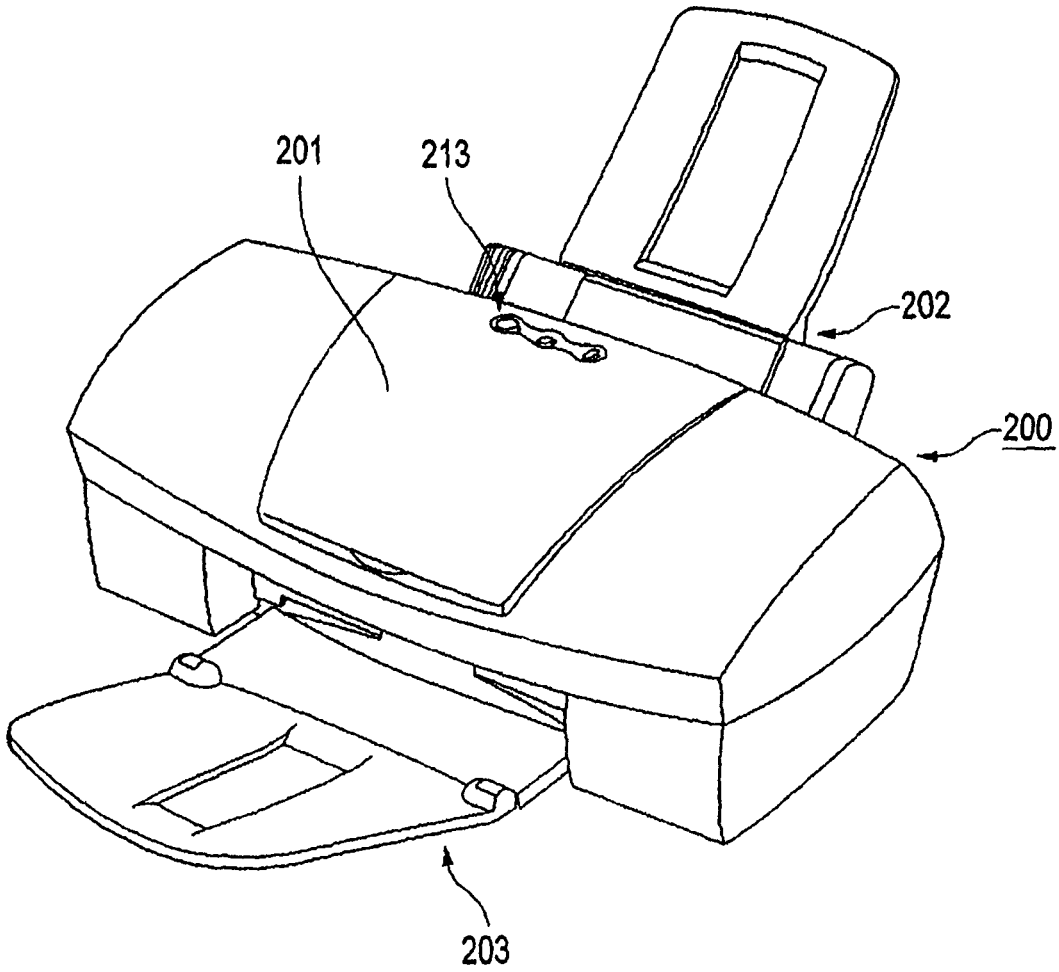
FIG. 17 shows an outer appearance of an ink jet printer to which the ink container according to the first embodiment is mountable.
Figure 18:
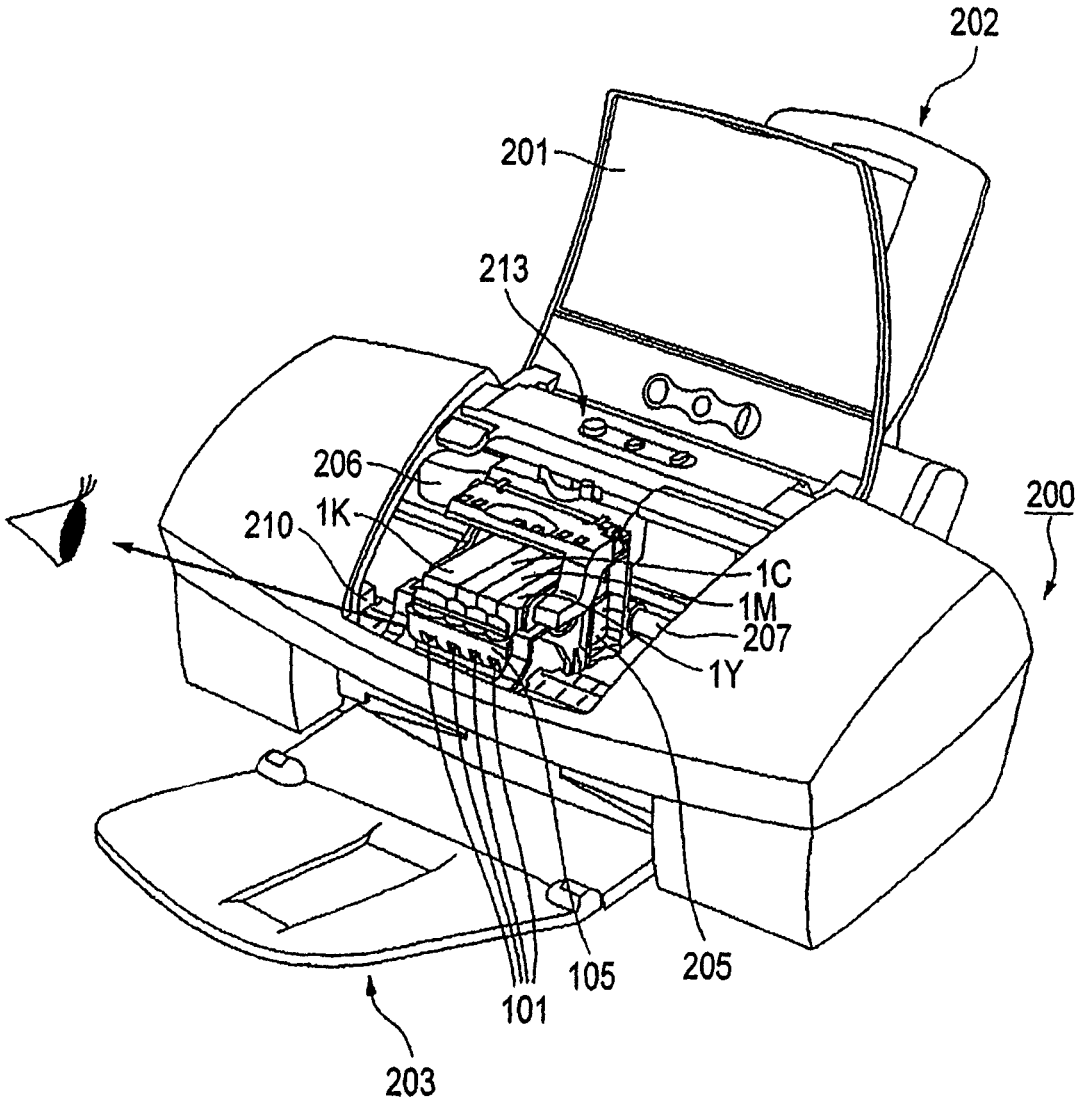
FIG. 18 is a perspective view of the printer in which the main assembly cover 201 of FIG. 17 is open.

1.4 Recording Apparatus (FIG. 17-FIG. 18)

FIG. 17 shows an outer appearance of an ink jet printer 200 to which the ink container described in the foregoing. FIG. 18 is a perspective view of the printer in which the main assembly cover 201 of FIG. 17 is open.

As shown in FIG. 17, the printer 200 of this embodiment comprises a main assembly, a sheet discharge tray 203 at the front side of the main assembly, an automatic sheet feeding device (ASF) 202 at the rear side thereof, a main assembly cover 201, and other case portions which cover major parts including a mechanism for scanningly moving the carriage carrying the recording heads and the ink containers and for effecting the recording during the movement of the carriage. There is also provided an operating panel portion 213 which includes a displaying device which in turn displays states of the printer irrespective of whether the main assembly cover is closed or opened, a main switch, and a reset switch.

As shown in FIG. 18, when the main assembly cover 201 is open, the user can see the movable range, the neighborhood thereof which carries the recording head unit 105 and the ink containers 1K, 1Y, 1M and 1C (the ink containers may be indicated by reference numeral "1" only hereinafter for simplicity). In this embodiment, when the main assembly cover 201 is opened. A sequence operation is carried out so that carriage 205 is automatically comes to the center position ("container exchanging position", shown in the Figure), where the user can do the ink container exchanging operation or the like.

In this embodiment, the recording head (unshown) is in the form of a chip mounted to the recording head unit 105, corresponding to the respective inks. The recording heads scan the recording material by the movement of the carriage 205, during which the recording heads eject the ink to effect the printing. To do this, the carriage 205 is slidably engaged with the guiding shaft 207 which extends in the moving direction thereof, is driven by a carriage motor through a drive transmission mechanism. The recording heads corresponding to the K, Y, M and C (black, yellow, magenta and cyan) inks eject the inks on the basis of ejection data fed from a control circuit provided in the main assembly side through a flexible cable 206. There is provided a paper feeding mechanism including a paper feeding roller, a sheet discharging roller and so on to feed the recording material (unshown) fed from the automatic sheet feeding device 202 to the sheet discharge tray 203. The recording head unit 105 having an integral ink container holder is detachably mounted on the carriage 205, and the respective ink containers 1 are detachably mounted on the recording head unit 105.

During the recording or printing operation, the recording head scan the recording material by the above-described movement, during which the recording heads eject the inks onto the recording material to effect the recording on a width of the recording material corresponding to the range of the ejection outlets of the recording head. In a time period between a scanning operation and the next scanning operation, the paper feeding mechanism feeds the recording material through a predetermined distance corresponding to the width. In this manner, the recording is sequentially effected to cover the entire area of the recording material. An end portion of the movement range of the recording head by the movement of the carriage, there is provided an ejection refreshing unit including caps for capping the sides of the recording heads having the ejection outlets. Therefore, the recording heads move to the position of the refreshing unit at predetermined time intervals, and are subjected to the refreshing process including the preliminary ejections or the like.

Figure 25:
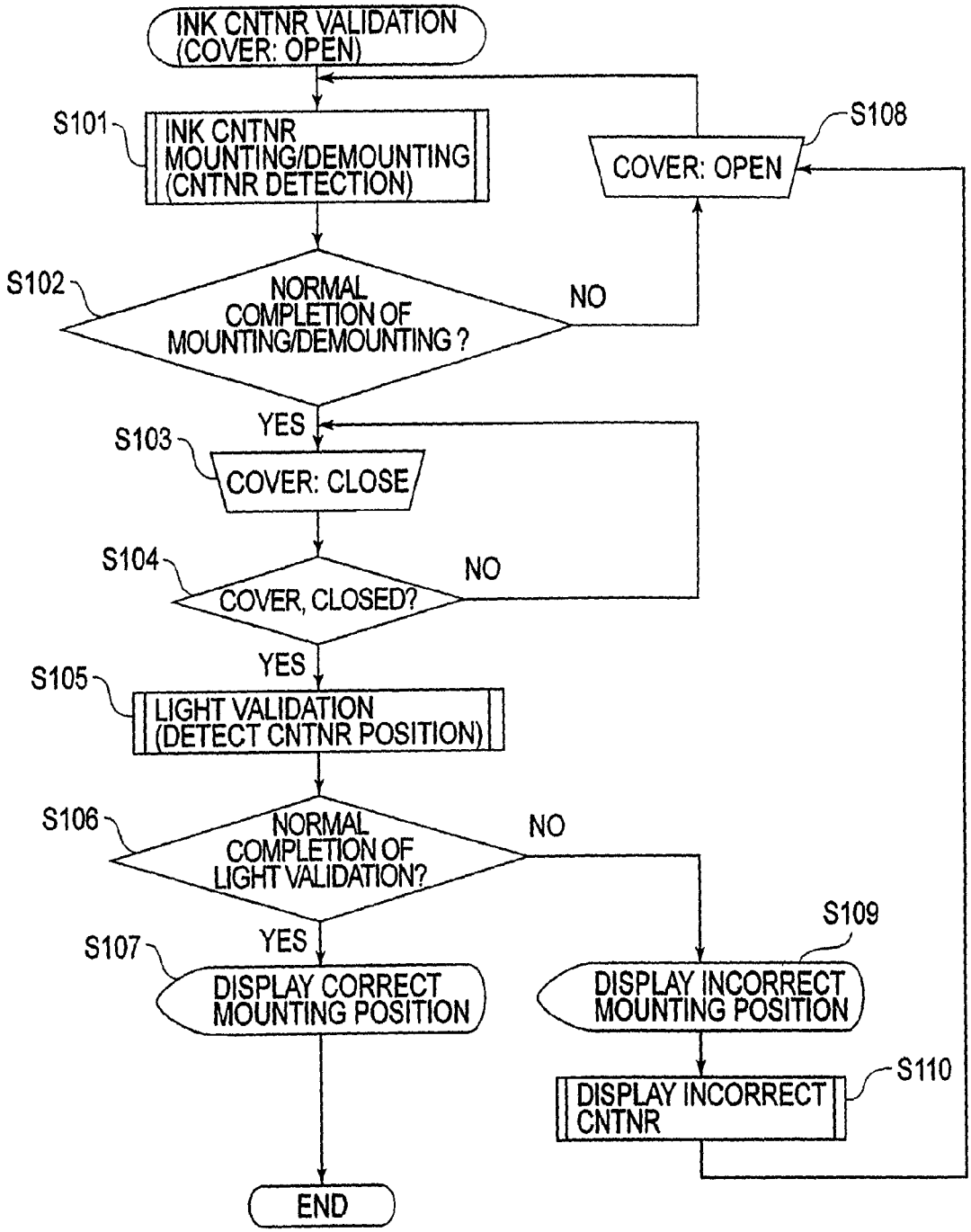
FIG. 25 is a flow chart illustrating a control process relating to mounting and demounting of the ink container according to an embodiment of the present invention.
Figure 26:
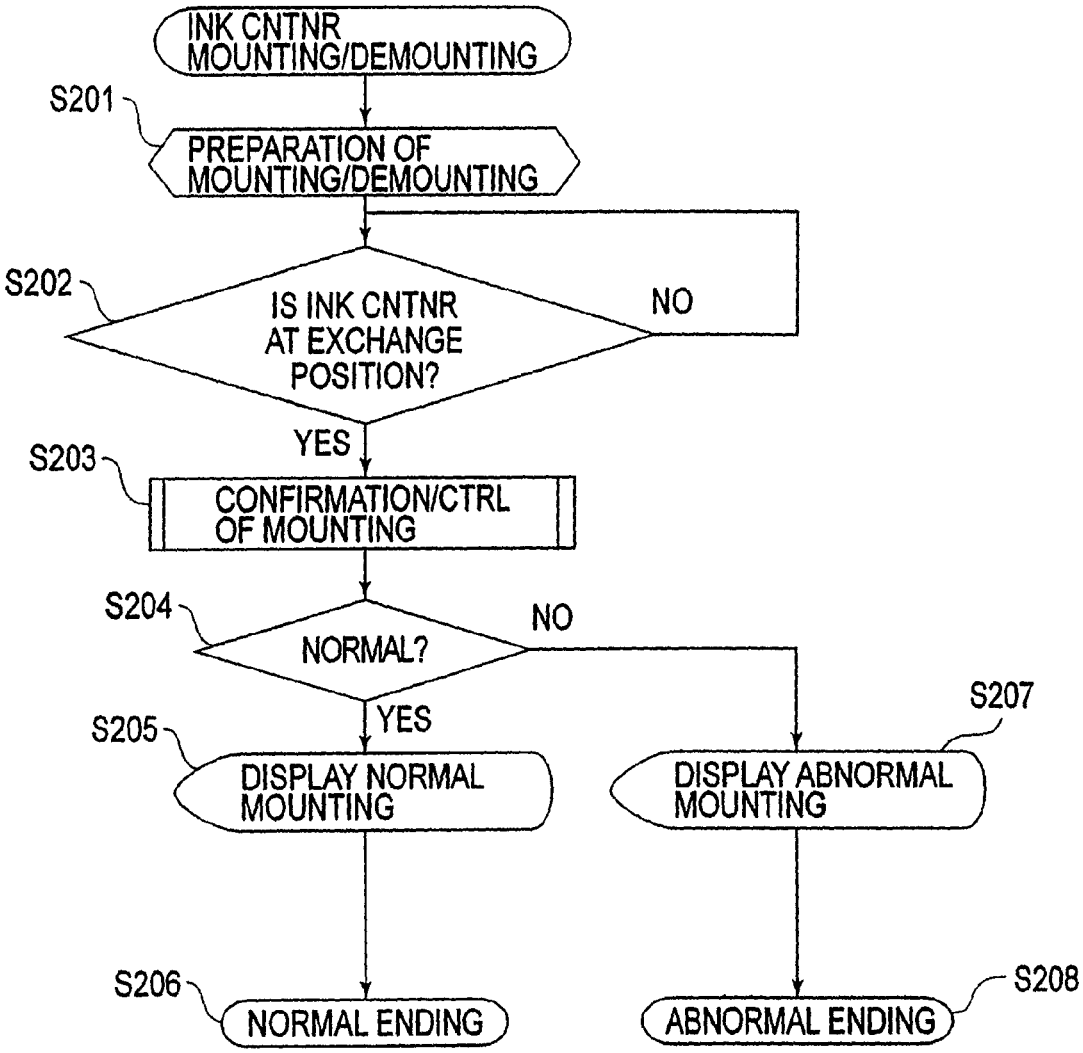
FIG. 26 is a flow chart of a mounting and demounting process of the ink container in FIG. 25.
Figure 27:
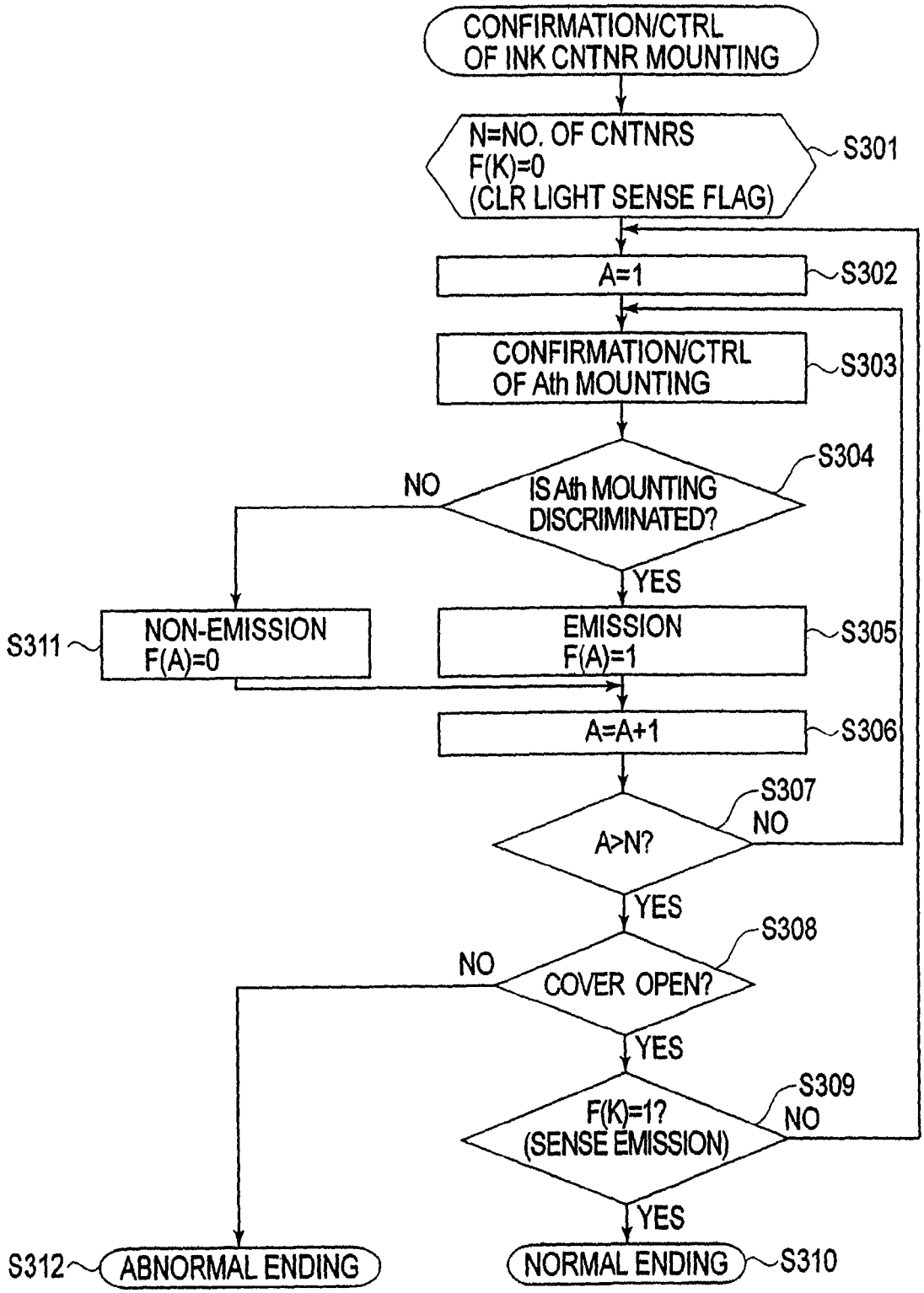
FIG. 27 is a flow chart showing in detail a mounting confirmation control in FIG. 26.

The recording head unit 105 having a holder portion for each ink container 1, is provided with a connector corresponding to each of the ink containers, and the respective connectors are contacted to the pad of the substrate provided on the ink container 1. By this, the control of turn-on and -off of each of the LEDs 101 in accordance with the sequence which will be described hereinafter in conjunction of FIG. 25-FIG. 27, are enabled.

More particularly, at the container exchange position, when an ink remaining amount of an ink container 1 is short, the LED 101 of the ink container 1 is switched on or flickered. This applies to each of the ink containers 1. Adjacent to an end portion which is opposite the position where the refreshing unit is provided, a first light receiving portion 210 having a light receiving element is provided. When the LEDs 101 of the ink containers 1 pass by the light receiving portion 210 by the movement of the carriage 205, the LEDs 101 are switched on, and the light is received by the first light receiving position 210 so that positions of the ink containers 1 on the carriage 205 can be detected on the basis of the position of the carriage 205 when the light is received. In another example of the control for the turn-on of the LED or the like, the LED 101 of the container is switched on when the ink container 1 is correctly mounted at the container exchange position. These controls are executed, similarly to the control for the ink ejection of the recording head, by supplying control data (control signal) to the respective ink containers form the main assembly side control circuit through the flexible cable 206.

2. Control System

Figure 19:
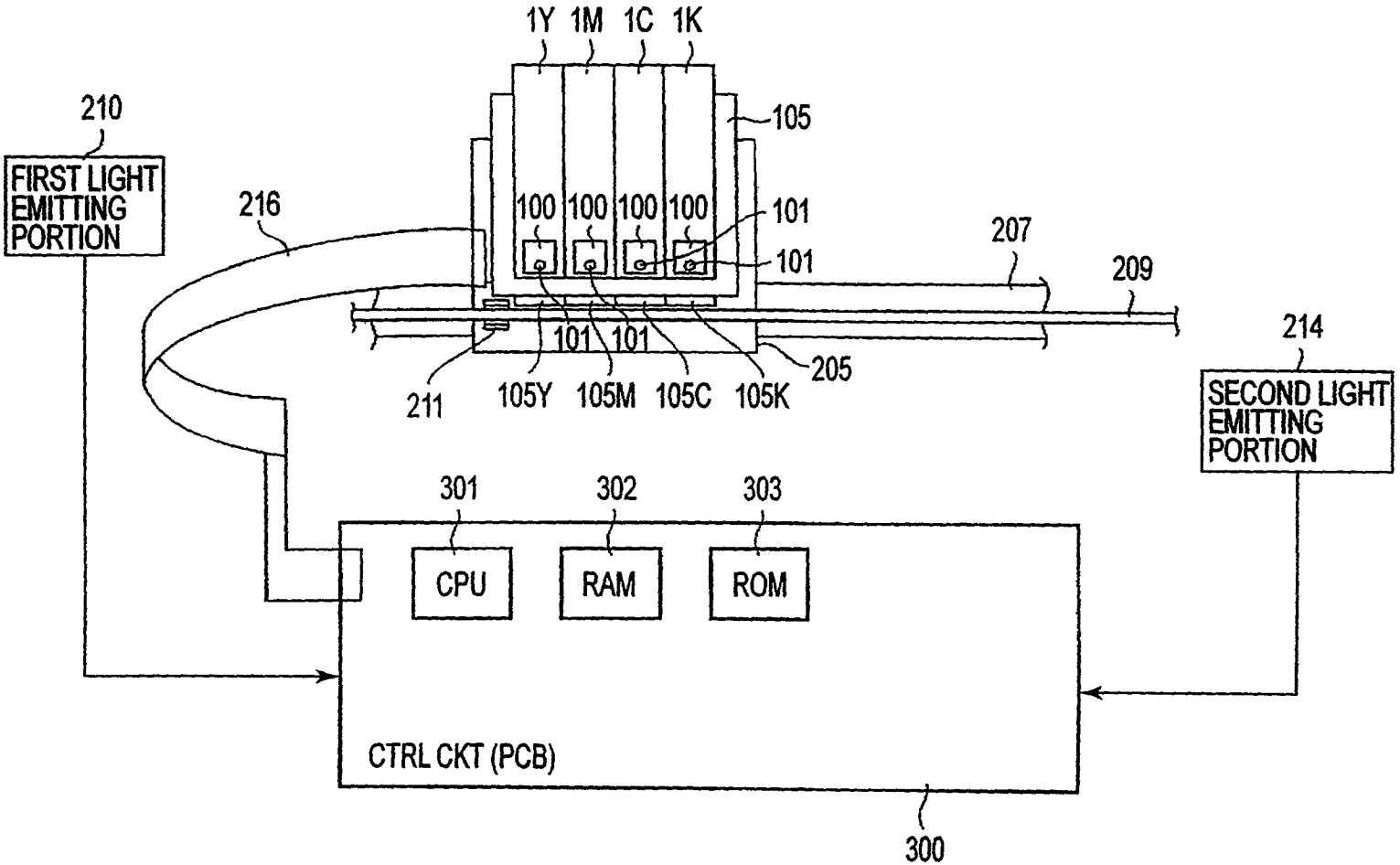
FIG. 19 is a block diagram showing a structure of a control system of the ink jet printer.

2.1 General Arrangement (FIG. 19)

FIG. 19 is a block diagram showing an example of a structure of a control system of the ink jet printer. The control system mainly comprises a control circuit (PCB (printed-wiring board)) in the main assembly of the printer, and the structure for the light emission of the LED of the ink container to be controlled by the control circuit.

In FIG. 19, the control circuit 300 executes data processing relating to the printer and operation control. More particularly, a CPU 301 carried out processes which will be described hereinafter in conjunction with FIG. 25-FIG. 28 in accordance with a program stored in ROM 303. RAM 302 is used as a work area in the process execution of the CPU 301.

As schematically shown in FIG. 19, the recording head unit 105 carried on the carriage 205 has recording heads 105K, 105Y, 105M and 105C which have a plurality of ejection outlets for ejecting black (K), yellow (Y), magenta (M) and cyan (C) inks, respectively. On the holder of the recording head unit 105, ink containers 1K, 1Y, 1M and 1C are detachably mounted corresponding to the respective recording heads.

Each of the ink container 1, as described, hereinbefore, is, provided with the substrate 100 provided with the LED 101, the display control circuit therefor and the pad (electric contact) or the like. When the ink container 1 is correctly mounted on the recording head unit 105, the pad on the substrate 100 is contacted to the connector provided corresponding to each of ink containers 114 the recording head unit 105. The connector (unshown) provided in the carriage 205, the control circuit 300 provided in the main assembly side, are electrically connected for transmission of signals through the flexible cable 206. Furthermore, by the mounting of the recording head unit 105 on the carriage 205, the connector of the carriage 205 and the connector of the recording head unit 105 are electrically contacted with each other for signal transmission. With such a structure, the signals can be transmitted between the control circuit 300 of the main assembly side and the respective ink containers 1. Thus, the control circuit 300 can perform the control for turn-on and -off of LED in accordance with the sequence which will be described hereinafter in conjunction with FIG. 25-FIG. 27.

The control of ink ejections of the recording heads 105K, 105Y, 105M and 105C, is carried out similarly through the flexible cable 206, the connector of the carriage 205, the connector of the recording head unit with the signal connection between the driving circuit and so on provided in the recording head, and the control circuit 300 in the main assembly side. Thus, the control circuit 300 controls the ink ejections and so on for the respective recording heads.

The first light receiving portion 210 disposed adjacent one of the end portions of the movement range of the carriage 205 receives light from the LED 101 of the ink container 1, and a signal indicative of the event is supplied to the control circuit 300. The control circuit 300, as will be described hereinafter, responds to the signal to discriminate the position of the ink container 1 in the carriage 205. In addition, an encoder scale 209 is provided along the movement path of the carriage 205, and the carriage 205 is correspondingly provided with an encoder sensor 211. The detection signal of the sensor is supplied to the control circuit 300 through the flexible cable 206, by which the movement position of the carriage 205 is obtained. The position information is used for the respective recording head ejection controls, and is used also for light validation process in which the positions of the ink containers are detected, which will be described hereinafter in conjunction with FIG. 25. A second light emission/receiving portion 214 is provided in the neighborhood of the predetermined position in the movement range of the carriage 205, includes a light emitting element and a light receiving element, and it functions to output to the control circuit 300 a signal relating to an ink remaining amount of each of the ink container 1 carried on the carriage 205. The control circuit 300 can detect the ink remaining amount on the basis of the signal.

2.2 Connecting Portion (FIG. 20-FIG. 24)

Figure 20:
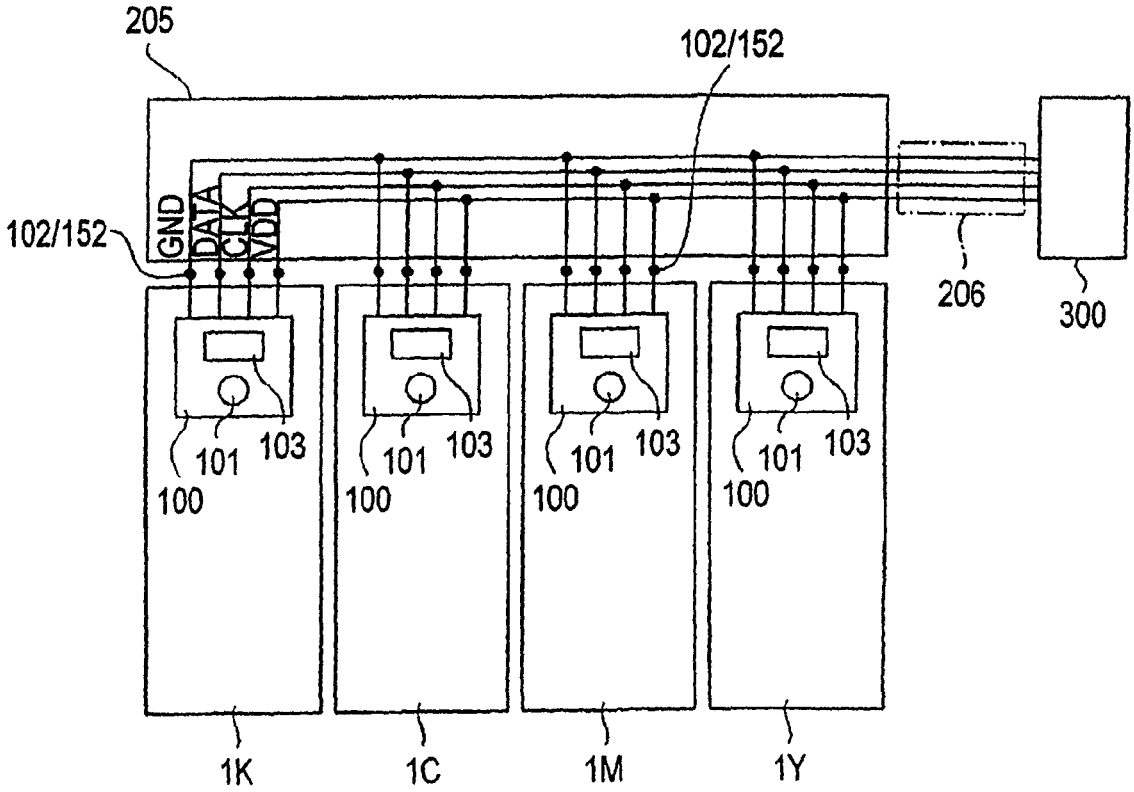
FIG. 20 shows structure of signal line wiring for signal transmission between the ink container and the flexible cable of the ink jet printer in terms of the substrate of the ink container.

FIG. 20 shows a structure of signal line wiring for signal transmission between the ink container 1 and the flexible cable 206 of the ink jet printer in terms of the substrate 100 of the ink container 1.

As shown in FIG. 20, the signal line wiring for the ink container 1 comprises four signal lines in this embodiment, each of them is common for all of four ink containers 1 (bus connection). The signal line wiring for the ink containers 1 include four signal lines, namely, a voltage source signal line VDD relating to electric power supply such as for an operation of a group of function elements for effecting light emission, actuation of the LED 101 in the ink container; a ground signal line GND; a signal line DATA for supplying control signal (control data), the like relating to the process such as turning-on and -off of the LED 101 from the control circuit 300; and a clock signal line CLK therefor. In this embodiment, four signal lines are employed, but the present invention is not limited to this case. For example, the ground signal may be supplied through another structure, and in such a case, the line GND can be omitted in the above-described structure. On the other hand, the line CLK and the line DATA may be made one common line.

Each of the substrates 100 of the ink containers 1 has a controller 103 which is responsive to the signal supplied through the four signal lines, and a LED 101 actuable in response to the output of the controller 103.

Figure 21:
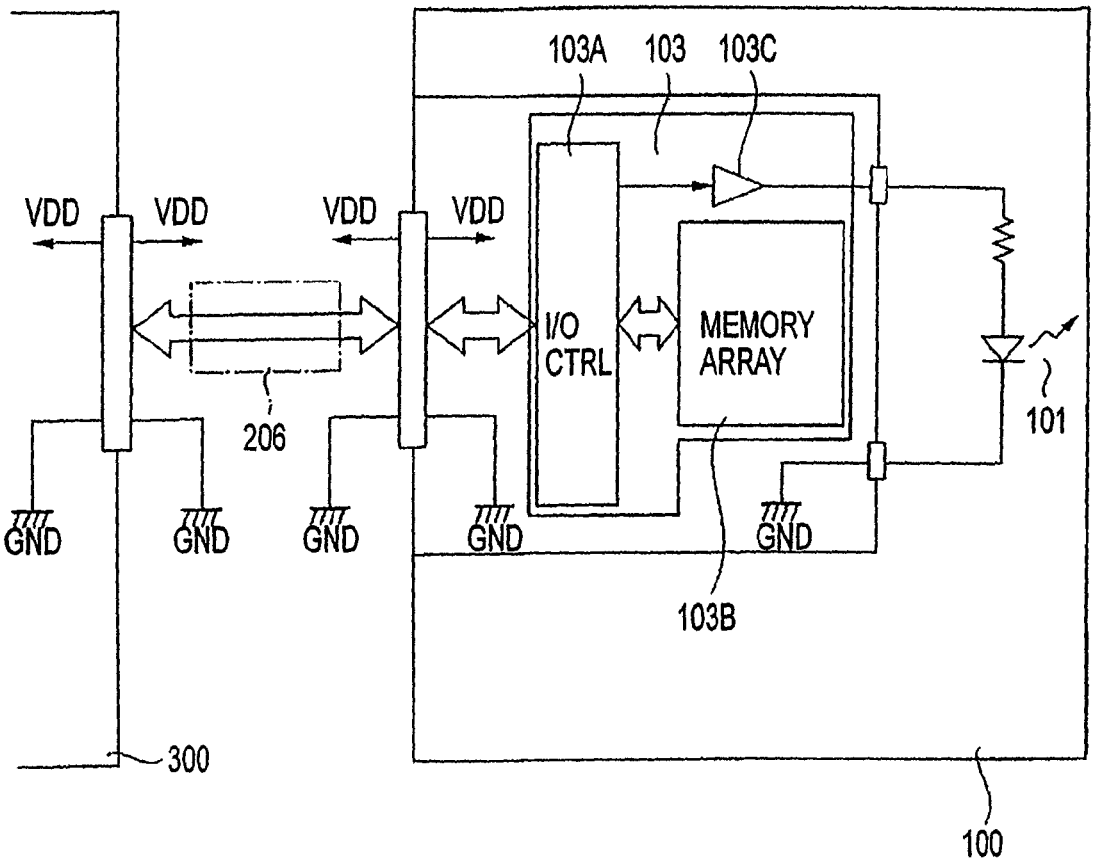

FIG. 21 is a detailed circuit diagram of the substrate having such a controller or the like. As shown in the Figure, the controller 103 comprises an I/O control circuit (I/O-CTRL) 103A, a memory array 103B and a LED driver 103C. The I/O control circuit 103A is responsive to control data fed through the flexible cable 206 from the control circuit 300 of the main assembly side to control the display driving of the LED 101, the writing of the data in the memory array 103B and the reading of the data. The memory array 103B is in the form of an EEPROM in this embodiment, and is able to store individual information of the ink container, such as information relating to the ink remaining amount in the ink container, the color information of the ink therein, and in addition, manufacturing information such as an individual number of the ink container, production lot number or the like. The color information is written in a predetermined address of the memory array 103B corresponding to the color of the ink stored in the ink container. For example, the color information is used as ink container discrimination information (individual information) which will be described hereinafter in conjunction with FIGS. 23 and 24 to identify the ink container when the data is written in the memory array 103B and is read out therefrom, or when the actuation and deactuation of the LED 101 is controlled for the particular ink container. The data written in the memory array 103B or read out of it include, for example, the data indicative of the ink remaining amount. The ink container of this embodiment, as described hereinbefore, is provided in the bottom portion with a prism, and when the remaining amount of the ink becomes small, the event can be optically detected by means of the prism. In addition to that, the control circuit 300 of this embodiment counts the number of ejections for each of the recording heads on the basis of the ejection data. The remaining amount information is written in the memory array 103B of the corresponding ink container, and the information is read out. By doing so, the memory array 103B stores the information of the ink remaining amount in real time. The information represents the ink remaining amount with high accuracy since the information is provided with the aid of the prism, too. Also, it is possible to use it to discriminate whether the mounted ink container is a fresh one, or used and then remounted one.

A LED driver 103C functions to apply a power source voltage to the LED 101 to cause it to emit light when the signal supplied from the I/O control circuit 103A is at a high level. Therefore, when the signal supplied from the I/O control circuit 103A is at a high level, the LED 101 is in the on-state, and when the signal is at a low level, the LED 101 is in the off-state.

Figure 22:
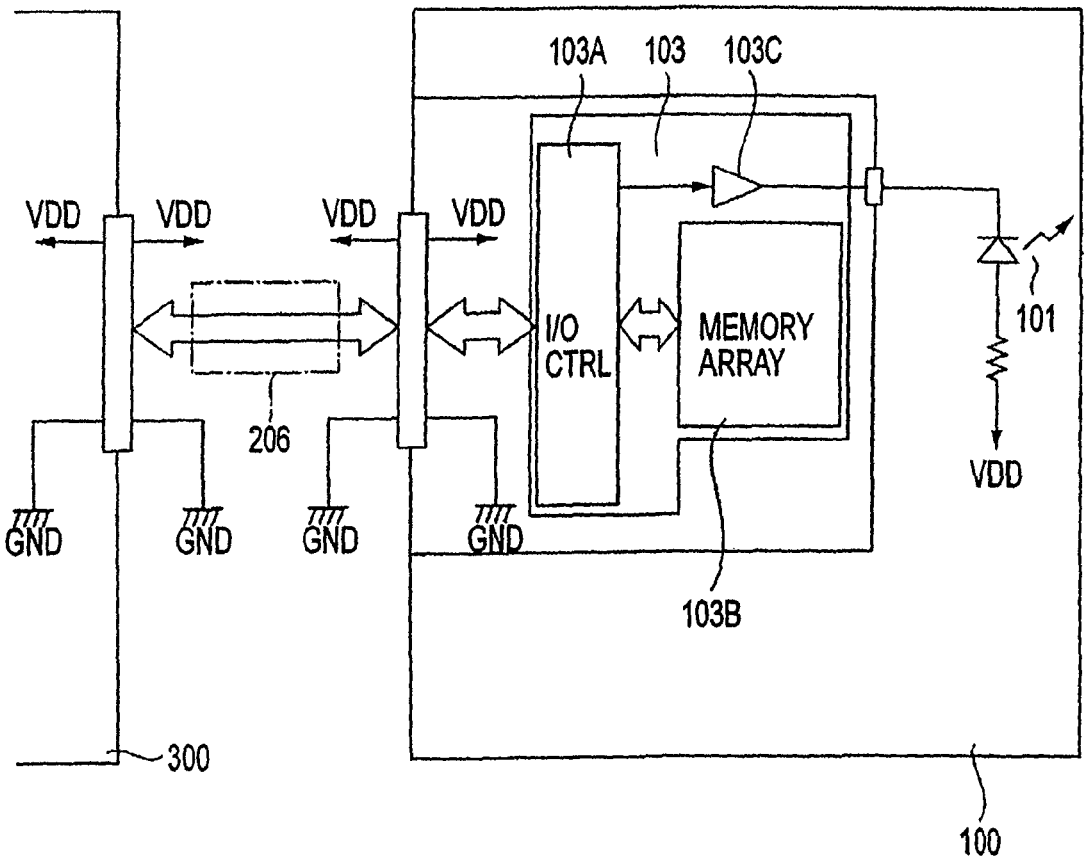
FIG. 22 is a circuit diagram of a modified example of the substrate of FIG. 21.

FIG. 22 is a circuit diagram of a modified example of the substrate of FIG. 21. This modified example is different from the example of FIG. 21 in the structure for applying the power source voltage to the LED 101, more particularly, the voltage source voltage is supplied from the VDD voltage source pattern provided inside the substrate 100 of the ink container. Ordinarily, the controller 103 is built in a semiconductor substrate, and in this example, the connecting contact on the semiconductor substrate is only for the LED connecting contact. Reduction of the number of the connecting contacts is significantly influential to the area occupied by the semiconductor substrate, and in this sense, the modified example in addition advantageous in terms of cost reduction of the semiconductor substrate.

Figure 23:
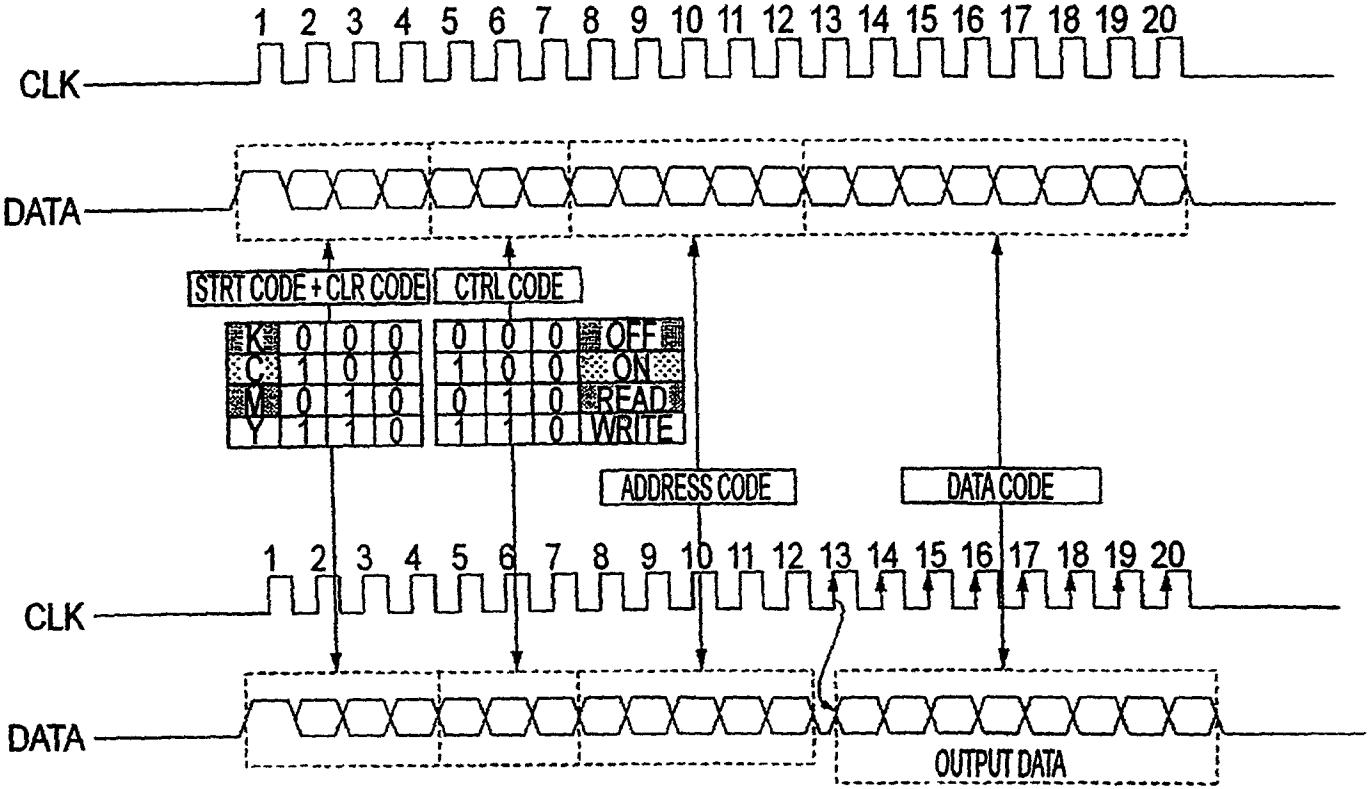
FIG. 23 is a timing chart illustrating the data writing and reading operations to and from a memory array of the substrate.
Figure 24:
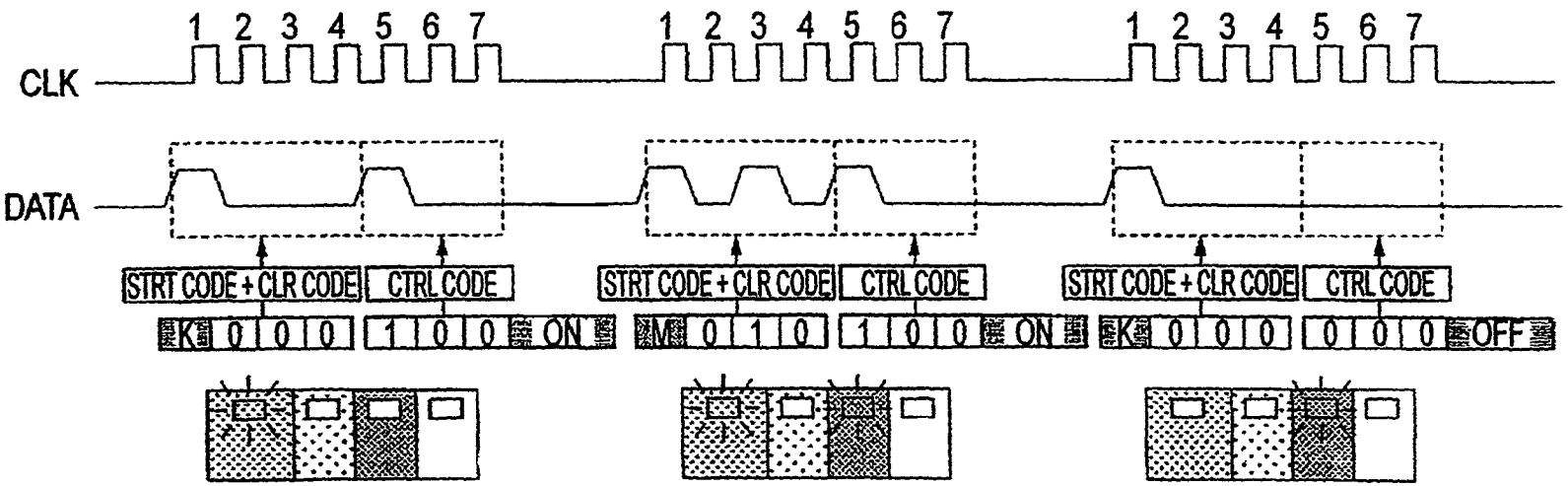
FIG. 24 is a timing chart illustrating actuation and deactuation of LED 101.

FIG. 23 is a timing chart illustrating the data writing and reading operations to and from the memory array 103B of the substrate. newpa FIG. 24 is a timing chart illustrating actuation, deactuation of LED 101.

As shown in FIG. 23, in the writing in the memory array 103B, start code plus color information, control code, address code, data code, are supplied in the order named from the control circuit 300 in the main assembly side through the signal line DATA (FIG. 20) to the I/O control circuit 103A in the controller 103 of the ink container 1 in synchronism with the clock signal CLK. The start code signal in the start code plus color information indicates the beginning of the series of the data signals, and the color information signal is effective to identify the particular ink container which the series of data signal are related to. Here, the color of the ink includes not only the Y, M, C or the like color but also such ink having different densities.

As shown in the Figure, the color information has a code corresponding to each colors of the ink, K, C, M and Y. The I/O control circuit 103A compares the color information indicated by the code with the color information stored in the memory array 103B of the ink container per se. Only if they are the same, the subsequent data are taken in, and if not, the subsequent data are ignored. By doing so, even when the data signal is supplied commonly to all of the ink containers from the main assembly, side through the common signal line DATA held in FIG. 20, the ink, container to which the data are concerned can be correctly identified since the data include, the color information, and therefore, the processing on the basis of the subsequent data, such as the writing, reading of the subsequent data, actuation, deactuation of the LED, can be effected only to the identified ink container (that is, only to the right ink container). As a result, (one) common data signal line is enough for all of the four ink containers to write the data in, to actuate the LED and to deactuate the LED, thus reducing the required number of the signal lines. As will be readily understood, (one) common data signal line is enough irrespective of the number of the ink containers.

As shown in FIG. 23, the control modes of this embodiment include OFF and ON codes for actuation and deactuation of the LED which will be described hereinafter, and READ and WRITE codes for reading out of the memory array and writing therein. In the writing operation, the WRITE code follows the color information code for identifying the ink container. The next code, i.e., the address code indicates an address in the memory array in which the data are to be written in, and the last code, i.e., the data code indicates the content of information to be written in.

The content indicated by the control code is not limited to the example described above, and, for example, control codes for verification command and/or continuous reading command may be added.

For the reading operation, the structure of the data signal is the same as in the case of the writing operation. The code of the start code plus color information is taken by the I/O control circuit 103A of all of the ink containers, similarly to the case of the writing operation, and the subsequent data signal are taken in only by the I/O control circuit 103A of the ink container having the same color information. What is different is that the read data are outputted in synchronism with rising of the first clock (13th clock in FIG. 23) after the address is designated by the address code. Thus, the I/O control circuit 103A effects control to prevent interference of the read data with another input signal even though the data signal contacts of the ink containers are connected to the common (one) data signal line.

As shown in FIG. 24, with respect to the actuation (turning-on) and the deactuation (turning-off) of the LED 101, the data signal of the start code plus color information is first sent to the I/O control circuit 103A through the signal line DATA from the main assembly side, similarly to the foregoing. As described hereinbefore, the right ink container is identified on the basis of the color information, and the actuation and deactuation of the LED 101 by the control code fed subsequently, are effected only for the identified ink container. The control codes for the actuation and the deactuation, as described hereinbefore in conjunction with FIG. 23, include one of ON code and OFF code which are effective to actuate and deactuate the LED 101, respectively. Namely, when the control code indicates. ON, the I/O control circuit 103A outputs an ON signal to the LED driver 103C, as described hereinbefore in conjunction with FIG. 22, the output state is continuously maintained thereafter. On the contrary, when the control code indicates. OFF, the I/O control circuit 103A outputs an OFF signal to the LED driver 103C, and the output state is continuously maintained thereafter. The actual timing for the actuation or deactuation of the LED 101 is after 7th clock of the clock CLK for each of the data signals.

In the example of this Figure, the black (K) ink container which the leftmost data signal designates is first identified, and then, the LED 101 of the black ink K container is switched on. Then, the color information of the second data signal indicates magenta ink M, and the control code indicates actuation, and therefore, the LED 101 of the ink M container is switched on while the LED 101 of the ink K container is kept in ON state. The control code of the third data signal means instruction of deactuation, and only the LED 101 of the ink K container is deactuated.

As will be understood from the foregoing description, the flickering control of the LED is accomplished by the control circuit 300 of the main assembly side sending repeated actuation and deactuation control codes alternately for the identified ink container. The cyclic period of the flickering can be determined by selecting the cyclic period of the alternating control codes.

2.3 Control Process (FIG. 25-FIG. 31)

FIG. 25 is a flow chart illustrating control processes relating the mounting and demounting of the ink container according to the embodiment of the present invention, and particularly shows the actuation and deactuation control for the LED 101 of each of the ink container 1 by the control circuit 300 provided in the main assembly side.

The process shown in FIG. 25 starts in response to the user opening the main assembly cover of the printer 201 which is detected by a predetermined sensor. When the process is started, the ink container is mounted or demounted by step S101.

FIG. 26 is a flow chart of a mounting and demounting process of the ink container in FIG. 25. As shown in the Figure, in the mounting or demounting process, the carriage 205 moves at step S201, and the information of the state of ink container (individual information thereof) carried on the carriage 205 is obtained. The information of the state to be obtained here is an ink remaining amount or the like which is read out of the memory array 1038 together with the number of the ink container. In step S202, the discrimination is made as to whether the carriage 205 reaches the ink container exchange position having been described in conjunction with FIG. 18 or not.

If the result of the discrimination is affirmative, step S203 is executed for ink container mounting confirmation control.

FIG. 27 is a flow chart showing in detail the mounting confirmation control in FIG. 26. First, in step S301, a parameter N indicative of the number of the ink container carried on the carriage 205 is set, and a flag F (k) for confirmation of light emission of the LED correspondingly to the number of the ink container, is initialized. In this embodiment, N is set to 4 since the number of the ink containers is 4 (K, C, M, Y). Then, four flags F (k), k=1-4 are prepared, and they are all initialized to zero.

In step S302, a variable An of the flag relating to the order of mounting discrimination for the ink container is set to "1", and in step S303, the mounting confirmation control is effected for the Ath ink container. In this control, the contact 152 of the holder 150 and the contact 102 of the ink container are contacted with each other by the user mounting the ink container to the right position in the holder 150 of the recording head unit 105, by which the control circuit 300 of the main assembly side, as described hereinbefore, identifies the ink container by the color information (individual information for the ink container), and the color information stored in the memory array 103B of the identified container is sequentially read out. The color information for the identification is not used for the already read out one or ones. In this control process, the discrimination is also made as to whether or not the read color information is different from the color information already read out after the start of this process.

In step S304, if the color information have been able to read out, the color information has been different from the already read out piece or pieces of information, it is then discriminated that ink container of the color information is mounted as the A-th ink container. Otherwise, it is discriminated that A-think container is not mounted. Here, the "A-th" represents only the order of discrimination of the ink container, does not represent the order indicative of the mounted position of the ink container. When the A-th ink container is discriminated as being correctly mounted, the flag F (A) (the flag satisfying k=An among the prepared flags flag F (k), k=1-4) is set to "1" in step S305, as described, hereinbefore in conjunction with FIG. 24, and the LED 101 of the ink container 1 having the corresponding color information is switched on. When it is discriminated that the ink container is not mounted, the flag F (A) is set to "0" in step S311.

Then, in step S306, the variable An is incremented by 1, and in step S307, the discrimination is made as to whether or not the variable An is larger than N set in the step S301 (in this embodiment, N=4). If the variable An is not more than N, the process subsequent to step S303 is repeated. If it is discriminated as being larger than N, the mounting confirmation control has been completed for all of four ink containers. Then, in step S308, the discrimination is made as to whether or not the main assembly cover 201 is in an open position on the basis of an output of the sensor. When the main assembly cover is in a closed state, an abnormality state is returned to the processing routine of FIG. 26 in step S312 since there is a possibility that user has closed the cover although one of some of the ink containers are not mounted or are not properly mounted. Then, this process operation is completed.

When, on the contrary, the main assembly cover 201 is discriminated as being open in the step S308, the discrimination is made as to whether or not all of the four flags F (k), k=1-4 are "1", that is, whether the LEDs 101 are all switched on or not. If it is discriminated that at least one of the LEDs 101 is not switched on, the process subsequent to the step S302 is repeated. Until the user mount or correctly remount the ink container or ink containers of which the LEDs 101 are not switched on, the LED of the ink container or containers is switched on, and the process operation is repeated.

Figure 28:
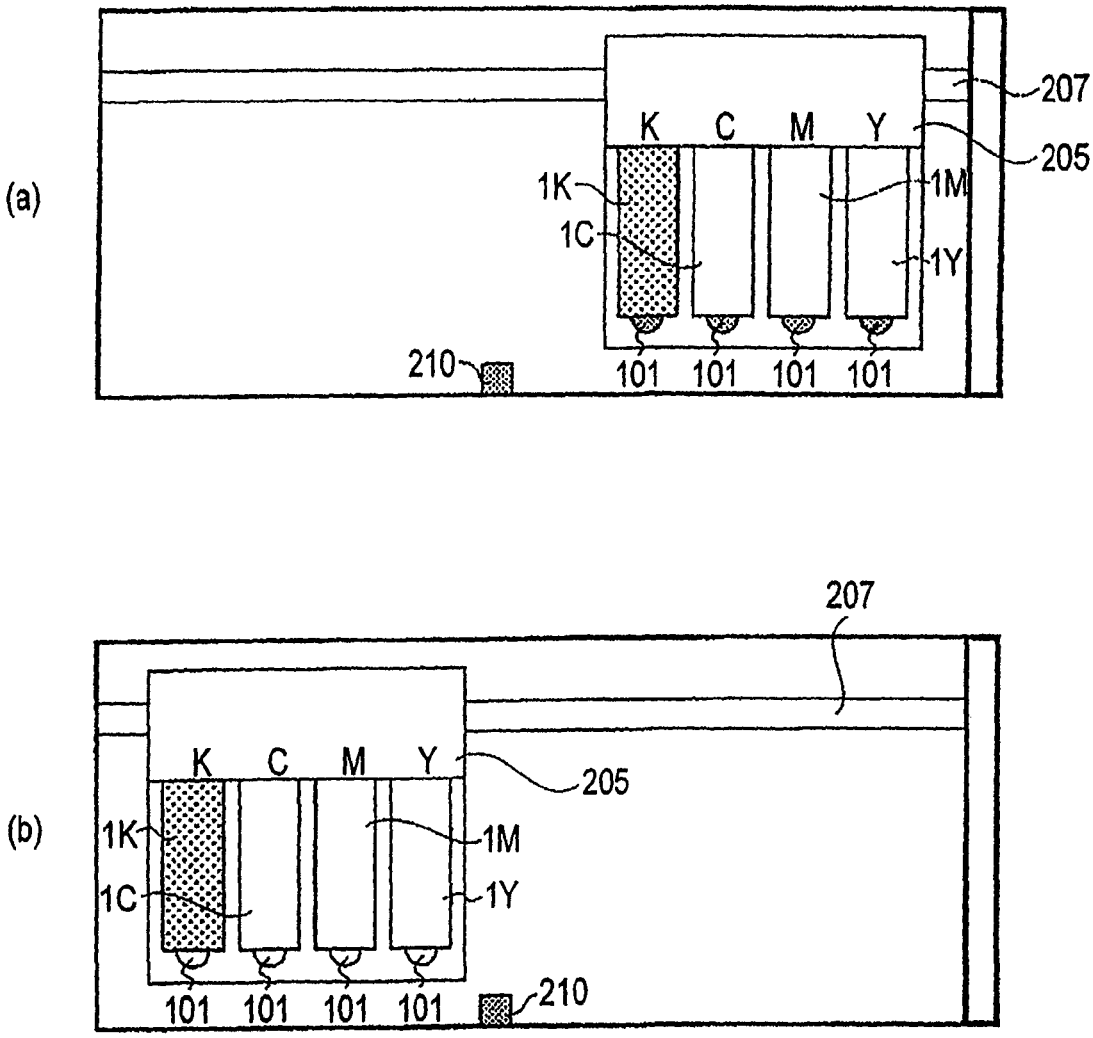
FIG. 28 shows a state (a) in which all of the ink containers are correctly mounted at correct positions, and therefore the LEDs are switched on, respectively, in the process of the control for the mounting and demounting of the ink containers, in which (b) shows movement of the carriage to a position for validation which is carried out using light (light validation), after the main assembly cover is closed subsequently to the LED lightening.

When all of the LEDs are discriminated as being switched on, a normal ending operation is carried out in step S310, and this process operation is completed. Then, the process returns to the processing routine shown in FIG. 26. FIG. 28 shows a state (a) in which all of the ink containers are correctly mounted at correct positions, and therefore, the LEDs are all switched on, respectively.

Referring back to FIG. 26, after the ink container mounting confirmation control (step S203) is executed in the above-described manner, the discrimination is made as to whether or not the control is normally completed, namely, whether or not the ink containers are properly mounted, in step S204. If the mountings are discriminated as being normal, the displaying device (FIG. 17 and FIG. 18) in the operating portion 213 is lighted green, for example, and in step S205, a normal ending is executed at step S206, and the operation returns to the example shown in FIG. 25. When the abnormality mounting is discriminated, the displaying device in the operating portion 213 is flickered orange, for example, in step S207, and the abnormality ending is carried out, and then, the operation returns the processing routine shown in FIG. 25. When the printer is connected with a host PC which controls the printer, the mounting abnormality display is also effected on the display of the PC simultaneously.

In FIG. 25, when the ink container seating process of step S101 is completed, the discrimination is made as to whether or not the mounting or demounting process is properly completed in step S102. If the abnormality is discriminated, the process operation waits for the user to open the main assembly cover 201, and in response to the opening of the cover 201, the process of the step S101 is started, so that process described in conjunction with FIG. 26 is repeated.

When the proper mounting or demounting process is discriminated in step S102, the process waits for the user to close the main assembly cover 201 in step S103, and the discrimination is made as to whether or not the cover 201 is closed or not in step S104. If the result of the discrimination is affirmative, the operation proceeds to light validation process of step S105. In this case, if the closing of the main assembly cover 201 is detected as shown by (b) in FIG. 28, the carriage 205 moves to the position for light validation, and the LEDs 101 of the ink containers are deactuated.

The light validation process is intended to discriminate whether or not the properly mounted ink containers are mounted at the correct positions, respectively. In this embodiment, the structures of the ink containers are not such that configurations thereof are made peculiar depending on the colors of the ink contained therein for the purpose of preventing the ink containers from being mounted at wrong positions. this is for the simplicity of manufacturing of the ink container bodies. Therefore, there is a possibility that ink containers are mounted at wrong positions. The light validation process is effective to detect such wrong mounting and to notify the user of the event. By this, the efficiency and low cost of the ink container manufacturing are accomplished since it is not required to make the configurations of the ink containers different from each other depending on the colors of the ink.

Figure 29:
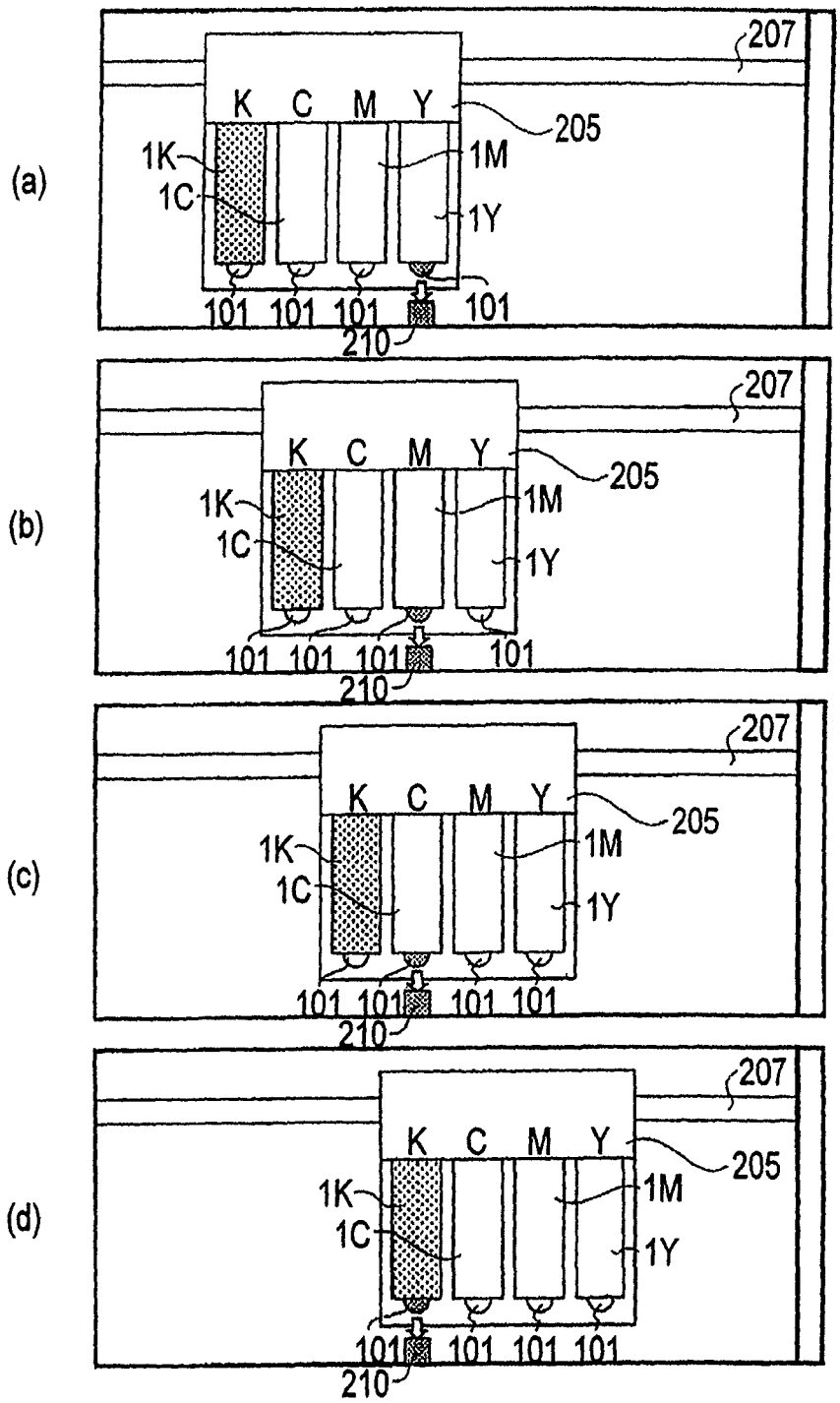
FIG. 29 illustrates the light validation process (a)-(d).
Figure 30:
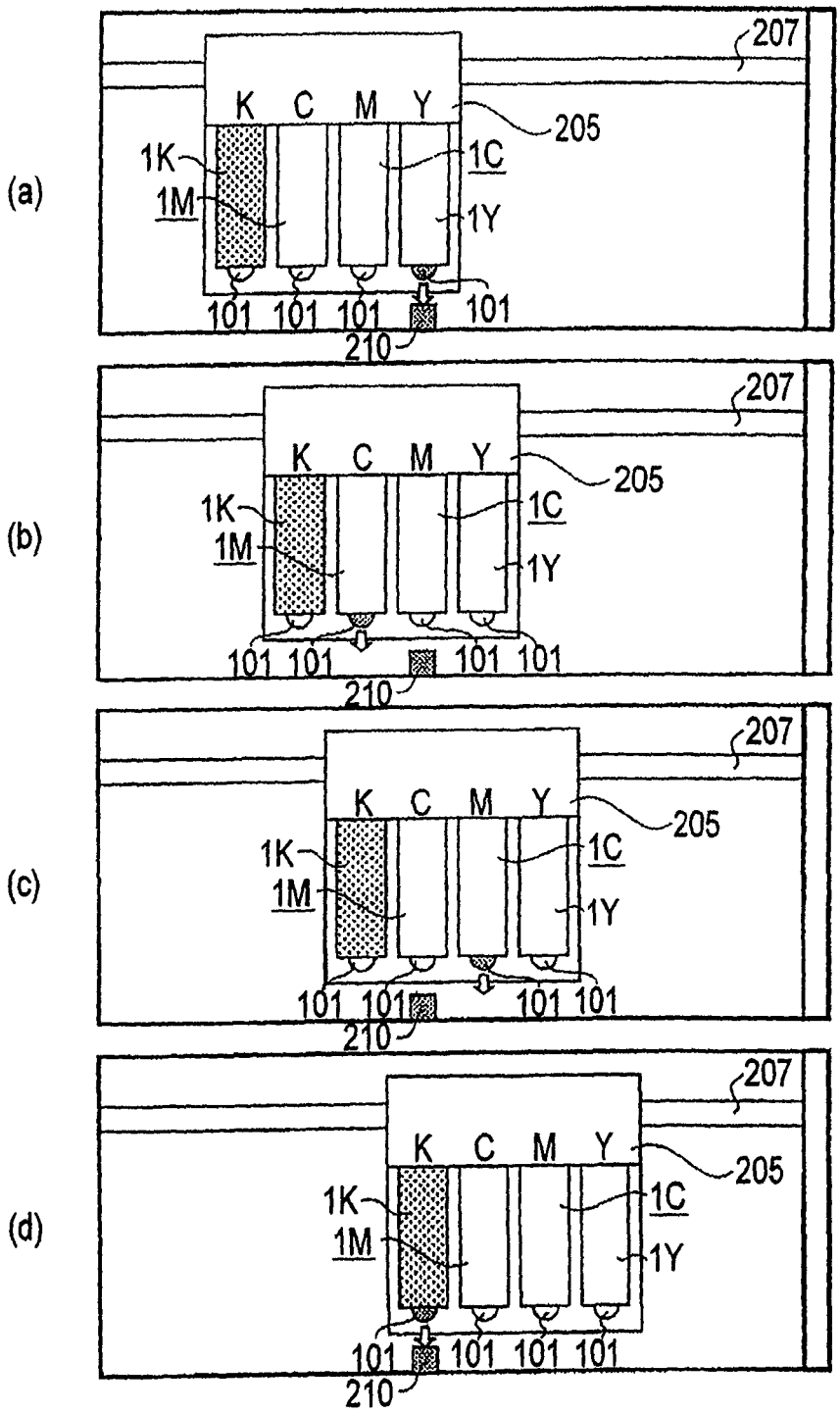
FIG. 30 also illustrates the light validation process (a)-(d).

FIG. 29 illustrates the light validation process (a)-(d). newpa FIG. 30 also illustrates the light validation process (a)-(d).

As shown by (a) in FIG. 29, the movable carriage 205 first starts moving from the lefthand side to the righthand side in the Figure toward the first light receiving portion 210. When the ink container placed at the position for a yellow ink container comes opposed to the first light receiving portion 210, a signal for actuating the LED 101 of the yellow ink container is outputted in order to switch it on for a predetermined time duration, by the control having been described in conjunction with FIG. 24. When the ink container is placed at the correct position, the first light receiving portion 210 receives the light from the LED 101, so that the control circuit 300 discriminates that ink container 1Y is mounted at the correct position.

While moving the carriage 205, as shown by (b) in FIG. 29, when the ink container placed at the position for a magenta ink container comes opposed to the first light receiving portion 210, a signal for actuating the LED 101 of the magenta ink container is outputted to switch it on for a predetermined time duration, similarly. In the example shown in the Figure, the ink container 1M is mounted at the correct position, so that first light receiving portion 210 receives the light from the LED. As shown by (b)-(d) in FIG. 29, the light is emitted sequentially, while changing the position of discrimination. In this Figure, all of the ink containers are mounted at correct positions.

On the contrary, if a cyan ink container 1C is erroneously mounted at a position for a magenta ink container 1M, as shown by (b) in FIG. 30, the LED 101 of the ink container 1C which is opposed to the first light receiving portion 210 is not actuated, but the ink container 1M mounted at another position is switched on. As a result, the first light receiving portion 210 does not receive the light at the predetermined timing, so that control circuit 300 discriminates that mounting position has an ink container other than the ink container 1M (right container). If a magenta ink container 1M is erroneously mounted at a position for a cyan ink container 1C, as shown by (c) in FIG. 30, the LED 101 of the ink container 1M which is opposed to the first light receiving portion 210 is not actuated, but the ink container 1C mounted at another position is switched on.

In this manner, the light validation process with the control circuit 300 described above is effective to identify the ink container or ink containers not mounted at the correct position. If the mounting position does not have the correct ink container mounted thereto, the color of the ink container erroneously mounted there can be identified by sequentially actuating the LEDs of the other three color ink containers.

In FIG. 25, after the light validation process in the step S105, the discrimination is made as to whether or not the light validation process is properly completed or not in step S106. When the proper completion of the light validation is discriminated, the displaying device in the operating portion 213 is lighted up green, for example, in step S107, and the process ends. On the other hand, if the ending is discriminated as being abnormal, the displaying device in the operating portion 213 is flickered orange at step S109, and the LED 101 of the ink container which is not mounted at the correct position and which has been identified in the step S105 is flickered or switched on in step S105. In this manner, when the user opens the main assembly cover 201, the user is notified of the ink container which is not mounted at the correct position, so that user is prompted to remount it to the correct position.

Figure 31:
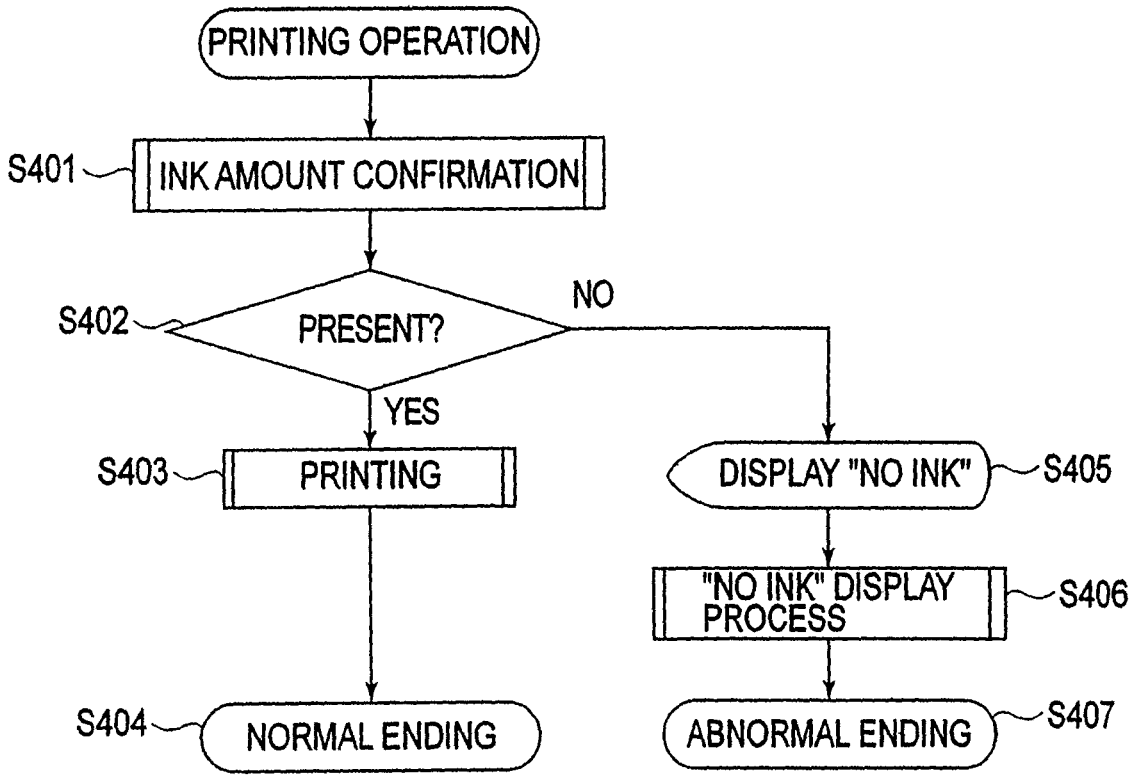
FIG. 31 is a flow chart illustrating a recording process according to the embodiment of the present invention.

FIG. 31 is a flow chart illustrating a recording process according to the embodiment of the present invention. In this process, the ink remaining amount is first checked in step S401. In this process, an amount of printing is determined from the printing data of the job for which the printing is going to be effected, and the comparison is made between the determined amount and the remaining amount of the ink container to check whether the remaining amount is sufficient or not (confirmation process). In this process, the ink remaining amount is the amount detected by the control circuit 300 on the basis of the counting.

In step S402, the discrimination is made as to whether the remaining ink amount is sufficient to the printing or not, on the basis of the confirmation process. If the ink amount is sufficient, the operation goes to the printing in step S403, and the displaying device of the operating portion 213 is lighted green at step S404 (normal ending). On the other hand, if the result of the discrimination at the step S402 indicates a shortage of the ink, the displaying device of the operating portion 213 is flickered orange in the step S405, and in step S406, the LED 101 of the ink container 1 containing the insufficient amount of the ink is flickered or switched on (abnormal ending). When the recording device is connected with a host PC which controls the recording device, the ink remaining amount may be displayed on the display of the PC, simultaneously.

3. Other Embodiments (FIG. 32-FIG. 40)

In the first embodiment described in the foregoing, the first engaging portion 5 provided on the ink container rear side is inserted into the first locking portion 155 provided at the rear side of the holder, and the ink container 1 is rotated about the rotational pivot which is the inserted portion, while pushing the ink container front side down. When such a structure is employed, the position of the substrate 100 is, as described hereinbefore, the front side which is away from the rotational pivot, and the first light receiving portion 210, and the first light emitting portion 101 for directing the light toward the first light receiving portion 210, toward the user's eyes are integral with the substrate 100, accordingly.

However, in some cases, the preferable position of the substrate and the position required by the light emitting portion are different from each other, depending on the structures of the ink container and/or the mounting portion thereof. In such a case, the substrate and the light emitting portion may be disposed at proper positions. In other words, they are not necessarily integral with each other.

Figure 32:
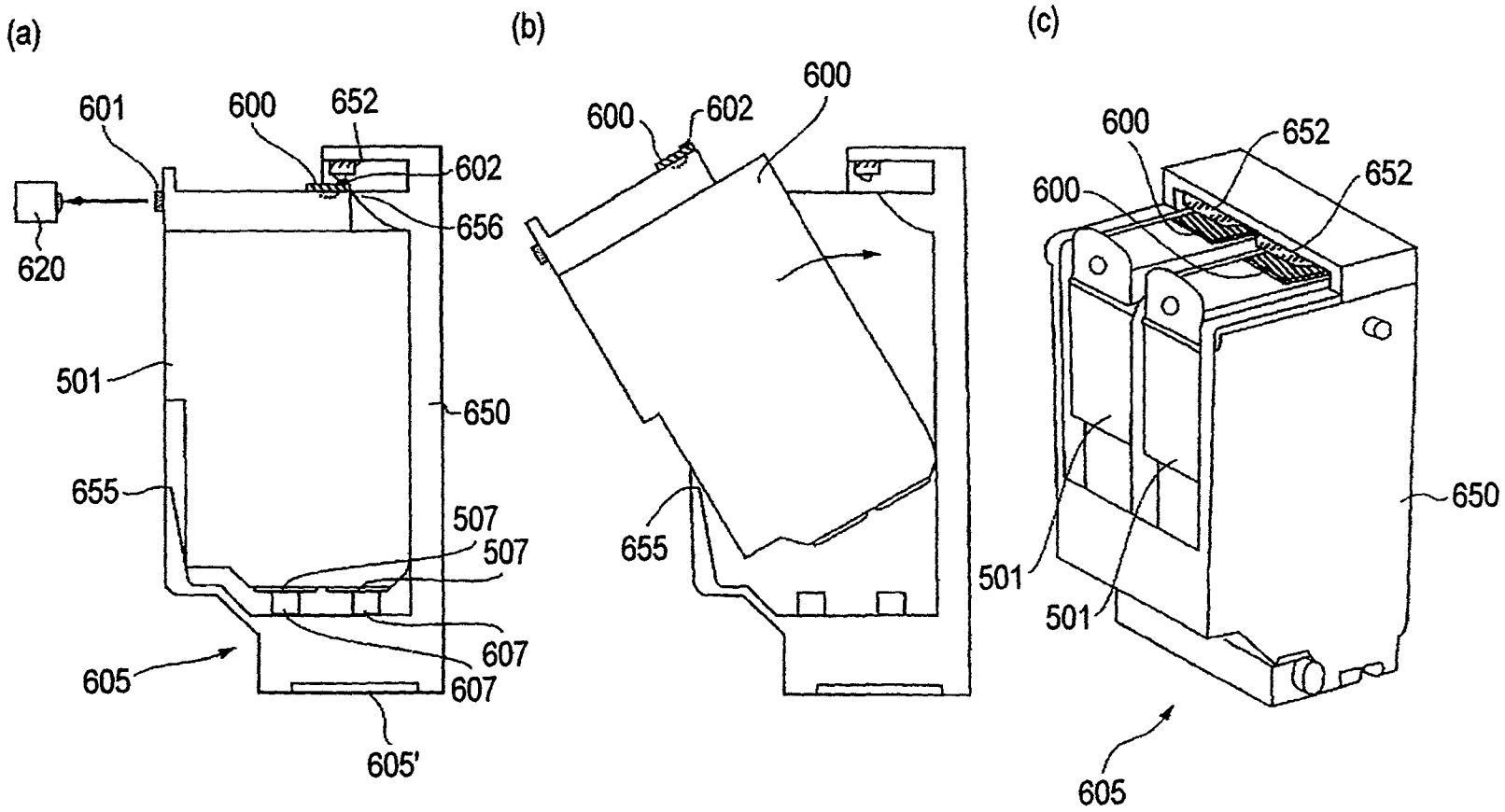
FIG. 32 illustrates structures of an ink container and a mounting portion thereof according to another embodiment of the present invention, and a mounting operation thereof (a)-(c).

FIG. 32 illustrates structures of an ink container and a mounting portion thereof according to another embodiment of the present invention ((a)-(c)).

As shown by (a) in FIG. 32, the ink container 501 of this embodiment of the present invention, is provided on the top side adjacent the front side with a substrate 600 which has a light emitting portion 601 such as LED, which has a pad 602 at the top rear portion. When the light emitting portion 601 is actuated, the light is emitted toward the front side. A light receiving portion 620 is disposed at a position for receiving the light directed leftward in the Figure adjacent an end of a scanning range of the carriage. When the carriage comes to such a position, the light emitting portion 601 is controlled, so that recording device side can obtain predetermined information relating to the ink container 501 from the content of the light received by the light receiving portion. When the carriage is at the center portion of the scanning range, for example, the light emitting portion 601 is controlled, by which the user is able to see the state of lightening so that predetermined information relating to the ink container 501 can be recognized by the user.

As shown by (c) in FIG. 32, the recording head unit 605 comprises a holder 650 for detachably holding a plurality of ink containers (two, in the example of the Figure), a recording head 605' provided at the bottom side thereof. By mounting the ink container 501 in the holder 650, an ink introduction opening 607 of the recording head side located in the inner bottom portion of the holder is connected with an ink supply port 507 located in the bottom portion of the ink container, so that ink fluid communication path is established therebetween. The holder 650 is provided on a rear side thereof with a locking portion 656 for locking the ink container 501 at the complete mounting position with the engaging portion 655 (rotational center) at the front side. Adjacent the locking portion 656, there is provided a connector 652 connected with a pad 502 of the substrate 500.

When the ink container 501 is mounted to the recording head unit 605, the user brings the ink container 501 to the front side of the holder 650, as shown by (b) in FIG. 32, presses the lower edge portion of the ink container rear side to the rear side of the holder 650 to bring the ink container front side into engagement with the engaging portion 655 of the holder 650. With this state, the upper portion of the front side of the ink container 501 is pressed toward the rear side, by which the ink container 501 is mounted in the holder while rotating in the direction indicated by an arrow about the engaging portion 655. Indicated by (a) and (c) in FIG. 32 is the ink container 501 which has been completely mounted, wherein the ink supply port 507 and the ink introduction opening 607 are connected to each other, and the pad 602 and the connector 652 are connected with each other. In addition, the pad 602 and the connector 652 are located at a position as far as possible from the rotational center upon the mounting operation, and immediately before completion of the mounting of the ink container 501, they are contacted to each other so that satisfactory electrical connection property is established therebetween upon the completion of mounting.

The structures of the engaging portion 655 of the holder 650 and the locking portion 656 and the corresponding structure of the ink container 501 side, may be properly determined by one skilled in the art. In the example shown in the Figure, the substrate 600 is provided on the top surface of the ink container 501, and extends in parallel with the top surface, but this is not limiting, and it may be inclined as in the first embodiment. Furthermore, the holder 650 and the structural members relating to it is not necessarily provided in the head unit.

Figure 33:
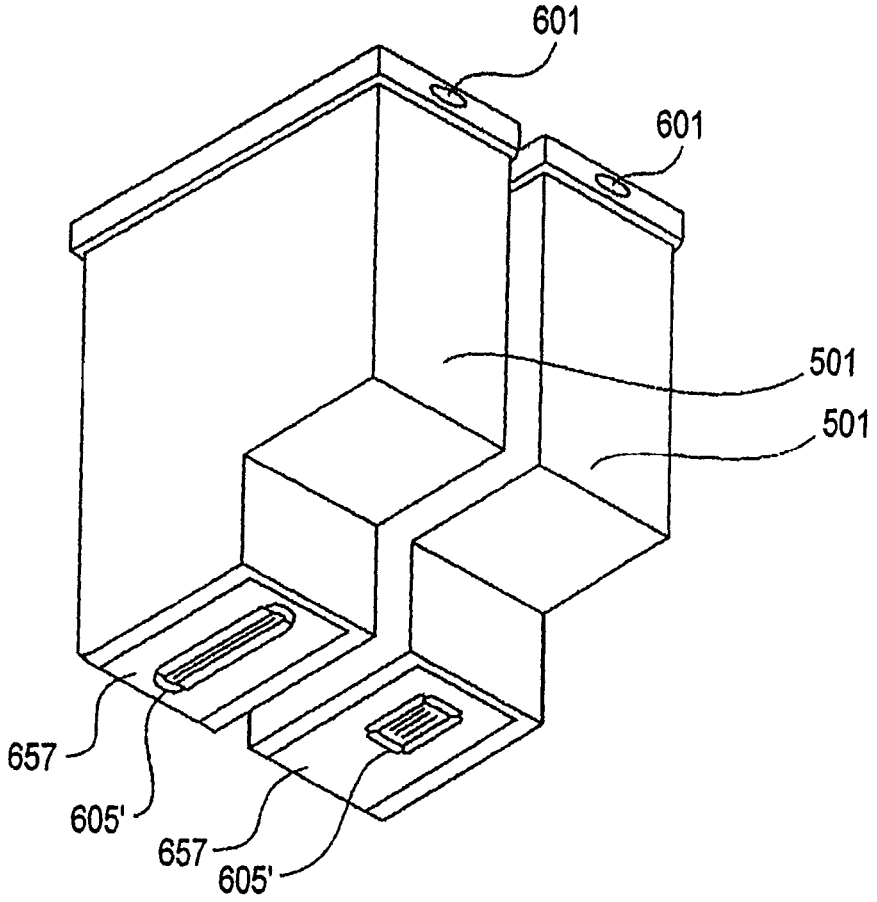
FIG. 33 is a perspective view illustrating a modified example of the structure of FIG. 32.

FIG. 33 shows a modified example of FIG. 32 structure, and shows two recording head units (liquid containing cartridges) each of which comprises an ink container 501 and a recording head 605' which are integral with each other. In this embodiment, one of the units is a cartridge for black ink, and the other is a cartridge for yellow, magenta and cyan inks.

The holder 650 may be provided with similar structures corresponding to such a structure. In this embodiment, the control circuit for the light emitting portion 601 disposed on the front side may be provided at a proper position on the head unit. For example, a control circuit is provided on the driving circuit substrate having an integral recording head 605', and the wiring is extended to the light emitting portion 601. In such a case, a driving circuit for the recording head 605' and the control circuit for the light emitting portion 601 are connected with an electrical contact portion on the carriage through an unshown electrical contact portion.

Figure 34:
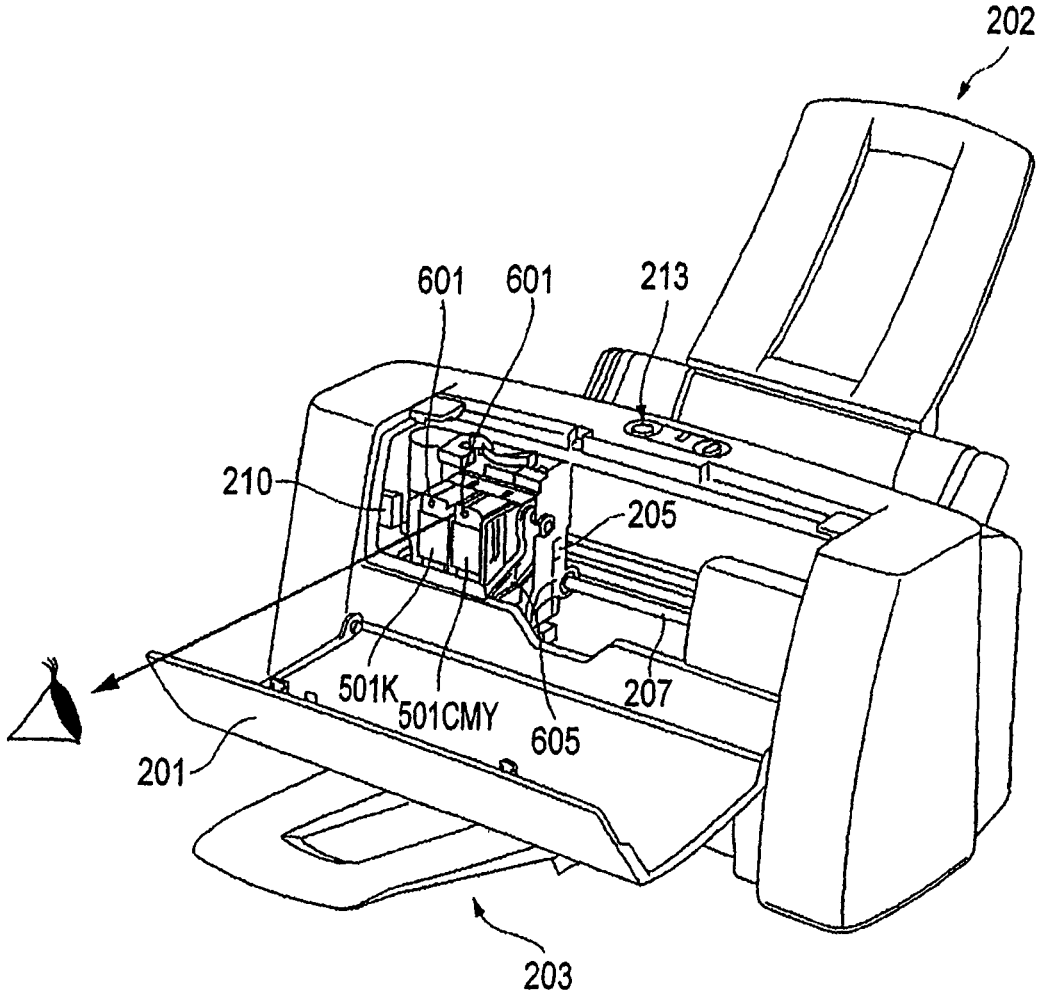
FIG. 34 is a perspective view of a printer to which the ink container according to said another embodiment of the present invention.

FIG. 34 is a perspective view of a printer to which the ink container according to said another embodiment of the present invention. The same reference numerals as in Embodiment shown in FIG. 17 and FIG. 18 are assigned to the elements having the corresponding functions in this embodiment, and the detailed description thereof is omitted for simplicity.

As shown in FIG. 34, an ink container 501K containing black ink, and an ink containers 501CMY having integral accommodating chambers containing cyan, magenta and yellow inks separately, are mounted in the holder of the recording head unit 605 on the carriage 205. In each of the ink container, as described hereinbefore, the LED 601 is provided as a separate member from the substrate, and the user can see the LEDs 601 at the front side when the ink container is mounted at the exchange position. Corresponding to the position of the LEDs, a light receiving portion 210 is provided in the neighborhood of one of the end portions of the movement range of the carriage 205.

Figure 35:
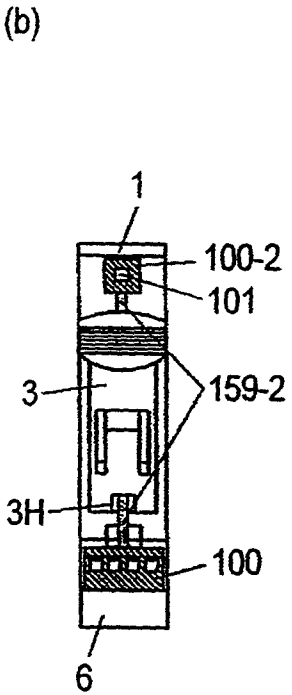
FIG. 35 is a schematic side view (a) and a schematic front view (b) of an ink container according to a further embodiment of the present invention.
Figure 35:
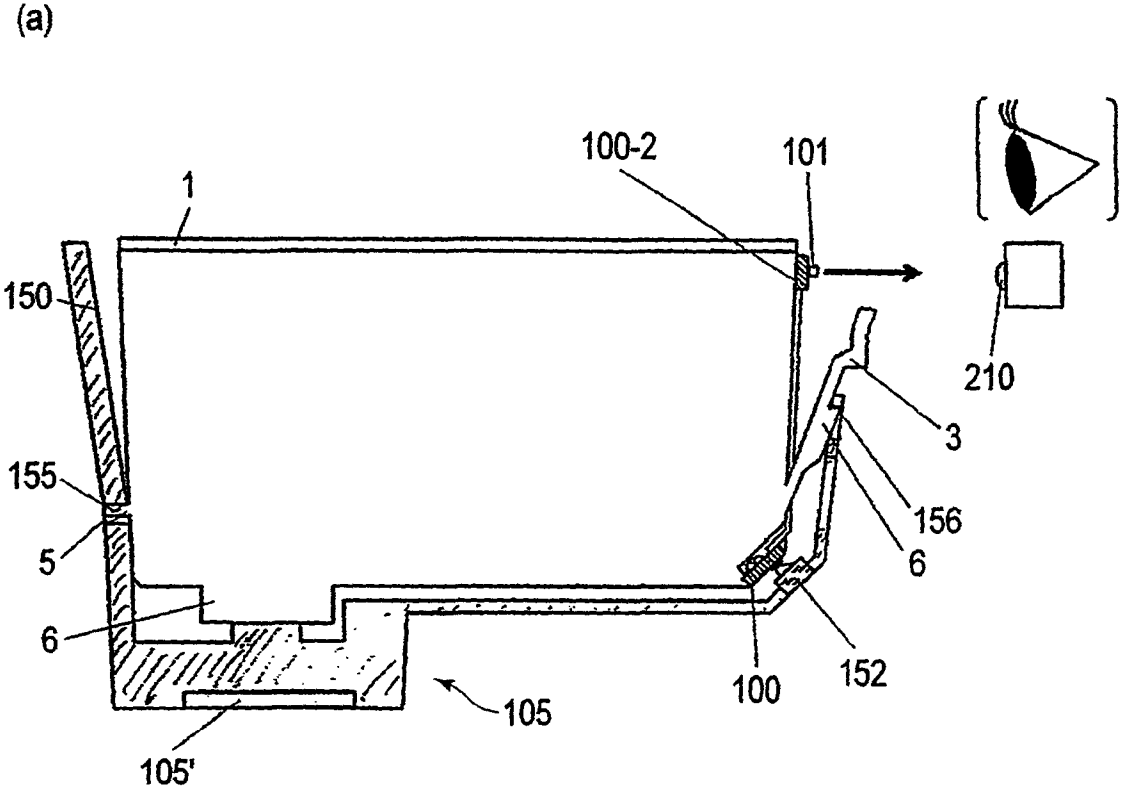

FIG. 35 is a schematic side view (a) and a schematic front view (b) of an ink container according to a further embodiment of the present invention, wherein the first embodiment is modified by placing the substrate and the light emitting portion at different positions.

In this embodiment, substrates 100-2 each having a light emitting portion 101 such as a LED is provided on the top portion of ink container front side. Similarly to the foregoing embodiment, the substrate 100 is provided on an inclined surface portion since doing so is preferable from the standpoint of satisfactory connection with the carriage side connector 152, the protection from the ink, and the substrate 100 is connected with the substrate 100-2 or the light emitting portion 101 by wiring portion 159-2 so that electric signal can be transmitted therebetween. Designated by 3H is a hole formed in a base portion of a supporting member 3 to extend the wiring portion 159-2 along the ink container casing.

In this embodiment, when the light emitting portion 101 is actuated, the light is directed toward the front side. A light receiving portion 210 is disposed at a position for receiving the light which is directed to the right in the Figure adjacent an end of the scanning range of the carriage, and when the carriage faces such a position, the light emission of the light emitting portion 101 is controlled, so that recording device side can obtain the predetermined information relating to the ink container 1 from the content of the received light by the light receiving portion. When the carriage is at the center portion of the scanning range, for example, the light emitting portion 101 is controlled, by which the user is more easily able to see the state of lightening so that predetermined information relating to the ink container 1 can be recognized by the user.

Figure 36:
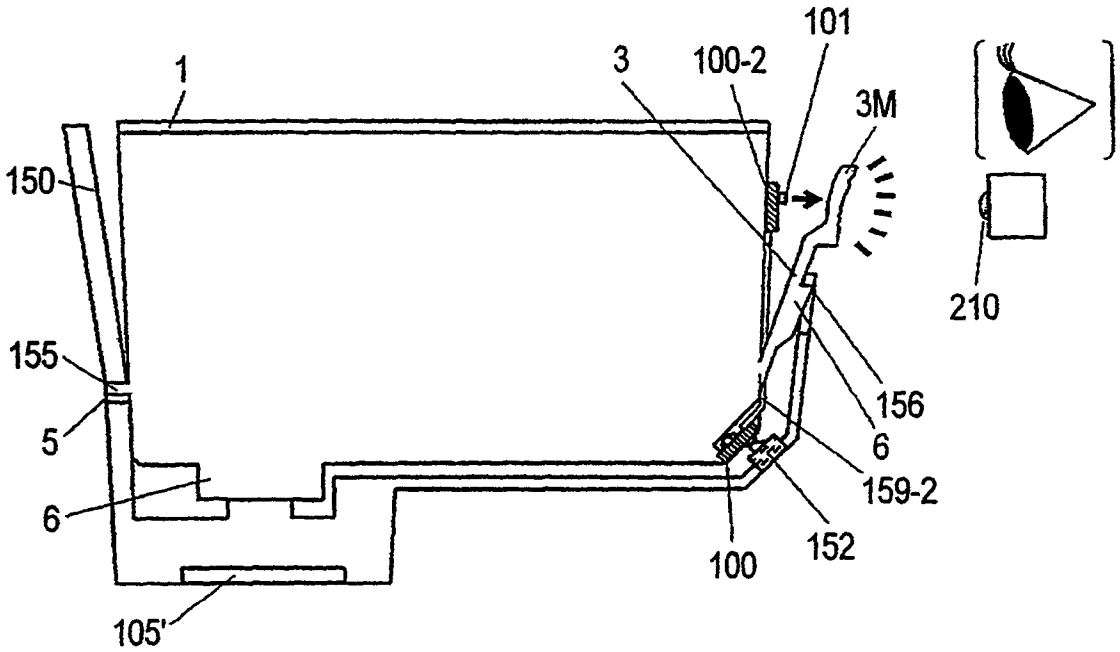
FIG. 36 is a schematic side view of a modified example of the structure of FIG. 35.

FIG. 36 is a schematic side view (a) and a schematic front view (b) of an ink container according to a modified embodiment of FIG. 35. In this embodiment, the light emitting portion 101 and the substrate 100-2 supporting it, are provided on a back side of the operating portion 3M at the ink container front side, the operating portion 3M being the portion manipulated by the user. The functions and advantageous effects of this embodiment are the same as the foregoing embodiments. When the carriage is placed at the center portion of the scanning range, for example, the light emitting portion 101 is actuated, and therefore, the operating portion 3M of the supporting member 3 is also illuminated, so that user can intuitively understand the required manipulation, for example, exchange of the ink container. The operating portion 3M may be provided with a portion for transmitting or scattering a proper amount of the light to facilitate recognition of the illuminated state of the operating portion 3M.

Figure 37:
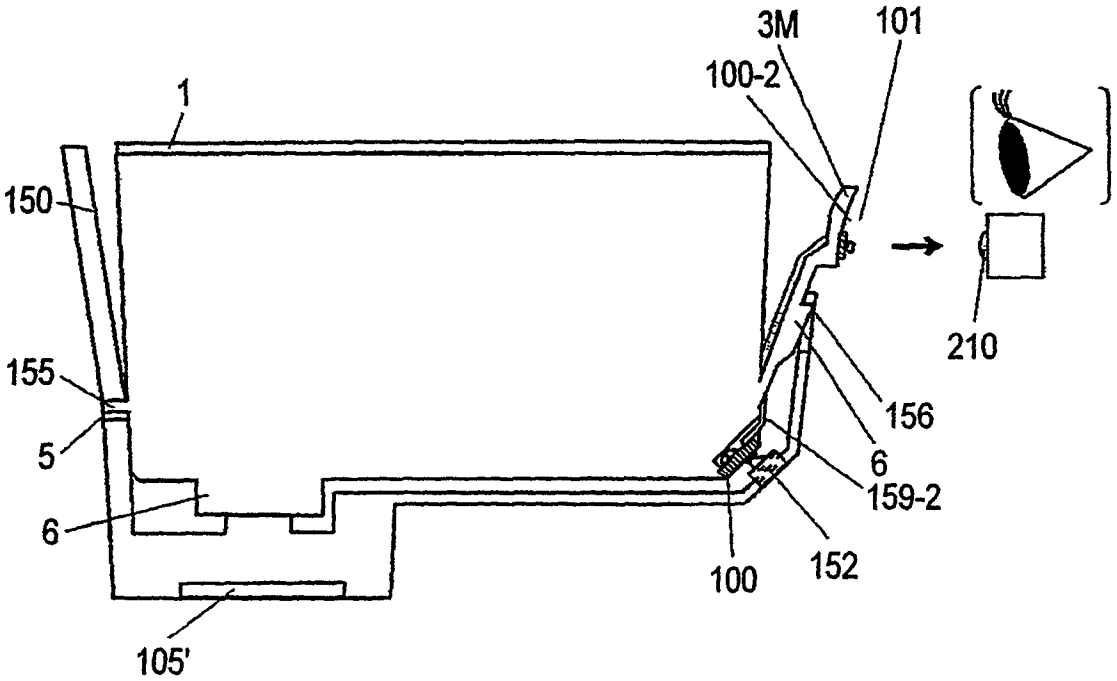
FIG. 37 is a schematic side view of a modified example of the structure of FIG. 35.

FIG. 37 is a schematic side view of a modified example of the structure of FIG. 35. In this embodiment, the substrate 100-2 having the light emitting portion 101 is disposed on a front side of the operating portion 3M of the supporting member 3. The substrate 100, the substrate 100-2 and the light emitting portion 101 are connected with each other through a hole 3H formed in the base portion of the supporting member 3 by a wiring portion 159-2 extending along the supporting member 3. According to this example, the same advantageous effects as with FIG. 36 can be provided.

In the structure shown in FIG. 35-FIG. 37, flexible print cable (FPC) may be used, by which the substrate 100, the wiring portion 159-2 and the substrate 100-2 may be one integral member.

In the foregoing embodiment, the liquid supply system is so-called continuous supply type wherein an amount of the ink ejected out is substantially continuously supplied to the printing head with the use of an ink container separably mounted to the recording head which reciprocates in a main-scanning direction. However, the present invention is applicable to another liquid supply system, wherein the ink container is integrally fixed to the recording head. Even with such a system, if the mounting position is not correct, the recording head receives data for another color, or the order of different color ink ejections is different from the predetermined order with the result of deteriorated recording quality.

The present invention is applicable to another continuous supply type, wherein the ink containers are separate from the recording heads, are provided at fixed positions in the recording device; and the fixed ink containers and the associated recording heads are connected by tubes to supply the inks to the recording heads. Intermediary containers which is fluidically between the ink container and the recording head may be carried on the recording head or carriage.

Figure 38:
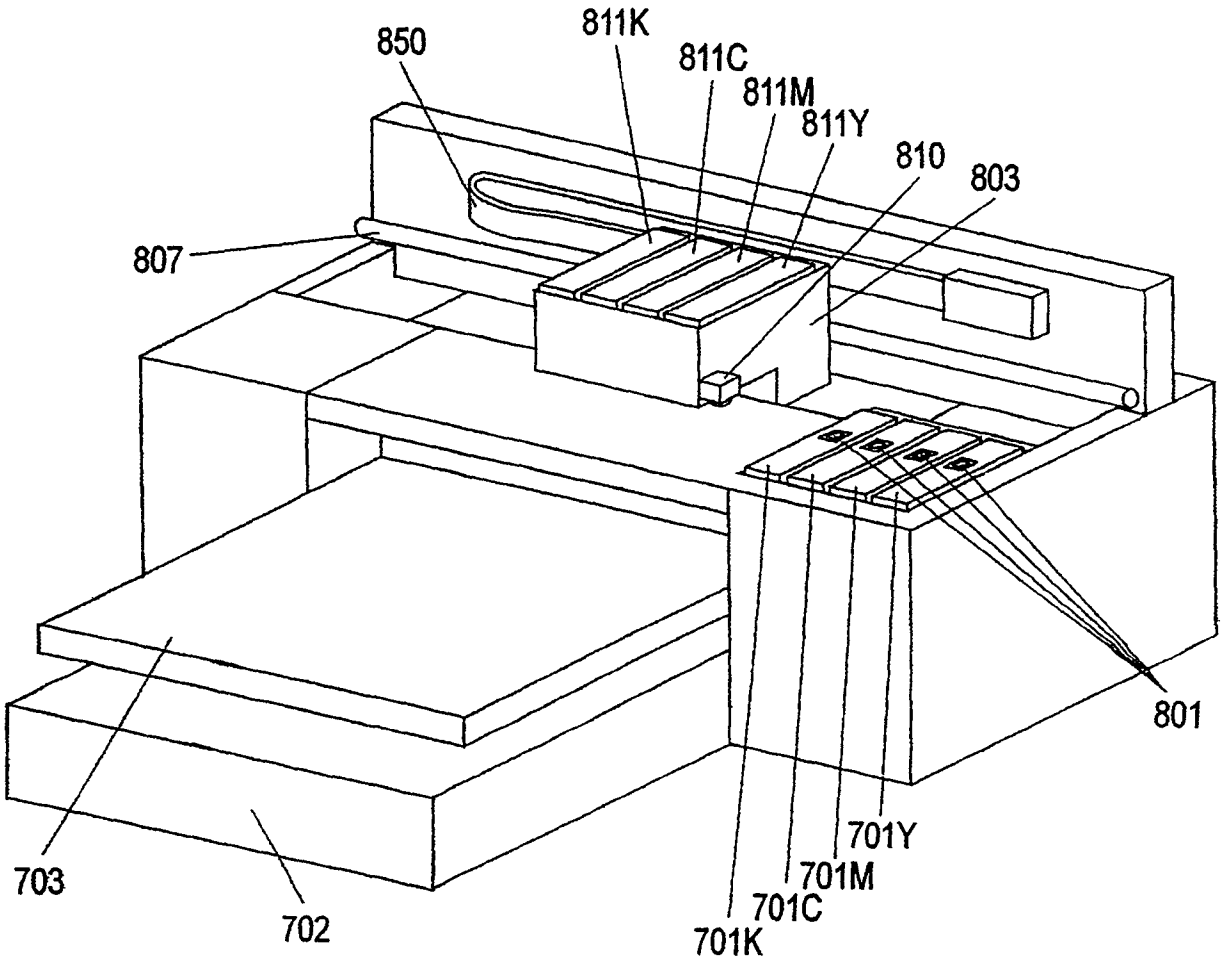
FIG. 38 is a perspective view of a printer having a structure according to a further embodiment of the present invention.

FIG. 38 is a perspective view of a printer having such a structure according to a further embodiment of the present invention.

In this Figure, designated by 702 is a sheet feeding tray in the form of a cassette, and the recording materials are stacked thereon and is singled out during operation. It is fed along a folded-back feeding path to a recording region (unshown) where the recording head is carried on a carriage 803, then to a sheet discharge tray 703. The carriage 803 is supported, guided by a guiding shaft 807, reciprocates along the guiding shaft 807, during which the recording head effects scanning and recording operations.

The carriage 803 carries a recording heads of respective colors. The recording heads have intermediary containers 811K, 811C, 811M and 811Y containing black ink, cyan ink, magenta ink and yellow ink, respectively. The intermediary containers are supplied with the ink from relatively large capacity fixed containers 701K-701Y, respectively, which are detachably mounted at a fixed portion of the apparatus. Designated by 850 is a flexible follower which moves following the movement of the carriage 803. The follower includes electric wiring portion for transmitting electric signals to the respective recording heads carried on the carriage, and a group of ink supply tubes extending from the fixed containers to the intermediary containers. The group of the supply tubes is in fluid communication with the group of the fixed containers through unshown communicating tubes.

The recording operation in this embodiment is similar to that of the foregoing embodiment. In this embodiment, however, the light emitting portions 801 having the function similar to the above-described light emitting portions 101 are provided on the respective fixed containers 701K-701Y. Correspondingly, a light receiving portion 810 for detecting a state of light emission during the main-scanning operation, is provided on the carriage 803. With such a mechanism, the presence or absence of the ink, the presence or absence of the mounted ink container and/or the properness of the mounting of each of the fixed containers 701K-701Y is detected in the manner similar to those described in the foregoing, and the predetermined control operations are carried out. The user can observe the state of light emission of the light emitting portion 801, and therefore the information relating to each of the fixed container. The fixed container may be of a semi-permanent type which is not ordinarily detachable, and in such a case, the ink is replenished into the ink containers when the ink is short in the containers.

Such structures are applicable to an intermittent supply type or so-called pit-stop-supply type as well as to the continuous supply type using the tube. In the pit-stop-supply type, the recording head is provided with an accumulator for retain a relatively small amount of the ink, there is provided a supply system for intermittently supplying the ink at appropriate timing to the accumulator portion from an associated supply source which is fixed in the apparatus and which contain a relatively large amount of the ink.

The ink supply system may be connected only when the ink supply is necessary to the intermediary container from the fixed container. Alternatively, the intermediary container and the supply source container may be connected with each other through a solenoid valve or the like, which is controlled to be open and close to connect and disconnect them at proper timing. Another pit-stop type is usable wherein the intermediary container portion is provided with a gas-liquid separator film which passes gas but not liquid, the air in the container is suctioned through the film to supply the ink into the intermediary container.

Figure 39:
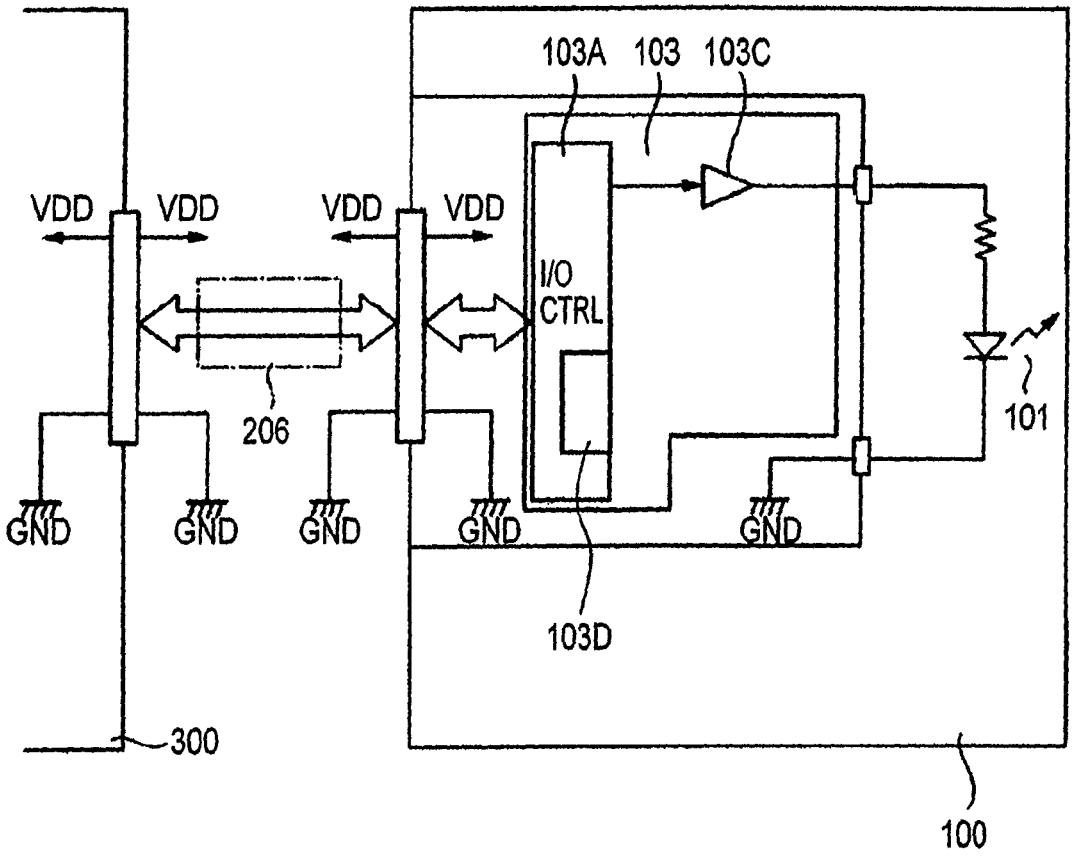
FIG. 39 is a circuit diagram of a substrate having a controller and the like, according to a further embodiment of the present invention.

FIG. 39 is a circuit diagram of a substrate having a controller and the like, according to a further embodiment of the present invention. As shown in this Figure, the controller 103 comprises an I/O control circuit (I/O-CTRL) 103A and a LED driver 103C.

The I/O control circuit 103A actuates the LED 101 in response to the control data supplied from the control circuit 300 provided in the main assembly side through the flexible cable 206.

A LED driver 103C functions to apply a power source voltage to the LED 101 to cause it to emit light when the signal supplied from the I/O control circuit 103A is at a high level. Therefore, when the signal supplied from the I/O control circuit 103A is at a high level, the LED 101 is in the on-state, and when the signal is at a low level, the LED 101 is in the off-state.

This embodiment is different from the first embodiment in that there is not provided a memory array 103B. Even if the information (color information, for example) is not stored in the memory array, the ink container can be identified, the LED 101 of the identified ink container can be actuated or deactuated. newpa Referring to FIG. 40, this will be described.

An I/O control circuit 103A of the controller 103 of the ink container 1 receives start code plus color information, control code is supplied with clock signal CLK, from the main assembly side control circuit 300 through a signal line DATA (FIG. 20). The I/O control circuit 103A includes a command discrimination portion 103D for recognizing a combination of the color information plus the control code as a command, for determining actuation or deactuation of the LED driver 103C. The ink containers 1K, 1C, 1M and 1Y are provided with respective controllers 103 which have different command discrimination portions 103D, and the commands for controlling the ON and OFF of the LED, for the respective colors have the arrangements shown in FIG. 40. Thus, the respective command discrimination portions 103D have the respective individual information (color information) in this sense, and the information is compared with the color information of the inputted command, various operations are controlled. When, for example, the main assembly transmits together with the start code the color information plus control code 000100 indicative of K-ON for turning on the LED of the ink container 1K, only the command discrimination portion 103D of the ink container 1K accept it, so that only, the LED of ink container 1K is switched on. In this embodiment, the controllers 103 have to have structures which are different depending on the colors, but are advantageous in that provision of the memory array 103B is not necessitated.

Figure 40:
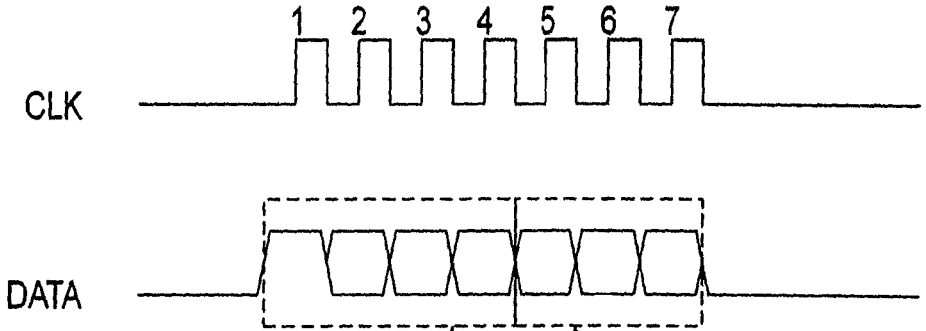
FIG. 40 is a timing chart of an operation in the structure of the embodiment.

The command discrimination portion 103D, as shown in FIG. 40, may have a function of discriminating not only the commands indicative of turning-on and -off of a particular LED 101 but also a command ALL-ON or ALL-OFF indicative of turning-on and -off of the LEDs 101 of all of the ink containers, and/or a CALL command causing a particular color controller 103 to output a reply signal.

As a further alternative, the command including the color information and the control code sent from the main assembly side control circuit 300 to the ink container 1 may not be directly compared with the color information (individual information) in the ink container. In other words, the inputted command is converted or processed in the controller 103, and the value provided as a result of the conversion is compared with the predetermined value stored in the memory array 1038 or the command discrimination portion 103D inner, and only when the result of the comparison corresponds to the predetermined relation, the LED is actuated or deactuated.

As a further alternative, the signal sent from the main assembly side is converted or processed in the controller 103, and the value stored in the memory array 103B or the command control portion 103D is also converted or processed in the controller 103. The converted ones are compared, and only when the result of the comparison corresponds to the predetermined relation, the LED is actuated or deactuated.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 43594212003 filed Dec. 26, 2003, which are hereby incorporated by reference.

What is claimed is:

1. An ink container, comprising:

a container body including a chamber configured to contain an ink;

a substrate positioned outside the chamber, the substrate having a first surface which faces toward an inside of the container body and a second surface which is opposite the first surface;

a light emitter provided on the first surface; and an exposed electrical contact provided on the second surface and configured to receive electrical signal for causing the light emitter to emit light.

2. An ink container according to claim 1, wherein the substrate is supported by the container body.

3. An ink container according to claim 2, wherein the substrate is disposed on an outer surface of the container body so that the light emitter is between the substrate and the outer surface.

4. An ink container according to claim 3, further comprising an elastically deformable latch lever supported by the container body, the latch lever having a latching portion that is spaced apart from the container body, wherein the container body has an ink supply port configured to supply the ink in the chamber to an outside of the container body, and wherein in a state that the ink container is oriented with the ink supply port facing downward, the substrate is between the latching portion and the ink supply port when the ink container is viewed from below.

5. An ink container according to claim 4, wherein in a state that the ink container is oriented with the ink supply port facing downward, the substrate is lower than the latching portion and higher than the ink supply port.

6. An ink container according to claim 2, wherein an outer surface of the container body includes a recessed portion, and wherein the substrate is positioned over the recessed portion so that the light emitter is disposed in the recessed portion.

7. An ink container according to claim 6, further comprising a latch lever supported by the container body, the latch lever having a latching portion that is spaced apart from the container body, wherein the container body has an ink supply port configured to supply the ink in the chamber to an outside of the container body, wherein in a state that the ink container is oriented with the ink supply port facing downward, the substrate is between the latching portion and the ink supply port when the ink container is viewed from below 8. An ink container according to claim 7, wherein in a state that the ink container is oriented with the ink supply port facing downward, the substrate is lower than the latching portion and higher than the ink supply port.

9. An ink container according to claim 1, further comprising:

an ink supply port disposed at a bottom side of the container body and configured to supply the ink in the chamber to an outside of the container body, wherein the substrate is inclined relative to the bottom side.

10. An ink container according to claim 1, further comprising an elastically deformable latch lever having a latching portion, wherein the container body has an ink supply port configured to supply the ink in the chamber to an outside of the container body, and wherein in a state that the ink container is oriented with the ink supply port facing downward, the substrate is between the latching portion and the ink supply port when the container is viewed from below.

11. An ink container according to claim 10, wherein the container body has a bottom side having the ink supply port, a top side, a first side and a second side opposed to the first side, wherein the ink supply port is closer to the first side than to the second side, wherein the latching portion is spaced apart from the second side and is closer to the second side than to the first side, and wherein the substrate is closer to the second side than to the first side and is closer to the bottom side than to the top side.

12. An ink container according to claim 11, wherein in a state that the ink container is oriented with the ink supply port facing downward, the substrate is lower than the latching portion and higher than the ink supply port.

13. An ink container according to claim 11, wherein the container body has an inclined portion which is inclined relative to the bottom side and the second side and which is adjacent to the bottom side and the second side, and wherein the substrate is disposed on the inclined portion.

14. An ink container according to claim 13, further comprising a controller provided on the substrate and storing container discrimination information that indicates a color of the ink in the chamber, wherein the electrical contact is configured to receive second electrical signal for causing the light emitter to stop emitting light, and wherein the controller is capable of (i) causing the light emitter to emit light, using the electrical signal received via the electrical contact and the container discrimination information, and (ii) causing the light emitter to stop emitting light, using the second electrical signal received via the electrical contact and the container discrimination information.

15. An ink container according to claim 10, wherein in a state that the ink container is oriented with the ink supply port facing downward, the substrate is lower than the latching portion and higher than the ink supply port.

16. An ink container according to claim 10, wherein the ink container is configured so that at least a portion of light emitted from the light emitter travels toward an outside of the ink container without passing through the chamber.

17. An ink container according to claim 10, further comprising a controller provided on the substrate and storing container discrimination information that indicates a color of the ink in the chamber, wherein the electrical contact is configured to receive second electrical signal for causing the light emitter to stop emitting light, and wherein the controller is capable of (i) causing the light emitter to emit light using the electrical signal received via the electrical contact and the container discrimination information, and (ii) causing the light emitter to stop emitting light using the second electrical signal received via the electrical contact and the container discrimination information.

18. An ink container according to claim 1, wherein the container body has a bottom side having an ink supply port configured to supply the ink in the chamber to an outside of the container body, a top side, a first side, a second side opposed to the first side and an inclined portion which is inclined relative to the bottom side and the second side and which is adjacent to the bottom side and the second side, wherein the ink container further comprises (i) a projection provided on the first side and configured to provide a center of rotational movement of the ink container during a mounting operation of the ink container to an external device, and (ii) a latch lever supported by the second side and elastically deformable toward the second side, the latch lever having a latching portion that is spaced apart from the second side and that is closer to the second side than to the first side, wherein the ink supply port is closer to the projection than to the latching portion, and wherein the substrate is disposed on the inclined portion.

19. An ink container according to claim 1, wherein the light emitted from the light emitter includes visible light.

20. An ink container according to claim 1, wherein the first surface faces toward the chamber and the second surface faces away from the chamber.

21. An ink container according to claim 1, further comprising a controller provided on the substrate and storing container discrimination information that indicates a color of the ink in the chamber, wherein the electrical contact is configured to receive second electrical signal for causing the light emitter to stop emitting light, and wherein the controller is capable of (i) causing the light emitter to emit light using the electrical signal received via the electrical contact and the container discrimination information, and (ii) causing the light emitter to stop emitting light using the second electrical signal received via the electrical contact and the container discrimination information.

22. An ink container according to claim 21, further comprising a second electrical contact provided on the second surface of the substrate and configured to receive electrical power for the light emitter.

23. An ink container according to claim 22, further comprising a third electrical contact provided on the second surface of the substrate and configured to receive a clock signal, wherein the controller controls timing of light emission of the light emitter based on the clock signal supplied from the third electrical contact.

24. An ink container according to claim 1, wherein the ink container is configured so that at least a portion of light emitted from the light emitter travels toward an outside of the ink container without passing through the chamber.

25. An ink container comprising:

a container body including a chamber configured to contain an ink, the container body having an ink supply port configured to supply the ink in the chamber to an outside of the container body;

an electrical contact;

a light emitter; and a substrate positioned on an outer surface of the container body and provided with the electrical contact and the light emitter, wherein the substrate has a first surface which faces toward an inside of the container body, and a second surface which is opposite the first surface, and wherein the light emitter is provided on the first surface and the electrical contact is provided on the second surface.

26. An ink container according to claim 25, further comprising a controller having a memory storing container discrimination information that indicates a color of the ink in the chamber, wherein the controller is configured (i) to receive data via the electrical contact, (ii) to cause the light emitter to emit light when the received data includes a light-emitting control code for causing the light emitter to emit light and information corresponding to the container discrimination information stored in the memory, and (iii) to extinguish the light emitter when the received data includes an extinction control code for extinguishing the light emitter and the information corresponding to the container discrimination information stored in the memory.

27. An ink container according to claim 26, wherein the controller is provided on the first surface of the substrate.

28. An ink container according to claim 25, wherein the substrate is positioned over a recessed portion of the outer surface so that the light emitter is disposed in the recessed portion.

29. An ink container according to claim 25, wherein at least a portion of light emitted from the light emitter travels toward an outside of the ink container without passing through the ink in the chamber.

30. An ink container according to claim 25, wherein the light emitter is an LED which emits visible light.

31. An ink container according to claim 25, wherein the container body has a bottom side having an ink supply port configured to supply the ink in the chamber to an outside of the container body, a top side, a first side and a second side opposed to the first side, wherein the ink supply port is closer to the first side than to the second side, wherein the ink container further comprises an engaging member elastically deformable toward the second side, the engaging member having an engaging portion which is spaced apart from the second side and which is closer to the second side than to the first side; and wherein the substrate is between the engaging portion and the ink supply port when the container is viewed from below.

32. An ink container according to claim 30, further comprising an engaging projection provided on the first side;

wherein the substrate is inclined relative to the second side and the bottom side.

33. An ink container according to claim 25, further comprising a negative pressure generating member provided in the container body.

34. An ink container comprising:

a container body including a chamber containing ink;

an electrical contact;

a light emitter;

a controller having a memory storing container discrimination information that indicates a color of the ink in the chamber, the controller being configured (a) to receive data including color information via the electrical contact, (b) to control actuation of the light emitter based on the color information included in the received data and the container discrimination information stored in the memory when the received data includes an actuation control code for actuating the light emitter, and (c) to control deactuation of the light emitter based on the color information included in the received data and the container discrimination information stored in the memory when the received data includes a deactuation control code for deactuating the light emitter; and a substrate positioned on an outer surface of the container body and provided with the electrical contact, the light emitter and the controller, wherein the substrate has a first surface which faces toward the chamber, and a second surface which is opposite the first surface and which faces away from the chamber, and wherein the light emitter is provided on the first surface and the electrical contact is provided on the second surface.

35. An ink container according to claim 34, wherein the light emitter is an LED which emits visible light.

36. An ink container according to claim 32, further comprising a negative pressure generating member provided in the container body.

37. An ink container comprising:

a container body including a chamber containing ink;

an ink supply port disposed at a first part of the container body;

a latch lever elastically deformable toward a second part of the container body and having a latching portion spaced apart from the second part, the second part being between the chamber and the latching portion;

an electrical contact;

a light emitter;

a controller having a memory storing container discrimination information that indicates a color of the ink in the chamber, the controller being configured: (a) to receive data including color information via the electrical contact, (b) to control actuation of the light emitter based on the color information included in the received data and the container discrimination information stored in the memory when the received data includes an actuation control code for actuating the light emitter, and (c) to control deactuation of the light emitter based on the color information included in the received data and the container discrimination information stored in the memory when the received data includes a deactuation control code for deactuating the light emitter; and a substrate disposed on an inclined portion of the container body which is adjacent to the first part and the second part and which is inclined relative to the first part and the second part, the substrate being provided with the electrical contact, the light emitter and the controller, wherein the substrate has a first surface which faces toward the chamber, and a second surface which is opposite the first surface and which faces away from the chamber, and wherein the light emitter is provided on the first surface and the electrical contact is provided on the second surface.

38. An ink container according to claim 37, wherein the light emitter is an LED which emits visible light.

39. An ink container according to claim 37, further comprising a negative pressure generating member provided in the container body.

40. An ink container comprising:

a container body including a chamber containing ink;

an electrical contact;

a light emitter;

a controller having a memory storing color information that indicates a color of the ink in the chamber, the controller being configured (a) to turn on the light emitter in response to a turn-on code for turning on the light emitter received via the electrical contact, if color information received via the electrical contact is the same as the color discrimination information stored in the memory, and (b) to turn off the light emitter in response to a turn-off code for turning off the light emitter received via the electrical contact, if the color information received via the electrical contact is the same as the color information stored in the memory; and a substrate positioned on an outer surface of the container body and provided with the electrical contact, the light emitter and the controller, wherein the substrate has a first surface which faces toward the chamber, and a second surface which is opposite the first surface and which faces away from the chamber, and wherein the light emitter is provided on the first surface and the electrical contact is provided on the second surface.

41. An ink container according to claim 40, wherein the light emitter is an LED which emits visible light.

42. An ink container according to claim 40, further comprising a negative pressure generating member provided in the container body.

43. An ink container comprising:

a container body including a chamber containing ink;

an ink supply port disposed at a first part of the container body;

a latch lever elastically deformable toward a second part of the container body and having a latching portion spaced apart from the second part, the second part being between the chamber and the latching portion;

an electrical contact;

a light emitter;

a controller having a memory storing color information that indicates a color of the ink in the chamber, the controller being configured (a) to turn on the light emitter in response to a turn-on code for turning on the light emitter received via the electrical contact, if color information received via the electrical contact is the same as the color information stored in the memory, and (b) to turn off the light emitter in response to a turn-off code for turning off the light emitter received via the electrical contact, if the color information received via the electrical contact is the same as the color information stored in the memory; and a substrate disposed on an inclined portion of the container body which is adjacent to the first part and the second part and which is inclined relative to the first part and the second part, the substrate being provided with the electrical contact, the light emitter and the controller, wherein the substrate has a first surface which faces toward the chamber, and a second surface which is opposite the first surface and which faces away from the chamber, and wherein the light emitter is provided on the first surface and the electrical contact is provided on the second surface.

44. An ink container according to claim 43, wherein the light emitter is an LED which emits visible light.

45. An ink container according to claim 43, further comprising a negative pressure generating member provided in the container body.

46. An ink container, comprising:

a container body including a chamber configured to contain an ink, the container body having an ink supply port configured to supply the ink in the chamber to an outside of the container body;

an elastically deformable latch lever having a latching portion;

a substrate positioned outside of the chamber, the substrate having (i) a first surface that faces toward an inside of the container body and (ii) a second surface that is opposite the first surface;

an electrical contact provided on the second surface; and a light emitter provided on the first surface, wherein in a state that the ink container is oriented with the ink supply port facing downward, the substrate is between the latching portion and the ink supply port when the container is viewed from below.

47. An ink container according to claim 46, wherein the first surface faces toward the chamber and the second surface faces away from the chamber.

48. An ink container according to claim 46, wherein the substrate is disposed on an outer surface of the container body so that the light emitter is between the substrate and the outer surface.

49. An ink container according to claim 46, wherein an outer surface of the container body includes a recessed portion, and wherein the substrate is positioned over the recessed portion so that the light emitter is disposed in the recessed portion.

50. An ink container according to claim 46, wherein the ink supply port is disposed at a bottom side of the container body, and wherein the substrate is inclined relative to the bottom side.

51. An ink container according to claim 50, further comprising:

a controller provided on the substrate and storing container discrimination information that indicates a color of an ink in the chamber, wherein the controller is configured:

(a) to receive data via the electrical contact, (b) to turn on the light emitter, if (i) the received data includes a turn-on code for turning on the light emitter and (ii) the received data includes information corresponding to the container discrimination information, and (c) to turn off the light emitter, if (i) the received data includes a turn-off code for turning off the light emitter and (ii) the received data includes information corresponding to the container discrimination information.

52. An ink container according to claim 46, wherein the container body has a bottom side having the ink supply port, a top side, a first side and a second side opposed to the first side, wherein the ink supply port is closer to the first side than to the second side, wherein the latching portion is spaced apart from the second side and is closer to the second side than to the first side, and wherein the substrate is closer to the second side than to the first side and is closer to the bottom side than to the top side.

53. An ink container according to claim 52, wherein in a state that the ink container is oriented with the ink supply port facing downward, the substrate is lower than the latching portion and higher than the ink supply port.

54. An ink container according to claim 52, wherein the container body has an inclined portion which is inclined relative to the bottom side and the second side and which is adjacent to the bottom side and the second side, and wherein the substrate is disposed on the inclined portion.

55. An ink container according to claim 52, further comprising:

a controller provided on the substrate and storing container discrimination information that indicates a color of an ink in the chamber, wherein the controller is configured:

(a) to receive data via the electrical contact, (b) to turn on the light emitter, if (i) the received data includes a turn-on code for turning on the light emitter and (ii) the received data includes information corresponding to the container discrimination information, and (c) to turn off the light emitter, if (i) the received data includes a turn-off code for turning off the light emitter and (ii) the received data includes information corresponding to the container discrimination information.

56. An ink container according to claim 46, wherein in a state that the ink container is oriented with the ink supply port facing downward, the substrate is lower than the latching portion and higher than the ink supply port.

57. An ink container according to claim 46, wherein the container body has a bottom side having the ink supply port, a top side, a first side and a second side opposed to the first side, wherein the ink container further comprises an engaging projection provided on the first side, wherein the latch lever is supported by the second side and is elastically deformable toward the second side, wherein the latching portion is spaced apart from the second side and is closer to the second side than to the first side, wherein the ink supply port is closer to the first side than to the second side, and wherein the substrate is closer to the second side than to the first side and is closer to the bottom side than to the top side.

58. An ink container according to claim 57, further comprising:

a controller provided on the substrate and storing container discrimination information that indicates a color of an ink in the chamber, wherein the controller is configured:

(a) to receive data via the electrical contact, (b) to turn on the light emitter, if (i) the received data includes a turn-on code for turning on the light emitter and (ii) the received data includes information corresponding to the container discrimination information, and (c) to turn off the light emitter, if (i) the received data includes a turn-off code for turning off the light emitter and (ii) the received data includes information corresponding to the container discrimination information.

59. An ink container according to claim 46, wherein the container body has a bottom side having the ink supply port, a top side, a first side, a second side opposed to the first side and an inclined portion which is inclined relative to the bottom side and the second side and which is adjacent to the bottom side and the second side, wherein the ink container further comprises a projection provided on the first side and configured to provide a center of rotational movement of the ink container during a mounting operation of the ink container to an external device, wherein the latch lever is supported by the second side and is elastically deformable toward the second side, wherein the latching portion is spaced apart from the second side and is closer to the second side than to the first side, wherein the ink supply port is closer to the projection than to the latching portion, and wherein the substrate is disposed on the inclined portion.

60. An ink container according to claim 46, wherein the ink container is configured so that at least a portion of light emitted from the light emitter travels toward an outside of the ink container without passing through the chamber.

61. An ink container according to claim 46, wherein the light emitted from the light emitter includes visible light.

62. An ink container according to claim 46, further comprising:

a controller provided on the substrate and storing container discrimination information that indicates a color of an ink in the chamber, wherein the controller is configured:

(a) to receive data via the electrical contact, (b) to turn on the light emitter, if (i) the received data includes a turn-on code for turning on the light emitter and (ii) the received data includes information corresponding to the container discrimination information, and (c) to turn off the light emitter, if (i) the received data includes a turn-off code for turning off the light emitter and (ii) the received data includes information corresponding to the container discrimination information.

63. An ink container according to claim 62, further comprising a second electrical contact provided on the second surface of the substrate and configured to supply the light emitter with electrical power.

64. An ink container according to claim 63, further comprising a third electrical contact provided on the second surface of the substrate and configured to supply the controller with a clock signal, wherein the controller is configured to control turn-on timing and the turn-off timing of the light emitter based on the clock signal supplied from the third electrical contact.

65. An ink container according to claim 62, wherein the controller is capable of continuously maintaining an on-state of the light emitter from the time when the controller turns on the light emitter based on the turn-on code until the controller turns off the light emitter based on the turn-off code.

66. An ink container according to claim 62, wherein the substrate is disposed on an outer surface of the container body so that the light emitter is between the substrate and the outer surface.

67. An ink container according to claim 46, further comprising:

a controller (a) storing container discrimination information that indicates a color of an ink in the chamber, and (b) capable of turning on the light emitter based on a turn-on code for turning the light emitter and color information supplied from the electrical contact and the stored container discrimination information.

68. An ink container according to claim 67, wherein the controller is configured to turn on the light emitter in response to the turn-on code, if the color information corresponds to the container discrimination information.

69. An ink container according to claim 67, wherein the controller is configured to turn on the light emitter in response to the turn-on code, if a color indicated by the color information is the same as the color indicated by the container discrimination information.

70. An ink container according to claim 1, further comprising a negative pressure generating member provided in the container body.

71. An ink container according to claim 46, further comprising a negative pressure generating member provided in the container body.

* * * * *